US007581804B2

(12) United States Patent
Ishimoto et al.

(10) Patent No.: US 7,581,804 B2
(45) Date of Patent: Sep. 1, 2009

(54) PRINTING APPARATUS AND PRINTING METHOD

(75) Inventors: Bunji Ishimoto, Nagano-ken (JP); Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 256 days.

(21) Appl. No.: 11/446,177

(22) Filed: Jun. 5, 2006

(65) Prior Publication Data

US 2006/0279597 A1 Dec. 14, 2006

(30) Foreign Application Priority Data

Jun. 3, 2005 (JP) ..... 2005-164253
Jun. 14, 2005 (JP) ..... 2005-173854

(51) Int. Cl.
*B41J 29/38* (2006.01)

(52) U.S. Cl. ..... 347/16; 347/14; 347/5

(58) Field of Classification Search ..... 347/16, 347/19, 14, 5, 9
See application file for complete search history.

(56) References Cited

U.S. PATENT DOCUMENTS 6,283,570 B1 * 9/2001 Komiya et al. ..... 347/15
2003/0179256 A1 * 9/2003 Endo ..... 347/19

FOREIGN PATENT DOCUMENTS

JP 6-166247 A 6/1994

* cited by examiner

*Primary Examiner*—Lam S Nguyen
(74) *Attorney, Agent, or Firm*—Sughrue Mion, PLLC

(57) ABSTRACT

A correction of density is effectively performed. The printing method includes the following steps. A step of performing correction of density for only a predetermined color, among a plurality of colors, for each dot row region so as to suppress the unevenness in density between rows of dots on a medium formed with the rows of dots arranged along a movement direction by each of the nozzles, when a plurality of the nozzles, that ejects a plurality of colors of different ink and that are arranged along a predetermined direction for each color of ink, ejects ink while being moved in a movement direction that intersects a predetermined direction. A step of printing by ejecting ink while a plurality the nozzles are moved.

8 Claims, 44 Drawing Sheets

Correction value table (cyan)

| Dot row region number | Region A | | | Region B | | | Region C | | | Region D | | | Region E | | | Region F | | | Region G | | | Region H | | |
|---|---|---|---|---|---|---|---|---|---|---|---|---|---|---|---|---|---|---|---|---|---|---|---|---|
| | Sb | Sc | Sd | Sb | Sc | Sd | Sb | Sc | Sd | Sb | Sc | Sd | Sb | Sc | Sd | Sb | Sc | Sd | Sb | Sc | Sd | Sb | So | Sd |
| 1 | $Hb_1$ | $Hc_1$ | $Hd_1$ | $Hb_1$ | $Hc_1$ | $Hd_1$ | $Hb_1$ | $Hc_1$ | $Hd_1$ | $Hb_1$ | $Hc_1$ | $Hd_1$ | $Hb_1$ | $Hc_1$ | $Hd_1$ | $Hb_1$ | $Hc_1$ | $Hd_1$ | $Hb_1$ | $Hc_1$ | $Hd_1$ | $Hb_1$ | $Hc_1$ | $Hd_1$ |
| 2 | $Hb_2$ | $Hc_2$ | $Hd_2$ | $Hb_2$ | $Hc_2$ | $Hd_2$ | $Hb_2$ | $Hc_2$ | $Hd_2$ | $Hb_2$ | $Hc_2$ | $Hd_2$ | $Hb_2$ | $Hc_2$ | $Hd_2$ | $Hb_2$ | $Hc_2$ | $Hd_2$ | $Hb_2$ | $Hc_2$ | $Hd_2$ | $Hb_2$ | $Hc_2$ | $Hd_2$ |
| 3 | $Hb_3$ | $Hc_3$ | $Hd_3$ | $Hb_3$ | $Hc_3$ | $Hd_3$ | $Hb_3$ | $Hc_3$ | $Hd_3$ | $Hb_3$ | $Hc_3$ | $Hd_3$ | $Hb_3$ | $Hc_3$ | $Hd_3$ | $Hb_3$ | $Hc_3$ | $Hd_3$ | $Hb_3$ | $Hc_3$ | $Hd_3$ | $Hb_3$ | $Hc_3$ | $Hd_3$ |
| 4 | $Hb_4$ | $Hc_4$ | $Hd_4$ | $Hb_4$ | $Hc_4$ | $Hd_4$ | $Hb_4$ | $Hc_4$ | $Hd_4$ | $Hb_4$ | $Hc_4$ | $Hd_4$ | $Hb_4$ | $Hc_4$ | $Hd_4$ | $Hb_4$ | $Hc_4$ | $Hd_4$ | $Hb_4$ | $Hc_4$ | $Hd_4$ | $Hb_4$ | $Hc_4$ | $Hd_4$ |
| 5 | $Hb_5$ | $Hc_5$ | $Hd_5$ | $Hb_5$ | $Hc_5$ | $Hd_5$ | $Hb_5$ | $Hc_5$ | $Hd_5$ | $Hb_5$ | $Hc_5$ | $Hd_5$ | $Hb_5$ | $Hc_5$ | $Hd_5$ | $Hb_5$ | $Hc_5$ | $Hd_5$ | $Hb_5$ | $Hc_5$ | $Hd_5$ | $Hb_5$ | $Hc_5$ | $Hd_5$ |
| 6 | $Hb_6$ | $Hc_6$ | $Hd_6$ | $Hb_6$ | $Hc_6$ | $Hd_6$ | $Hb_6$ | $Hc_6$ | $Hd_6$ | $Hb_6$ | $Hc_6$ | $Hd_6$ | $Hb_6$ | $Hc_6$ | $Hd_6$ | $Hb_6$ | $Hc_6$ | $Hd_6$ | $Hb_6$ | $Hc_6$ | $Hd_6$ | $Hb_6$ | $Hc_6$ | $Hd_6$ |
| 7 | $Hb_7$ | $Hc_7$ | $Hd_7$ | $Hb_7$ | $Hc_7$ | $Hd_7$ | $Hb_7$ | $Hc_7$ | $Hd_7$ | $Hb_7$ | $Hc_7$ | $Hd_7$ | $Hb_7$ | $Hc_7$ | $Hd_7$ | $Hb_7$ | $Hc_7$ | $Hd_7$ | $Hb_7$ | $Hc_7$ | $Hd_7$ | $Hb_7$ | $Hc_7$ | $Hd_7$ |

| Dot row region number | Measurement value (cyan) | | | | |
|---|---|---|---|---|---|
| | 76 (30%) | 102 (40%) | 128 (50%) | 153 (60%) | 179 (70%) |
| 1 | 78 | 100 | 125 | 155 | 182 |
| 2 | 75 | 99 | 128 | 151 | 179 |
| 3 | 76 | 103 | 130 | 152 | 176 |
| ⋮ | | ⋮ | | ⋮ | |
| 59 | 77 | 101 | 127 | 154 | 183 |
| 60 | 72 | 99 | 128 | 156 | 184 |

Correction value table (cyan)

| Dot row region number | Region A | | | Region B | | | Region C | | | Region D | | | Region E | | | Region F | | | Region G | | | Region H | | |
|---|---|---|---|---|---|---|---|---|---|---|---|---|---|---|---|---|---|---|---|---|---|---|---|---|
| | Sb | Sc | Sd | Sb | Sc | Sd | Sb | Sc | Sd | Sb | Sc | Sd | Sb | Sc | Sd | Sb | Sc | Sd | Sb | Sc | Sd | Sb | Sc | Sd |
| 1 | Hb_1 | Hc_1 | Hd_1 | Hb_1 | Hc_1 | Hd_1 | Hb_1 | Hc_1 | Hd_1 | Hb_1 | Hc_1 | Hd_1 | Hb_1 | Hc_1 | Hd_1 | Hb_1 | Hc_1 | Hd_1 | Hb_1 | Hc_1 | Hd_1 | Hb_1 | Hc_1 | Hd_1 |
| 2 | Hb_2 | Hc_2 | Hd_2 | Hb_2 | Hc_2 | Hd_2 | Hb_2 | Hc_2 | Hd_2 | Hb_2 | Hc_2 | Hd_2 | Hb_2 | Hc_2 | Hd_2 | Hb_2 | Hc_2 | Hd_2 | Hb_2 | Hc_2 | Hd_2 | Hb_2 | Hc_2 | Hd_2 |
| 3 | Hb_3 | Hc_3 | Hd_3 | Hb_3 | Hc_3 | Hd_3 | Hb_3 | Hc_3 | Hd_3 | Hb_3 | Hc_3 | Hd_3 | Hb_3 | Hc_3 | Hd_3 | Hb_3 | Hc_3 | Hd_3 | Hb_3 | Hc_3 | Hd_3 | Hb_3 | Hc_3 | Hd_3 |
| 4 | Hb_4 | Hc_4 | Hd_4 | Hb_4 | Hc_4 | Hd_4 | Hb_4 | Hc_4 | Hd_4 | Hb_4 | Hc_4 | Hd_4 | Hb_4 | Hc_4 | Hd_4 | Hb_4 | Hc_4 | Hd_4 | Hb_4 | Hc_4 | Hd_4 | Hb_4 | Hc_4 | Hd_4 |
| 5 | Hb_5 | Hc_5 | Hd_5 | Hb_5 | Hc_5 | Hd_5 | Hb_5 | Hc_5 | Hd_5 | Hb_5 | Hc_5 | Hd_5 | Hb_5 | Hc_5 | Hd_5 | Hb_5 | Hc_5 | Hd_5 | Hb_5 | Hc_5 | Hd_5 | Hb_5 | Hc_5 | Hd_5 |
| 6 | Hb_6 | Hc_6 | Hd_6 | Hb_6 | Hc_6 | Hd_6 | Hb_6 | Hc_6 | Hd_6 | Hb_6 | Hc_6 | Hd_6 | Hb_6 | Hc_6 | Hd_6 | Hb_6 | Hc_6 | Hd_6 | Hb_6 | Hc_6 | Hd_6 | Hb_6 | Hc_6 | Hd_6 |
| 7 | Hb_7 | Hc_7 | Hd_7 | Hb_7 | Hc_7 | Hd_7 | Hb_7 | Hc_7 | Hd_7 | Hb_7 | Hc_7 | Hd_7 | Hb_7 | Hc_7 | Hd_7 | Hb_7 | Hc_7 | Hd_7 | Hb_7 | Hc_7 | Hd_7 | Hb_7 | Hc_7 | Hd_7 |

Fig. 21

| Dot row region number | Measurement value (cyan) | | | | |
|---|---|---|---|---|---|
| | 76 (30%) | 102 (40%) | 128 (50%) | 153 (60%) | 179 (70%) |
| 1 | 78 | 100 | 125 | 155 | 182 |
| 2 | 75 | 99 | 128 | 151 | 179 |
| 3 | 76 | 103 | 130 | 152 | 176 |
| ⋮ | | ⋮ | | ⋮ | |
| n−1 | 77 | 101 | 127 | 154 | 183 |
| n | 72 | 99 | 128 | 156 | 184 |

Correction value table

| Dot row region number | cyan | | |
|---|---|---|---|
| | Sb | Sc | Sd |
| 1 | Hb_1 | Hc_1 | Hd_1 |
| 2 | Hb_2 | Hc_2 | Hd_2 |
| 3 | Hb_3 | Hc_3 | Hd_3 |
| 4 | Hb_4 | Hc_4 | Hd_4 |
| 5 | Hb_5 | Hc_5 | Hd_5 |
| 6 | Hb_6 | Hc_6 | Hd_6 |
| 7 | Hb_7 | Hc_7 | Hd_7 |
| ⋮ | | ⋮ | |
| n−1 | Hb_n−1 | Hc_n−1 | Hd_n−1 |
| n | Hb_n | Hc_n | Hd_n |

Fig. 42

PRINTING APPARATUS AND PRINTING METHOD

CROSS-REFERENCE TO RELATED APPLICATIONS

The present application claims priority upon Japanese Patent Application No. 2005-164253 filed on Jun. 3, 2005 and 2005-173854 filed on Jun. 14, 2005, which is herein incorporated by reference.

BACKGROUND

1. Technical Field

The present invention relates to printing apparatuses and printing methods for suppressing unevenness in density in an image.

2. Related Art

Inkjet printers (hereinafter referred to as "printers") are known as a printing apparatus that forms an image by ejecting ink onto a paper as a medium. This printer alternately repeats a dot forming operation for forming dots on the paper by ejecting ink from a plurality of nozzles that move in a movement direction of a carriage, and a carrying operation for carrying the paper by a carry section that includes a carry roller in an intersecting direction that intersects the movement direction (hereinafter also referred to as "carrying direction"). Thus, a plurality of raster lines constituted by a plurality of dots that are arranged along the movement direction are formed and arranged in the intersecting direction, and an image is printed (for example, refer to JP-A-6-166247). In such a printer, in order to suppress occurrence of unevenness in density, there is the case where the density of an image that has been printed based on image data for printing the image with a predetermined density is read for each row region in which the raster line is formed, and the image data of the image to be printed is corrected for each row region based on the read information.

However, with the above-described printer, there is the case where a plurality of raster lines that are originally formed in the carrying direction at equal intervals are not formed at equal intervals due to decentering of the carry roller. Even if an image is printed based on the image data for printing the image with a predetermined density with such a printer, there is a possibility that the image will not be printed at an appropriate density. Also, if the image data is corrected based on information obtained by reading an image printed at a wrong density, there is a possibility that the image data will not be appropriately corrected, and the unevenness in density will not be suppressed.

SUMMARY

The present invention has been devised in consideration of these issues, and it is an object thereof to achieve a printing apparatus and a printing method that are capable of suppressing effects on correction due to decentering of the carry roller.

An aspect of the present invention for achieving the above-described object is a printing apparatus including: (a) a carry section provided with a carry roller for intermittently carrying a medium on which an image is to be printed in increments of a predetermined amount in a carrying direction; (b) a nozzle for forming a dot based on corrected data obtained by correcting image data for printing the image on the medium that has been carried by the carry section; (c) a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount; and (d) a controller that causes a dot to be formed based on the corrected data that has been corrected based on the correction value table.

Other features of the present invention will become clear by the description of the present specification with reference to the accompanying drawings.

BRIEF DESCRIPTION OF THE DRAWINGS

FIG. 21 is an explanatory diagram of the cyan correction value table.

FIG. 42 is an explanatory diagram of a cyan correction value table.

DESCRIPTION OF EXEMPLARY EMBODIMENTS

Figure 1:
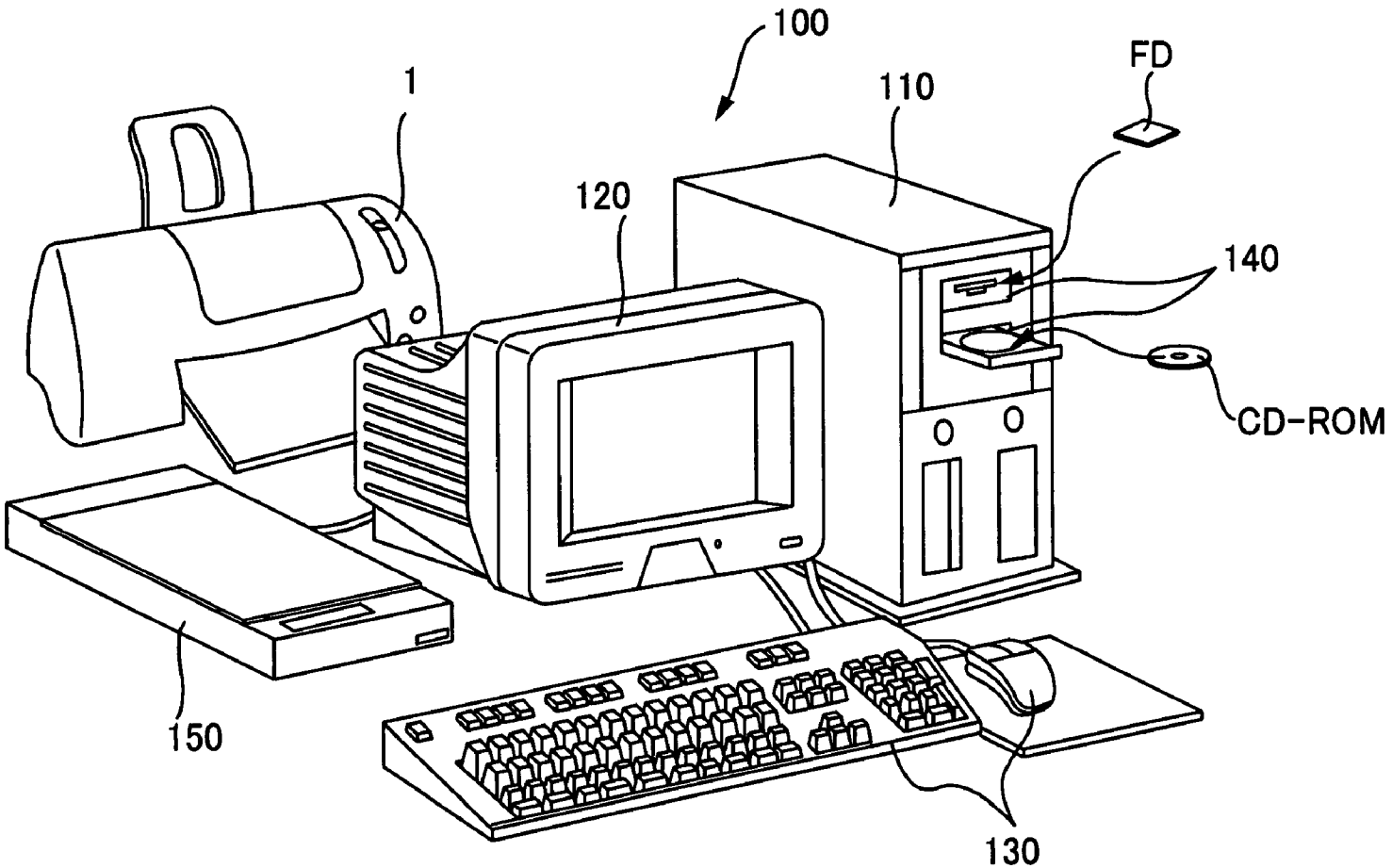
FIG. 1 is a diagram for describing the configuration of a printing system.

At least the following matters will be made clear by the explanation in the present specification and the description of the accompanying drawings.

A printing apparatus that includes: (a) a carry section provided with a carry roller for intermittently carrying a medium on which an image is to be printed in increments of a predetermined amount in a carrying direction; (b) a nozzle for forming a dot based on corrected data obtained by correcting image data for printing the image on the medium that has been carried by the carry section; (c) a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount; and (d) a controller that causes a dot to be formed based on the corrected data that has been corrected based on the correction value table.

With such a printing apparatus, since the set regions that are virtually set so the theoretical circumferential surface length of the set region from the predetermined reference position in the circumferential direction of the carry roller becomes equal to a theoretical amount of the predetermined amount that the carry section intermittently carries the medium are associated with the correction values for correcting the image data, it is possible to correct the image data corresponding to one carrying operation by the carry section. Therefore, it is possible to perform correction corresponding to each carrying operation in which the medium is intermittently carried.

In such printing apparatus, it is preferable that the image is printed by alternately repeating a carrying operation for carrying the medium and a dot forming operation for forming the dot, and in the correction value table, it is preferable that the set region that was in contact with the medium when the medium was carried by the carrying operation is associated with a correction value for correcting the image data that is to be used in the dot forming operation after that carrying operation.

With such a printing apparatus, since the correction values are associated with the set region that was in contact with the medium during the carrying operation immediately before dots are formed based on the corrected data, the correction values with which the image data is corrected correspond to the portion of the carry roller that was in contact with the medium during the carrying operation immediately before dots are formed. Therefore, in the case the carry amount by which the medium is carried by the carrying operation immediately before the dots are formed differs from the theoretical carry amount and contains an error or the like, it is possible to print a fine quality image by setting the correction values so as to correct the image data to suppress the error.

In such a printing apparatus, it is preferable that the theoretical circumferential surface length of the set region corresponding to n rotations (n is an integer) of the carry roller coincides with an amount which is obtained by multiplying by an integer the theoretical amount of the predetermined amount.

With such a printing apparatus, the portion of the carry roller that was first in contact with the medium coincides with the portion of the carry roller that contacts the medium after the carry roller performs n rotations. In other words, the amount carried by n rotations of the carry roller is equal to the amount by which the medium is carried by a predetermined times of the carrying operation. For such reason, in a case where the carry roller rotates n times or more, there will be carrying operations in which the medium is carried over the single set region. For example, in a case where the carry roller finishes n times of rotation after repeating the carrying operation "m" times, the set region that was in contact with the medium at the (m+1)th carrying operation is the same as the set region that was in contact with the medium at the first carrying operation. Thus, it is not necessary to set correction values corresponding to all the carrying operations performed in printing an image, and only correction values for the set regions that contact the medium in the carrying operations carried out when the carry roller rotates for n times are needed. Accordingly, it is possible to reduce the correction value table in which the set regions and the correction values are associated with each other.

In such a printing apparatus, it is preferable to include a detection section for detecting the reference position and a displacement amount of the reference position in the carrying operation, wherein the controller detects the set region that was in contact with the medium when the medium was carried by the carrying operation by detecting the displacement amount with the detection section.

With such a printing apparatus, since the displacement of a predetermined reference position in the circumferential direction of the carry roller is detected by the detection section, it is possible to detect the set region that was in contact with the medium during the carrying operation from among a plurality of set regions that are set according to the circumferential length from the reference position.

In such a printing apparatus, it is preferable that the detection section is a rotary encoder for detecting a rotation amount of the carry roller.

With such a printing apparatus, since the detection section is a rotary encoder, it is possible to detect more precisely the set region that was in contact with the medium when the medium was carried by the carrying operation.

In such a printing apparatus, it is preferable that the nozzle forms a row of dots on the medium by ejecting ink while being moved in a movement direction that intersects the carrying direction, and the correction value table is created based on a read result of a correction pattern so as to suppress unevenness in density between row regions each formed with the row of dots arranged along the movement direction.

The unevenness in density among the row regions each formed with the row of dots arranged along the movement direction that intersects the carrying direction occurs in cases where the medium is not accurately carried by the carrying operation. However, the correction value table for correcting the unevenness in density among the row regions is created based on the results read of the correction pattern, and therefore it is possible to create an appropriate correction value table that corresponds to the actual carrying condition.

Here, when a rectangular region that is virtually set on a medium such as a paper is assumed to be a "unit region" whose size and shape are determined depending on the print resolution, a "row region" refers to a region constituted by a plurality of unit regions arranged in the movement direction. For example, in the case where the print resolution is 720 dpi (movement direction)×720 dpi (carrying direction), the "unit region" becomes a square region of approximately 35.28 μm×35.28 μm (≈1/720 inch×1/720 inch). In the case where the print resolution is 360 dpi×720 dpi, the "unit region" becomes a rectangular region of approximately 70.56 μm×35.28 μm (≈1/360 inch×1/720 inch). When an ink droplet is ideally ejected, the ink droplet lands on the central position of this unit region and subsequently spreads on a medium, thereby forming a dot in the unit region. Then, in the case where the print resolution is 720 dpi×720 dpi for example, the "row region" is a band-like region with a width of approximately 35.28 μm (≈1/720 inch) in the carrying direction, and when an ink droplet is intermittently ejected in an ideal manner from the nozzles that are moving in the movement direction, a row of dots is formed in the row region.

In such a printing apparatus, it is preferable that the image data indicates a tone value of each unit region, a correction value is obtained for each row region based on the read result of the correction pattern that is printed based on the image data indicating a predetermined tone value, and in the correction value table, the set region that was in contact with the medium during the carrying operation immediately before the dot forming operation that formed the row of dots configuring the correction pattern is associated with a correction value corresponding to the row region in which a row of dots is formed by that dot row forming operation.

With such a printing apparatus, correction values obtained for the respective row regions are associated with the row regions formed with rows of dots by the dot forming operations that formed rows of dots that constitute the correction pattern. Furthermore, the correction values are associated with the set regions that were in contact with the medium during the carrying operations immediately before the dot forming operations that formed rows of dots that constitute the correction pattern. Therefore, each correction value is set by the correction value table to show the association between the correction values and the image data for forming a row of dots to be formed in any of the row regions, after the medium is carried over any of the set regions of the carry roller. As a result, it is possible to appropriately correct image data by correcting the image data based on the correction value table.

In such a printing apparatus, it is preferable that in the correction pattern, a plurality of the rows of dots formed by ink ejected from the nozzle that is moved in the movement direction are printed arranged along the carrying direction based on a tone value indicating a predetermined density.

With such a printing apparatus, since a plurality of rows of dots are printed arranged along the carrying direction, it is possible to read the unevenness in density between the row regions in which rows of dots are formed by reading the correction pattern. Since the image data is corrected based on the read results of this correction pattern, it is possible to suitably suppress the unevenness in density between the row regions in the image to be printed.

In such a printing apparatus, it is preferable that the correction pattern includes rows of dots corresponding to row regions included in a theoretical carrying distance by which the medium is carried when the carry roller rotates n times that coincide with an amount obtained by multiplying by an integer the theoretical amount of the predetermined amount.

With such a printing apparatus, the carrying operations in which the medium is carried over a plurality of different set regions that are set in different circumferential surfaces of the carry roller are repeated when the carry roller rotates n times. The correction pattern includes all the rows of dots that are formed in the respective row regions when the medium is carried over each of the plurality of the set regions. For this reason, it is possible to obtain all the correction values that correspond to the image data of an image to be printed by reading the correction pattern.

It is also possible to achieve a printing method that is includes:

carrying a medium by a carry section provided with a carry roller for intermittently carrying the medium on which an image is to be printed in increments of a predetermined amount in a carrying direction; and forming a dot based on corrected data obtained by correcting the image data for printing the image based on a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount.

A printing apparatus comprising:

(a) a carry section provided with a carry roller for intermittently carrying a medium on which an image is to be printed in increments of a predetermined amount in a carrying direction;

(b) a nozzle for forming a dot based on corrected data obtained by correcting image data for printing the image on the medium that has been carried by the carry section;

(c) a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount; and (d) a controller that causes a dot to be formed based on the corrected data that has been corrected based on the correction value table, (e) wherein the image is printed by alternately repeating a carrying operation for carrying the medium and a dot forming operation for forming the dot, and in the correction value table, the set region that was in contact with the medium when the medium was carried by the carrying operation is associated with a correction value for correcting the image data that is to be used in the dot forming operation after that carrying operation, (f) wherein the theoretical circumferential surface length of the set region corresponding to n rotations (n is an integer) of the carry roller coincides with an amount which is obtained by multiplying by an integer the theoretical amount of the predetermined amount, (g) including a detection section for detecting the reference position and a displacement amount of the reference position in the carrying operation, wherein the controller detects the set region that was in contact with the medium when the medium was carried by the carrying operation by detecting the displacement amount with the detection section, (h) the detection section is a rotary encoder for detecting a rotation amount of the carry roller, (i) the nozzle forms a row of dots on the medium by ejecting ink while being moved in a movement direction that intersects the carrying direction, and the correction value table is created based on a read result of a correction pattern so as to suppress unevenness in density between row regions each formed with the row of dots arranged along the movement direction, (j) the image data indicates a tone value of each unit region, a correction value is obtained for each row region based on the read result of the correction pattern that is printed based on the image data indicating a predetermined tone value, and in the correction value table, the set region that was in contact with the medium during the carrying operation immediately before the dot forming operation that formed the row of dots configuring the correction pattern is associated with a correction value corresponding to the row region in which a row of dots is formed by that dot row forming operation, (k) in the correction pattern, a plurality of the rows of dots formed by ink ejected from the nozzle that is moved in the movement direction are printed arranged along the carrying direction based on a tone value indicating a predetermined density, and (l) the correction pattern includes rows of dots corresponding to row regions included in a theoretical carrying distance by which the medium is carried when the carry roller rotates n times that coincide with an amount obtained by multiplying by an integer the theoretical amount of the predetermined amount.

According to such a printing apparatus, substantially all of the effects described above can be obtained, thus the object of the invention can be effectively achieved.

Further, a computer program can be realized for realizing, in a printing apparatus including:

(a) a carry section provided with a carry roller for intermittently carrying a medium on which an image is to be printed in increments of a predetermined amount in a carrying direction;

(b) a nozzle for forming a dot based on corrected data obtained by correcting image data for printing the image on the medium that has been carried by the carry section; and (c) a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount, (d) a function to cause a dot be formed based on the corrected data that has been corrected based on the correction value table.

Further a printing system can be realized, comprising:

(A) a computer;

(B) a printing apparatus connected to the computer, and including: (a) a carry section provided with a carry roller for intermittently carrying a medium on which an image is to be printed in increments of a predetermined amount in a carrying direction;

(b) a nozzle for forming a dot based on corrected data obtained by correcting image data for printing the image on the medium that has been carried by the carry section;

(c) a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount; and (d) a controller that causes a dot to be formed based on the corrected data that has been corrected based on the correction value table.

A printing apparatus comprising:

(a) a carry section provided with a carry roller for carrying a medium on which an image is to be printed in a carrying direction;

(b) a nozzle for forming a row of dots on the medium that has been carried by the carry section, by ejecting ink while moving in a movement direction that intersects the carrying direction, based on print data for printing the image; and (c) a controller for controlling the carry section in order to make a portion of the carry roller that contacts the medium when the row of dots, which configures the correction pattern, is formed in a row region at the furthest downstream side in the carrying direction coincide with a portion of the carry roller that contacts the medium when the row of dots, which configures an image that is printed based on print data for printing the image, is formed while performing correction based on the correction pattern in the row region at the furthest downstream side in the carrying direction.

According to such a printing apparatus, when the dot row, of the image formed based on print data for printing the image, is formed while performing correction based on the correction pattern, in the row region at the furthest downstream side in the carrying direction, the medium is carried by a portion that substantially coincides to a portion of the carry roller that contacts the medium when the dot row, which configures the correction pattern, is formed in a row region at the furthest downstream side in the carrying direction. Thus, in the carrying operation of the medium when the image is printed and in the carrying operation of the medium when the correction pattern is printed, the dot row formed in the row region at the furthest downstream side in the carrying direction is to be formed after the medium is carried by the same portion of the carry roller. That is, if the carry roller is decentered, in the carry amount of the medium that is carried to form the dot row to be formed in the row region at the furthest downstream side in the carrying direction, an error due to decentering of the carry roller will be included in the same way as when an image is printed and when a correction pattern is printed. Therefore, by correcting the image data based on the correction pattern, the correction can be performed more accurately, and a satisfactory image can be printed.

Here, when a rectangular region that is virtually set on a medium such as a paper is assumed to be a "unit region" whose size and shape are determined depending on the print resolution, a "row region" refers to a region constituted by a plurality of unit regions arranged in the movement direction. For example, in the case where the print resolution is 720 dpi (movement direction)×720 dpi (carrying direction), the "unit region" becomes a square region of approximately 35.28 μm×35.28 μm (≈1/720 inch×1/720 inch). In the case where the print resolution is 360 dpi×720 dpi, the "unit region" becomes a rectangular region of approximately 70.56 μm×35.28 μm (≈1/360 inch×1/720 inch). When an ink droplet is ideally ejected, the ink droplet lands on the central position of this unit region and subsequently spreads on a medium, thereby forming a dot in the unit region. Then, in the case where the print resolution is 720 dpi×720 dpi for example, the "row region" is a band-like region with a width of approximately 35.28 μm (≈1/720 inch) in the carrying direction, and when an ink droplet is intermittently ejected in an ideal manner from the nozzles that are moving in the movement direction, a row of dots is formed in the row region.

In such a printing apparatus, it is preferable that it comprises, a detection section for detecting a predetermined reference position in the circumferential surface of the carry roller, wherein the controller controls the carry section, based on the reference position detected by the detecting section.

With such a printing apparatus, since the controller controls the carry section based on the reference position in the circumferential surface of the carry roller detected by the detection section, it is possible to position the reference position in the circumferential surface of the carry roller accurately in the predetermined position. Therefore, it is possible to make the medium to be carried accurately contact the predetermined position in the circumferential surface of the carry roller.

In such a printing apparatus, it is preferable that it comprises, a medium supply section for supplying the medium to the carry section, wherein the controller positions the reference position of the carry roller at a predetermined rotation starting position, wherein the controller makes the portion of the carry roller that contacts the medium coincide, when the row of dots, which configures the correction pattern, is formed in the row region at the furthest downstream side in the carry direction and when the row of dots, which configures the image, is formed while performing correction based on the correction pattern in the row region furthest downstream in the carrying direction, by making a timing to start rotating the carry roller from the rotation start position coincide with respect to a timing to start supplying the medium by the medium supply section.

With such a printing apparatus, by making a timing to start rotating the carry roller from the rotation start position coincide with respect to a timing to start supplying the medium by the medium supply section with respect to the carry roller positioned at a predetermined rotation starting position, the medium supplied from the medium supply section can be made to contact a substantially fixed position in the circumferential surface of the carry roller. Therefore, it is possible to make the portion in the circumferential surface of the carry roller that contacts the medium coincide by a simple control, when the dot row, of the correction pattern, is formed in the row region at the furthest downstream side in the carry direction and when the dot row, of the image, is formed while correcting based on the correction pattern, in the row region furthest downstream in the carrying direction.

In such a printing apparatus, it is preferable that the carry roller is stopped at the rotation starting position when the medium is discharged.

With such a printing apparatus, after one medium is discharged, it is not necessary to position the carry roller at the rotation starting position again, when printing the next medium. Therefore, throughput can be improved.

In such a printing apparatus, it is preferable that the detection section is a rotary encoder for detecting a rotation of the carry roller.

With such a printing apparatus, the rotation and the position in the circumferential surface of the carry roller can be detected easily and more accurately.

In such a printing apparatus, it is preferable that the controller corrects image data based on a read result of the correction pattern so as to suppress unevenness in density between row regions each formed with the row of dots arranged along the movement direction.

The correction based on a read result of the printed correction pattern, is a correction to suppress unevenness in density between row regions each formed with the row of dots arranged along the movement direction. Thus, it is important that particularly, the position of the row region formed with each dot row configuring the correction pattern in the carrying direction coincides with the position of the row region formed with each dot row configuring the image. With the above printing apparatus, the position of the row region formed with each dot row configuring the correction pattern in the carrying direction and the position of the row region formed with each dot row configuring the image in the carrying direction can be made to coincide more accurately. Therefore, the image data can be corrected more appropriately based on the correction pattern, and a satisfactory image can be printed.

In such a printing apparatus, it is preferable that the image data indicates a tone value of each unit region to be formed on the medium, correction information is obtained based on the read result of the correction pattern that has been printed based on the image data indicating a predetermined tone value, and the image data is corrected based on the correction information.

With such a printing apparatus, the correction information is obtained based on the read result of the correction pattern that is printed based on the image data indicating a predetermined tone value. Thus, the read result of the printed correction pattern and the predetermined tone value of the image data are associated. Then, the tone value of the image data is corrected based on the read result of the correction pattern, and the image data can be corrected more appropriately.

In such a printing apparatus, it is preferable that the correction pattern is printed for each printing condition of printing the image, wherein the rotation starting position is set based on the printing condition.

With such a printing apparatus, the rotation starting position is set for each printing condition, so that the correction pattern printed for each printing condition is printed on the medium carried when the carry roller started rotating from the rotation starting position according to the printing condition. Therefore, the correction pattern according to each printing condition is printed for each printing condition, and the image data can be appropriately corrected when printing the image with any printing condition, and a satisfactory image can be printed.

In such a printing apparatus, it is preferable that in the correction pattern, a plurality of the rows of dots formed by ink ejected from the nozzle that moves in the movement direction are printed arranged along the carrying direction, based on a tone value that indicates a predetermined density.

With such a printing apparatus, since a plurality of rows of dots are printed arranged along the carrying direction, it is possible to read the unevenness in density between the row regions in which rows of dots are formed by reading the correction pattern. Since the image data is corrected based on the read results of this correction pattern, it is possible to suitably suppress the unevenness in density between the row regions in the image to be printed.

A printing method comprising:

carrying a medium by making a predetermined portion of a carry roller provided to a carry section for carrying the medium contact the medium, when a row of dots is formed in a row region at the furthest downstream side in a carrying direction, by causing ink to be ejected from a nozzle that is moved in a movement direction that intersects the carrying direction of the medium, based on print data for printing a correction pattern; and carrying the medium so that the predetermined portion of the carry roller is made to contact the medium, when the row of dots is formed in the row region at the furthest downstream side in the carrying direction, by ejecting ink from the nozzle, based on print data for printing an image.

A printing apparatus comprising:

(a) a carry section provided with a carry roller for carrying a medium on which an image is to be printed in a carrying direction;

(b) a nozzle for forming a row of dots on the medium that has been carried by the carry section, by ejecting ink while moving in a movement direction that intersects the carrying direction, based on print data for printing the image; and (c) a controller for controlling the carry section in order to make a portion of the carry roller that contacts the medium when the row of dots, which configures the correction pattern, is formed in a row region at the furthest downstream side in the carrying direction coincide with a portion of the carry roller that contacts the medium when the row of dots, which configures an image that is printed based on print data for printing the image, is formed while performing correction based on the correction pattern in the row region at the furthest downstream side in the carrying direction, (d) including a detection section for detecting a predetermined reference position in the circumferential surface of the carry roller, wherein the controller controls the carry section, based on the reference position detected by the detecting section, (e) including a medium supply section for supplying the medium to the carry section, wherein the controller positions the reference position of the carry roller at a predetermined rotation starting position, the controller makes the portion of the carry roller that contacts the medium coincide, when the row of dots, which configures the correction pattern, is formed in the row region at the furthest downstream side in the carry direction and when the row of dots, which configures the image, is formed while performing correction based on the correction pattern in the row region furthest downstream in the carrying direction, by making a timing to start rotating the carry roller from the rotation start position coincide with respect to a timing to start supplying the medium by the medium supply section, (f) the carry roller is stopped at the rotation starting position when the medium is discharged, (g) the detection section is a rotary encoder for detecting a rotation of the carry roller, (h) the controller corrects image data based on a read result of the correction pattern so as to suppress unevenness in density between row regions each formed with the row of dots arranged along the movement direction, (i) the image data indicates a tone value of each unit region to be formed on the medium, correction information is obtained based on the read result of the correction pattern that has been printed based on the image data indicating a predetermined tone value, and the image data is corrected based on the correction information, (j) the correction pattern is printed for each printing condition of printing the image, the rotation starting position is set based on the printing condition, and (k) in the correction pattern, a plurality of the rows of dots formed by ink ejected from the nozzle that moves in the movement direction are printed arranged along the carrying direction, based on a tone value that indicates a predetermined density.

With such a printing apparatus, substantially all of the above described effects can be obtained, so that the object of this invention can be effectively achieved.

Further, a computer program can be realized for realizing, in a printing apparatus including: a carry section provided with a carry roller for carrying a medium on which an image is to be printed in a carrying direction; and a nozzle for forming a row of dots on the medium that has been carried by the carry section, by ejecting ink while moving in a movement direction that intersects the carrying direction, based on print data for printing the image, a function of controlling the carry section in order to make a portion of the carry roller that contacts the medium, when the row of dots, which configures the correction pattern, is formed in a row region at the furthest downstream side in the carrying direction coincide with a portion of the carry roller that contacts the medium, when the dot row, which configures the image that is printed based on print data for printing the image, is formed while performing correction based on the correction pattern, in the row region at the furthest downstream side in the carrying direction.

Further, a printing system can be realized comprising: (A) a computer; and (B) a printing apparatus connected to the computer and that includes: (a) a carry section provided with a carry roller for carrying a medium on which an image is to be printed in a carrying direction; (b) a nozzle for forming a row of dots on the medium that has been carried by the carry section, by ejecting ink while moving in a movement direction that intersects the carrying direction, based on print data for printing the image; and (C) a controller for controlling the carry section in order to make a portion of the carry roller that contacts the medium when the row of dots, which configures the correction pattern, is formed in a row region at the furthest downstream side in the carrying direction coincide with a portion of the carry roller that contacts the medium when the row of dots, which configures the image that is printed based on print data for printing the image forming while performing correction based on the correction pattern, is formed in the row region at the furthest downstream side in the carrying direction.

Configuration of Printing System

Printing System

FIG. 1 is a diagram explaining the configuration of a printing system 100. The printing system refers to a system including at least a printing apparatus and a print control device for controlling the operations of the printing apparatus. The printing system 100 of the present embodiment includes an inkjet printer (hereinafter referred to as "printer") 1, a computer 110, a display device 120, an input device 130, a record/play device 140, and a scanner 150.

The printer 1 prints images on media such as a paper, a cloth, a film, or an OHP paper. The computer 110 is communicably connected to the printer 1. To make the printer 1 print an image, the computer 110 outputs print data corresponding to that image to the printer 1. Computer programs such as an application program or a printer driver are installed on the computer 110. In addition, a scanner driver that controls the scanner 150 and that is for receiving image data of an original read by the scanner 150 is installed on the computer 110.

First Embodiment

Printer

Figure 2:
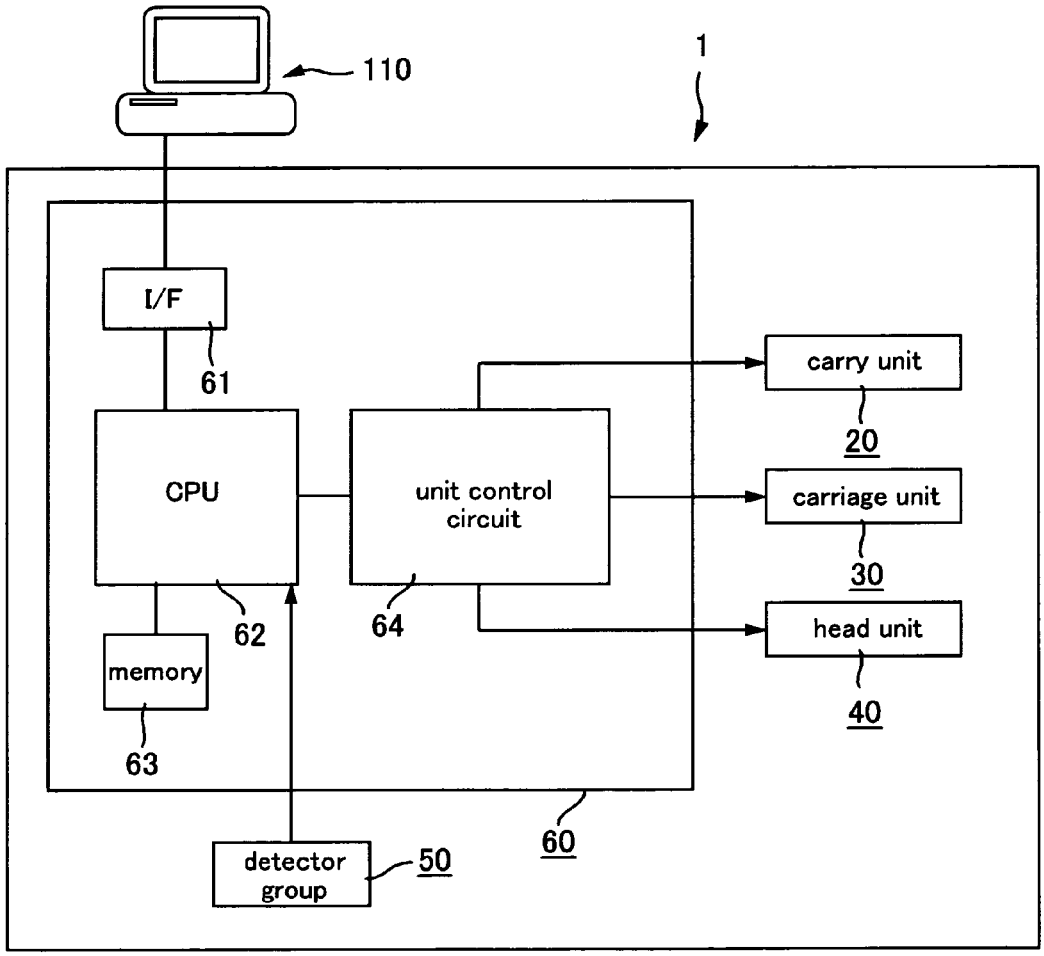
FIG. 2 is a block diagram of the overall configuration of a printer.
Figure 3A:
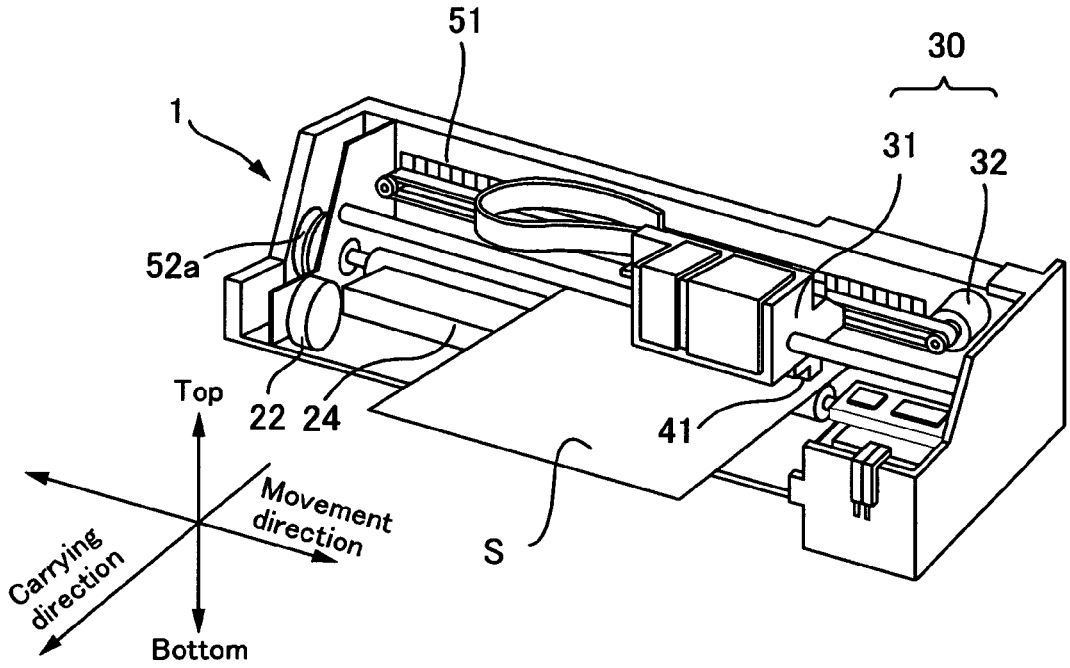
FIG. 3A is a schematic diagram showing the overall structure of the printer.
Figure 3B:
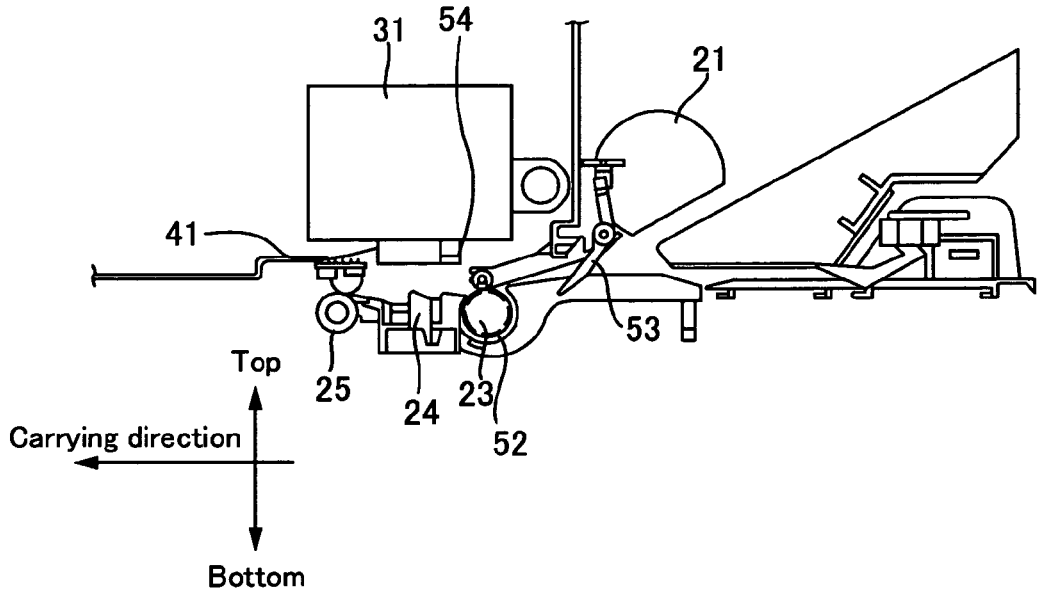
FIG. 3B is a vertical cross-sectional view of the overall configuration of the printer.

FIG. 2 is a block diagram of the overall configuration of the printer 1 as a printing apparatus. FIG. 3A is a schematic view of the overall configuration of the printer 1. FIG. 3B is a vertical cross-sectional view of the overall configuration of the printer 1. The basic configuration of the printer of this embodiment is described below.

The printer 1 has a carry unit 20, a carriage unit 30, a head unit 40, a detector group 50, and a controller 60. The printer 1 that has received the print data from the computer 110, which is an external device, controls each of the units (the carry unit 20, the carriage unit 30, and the head unit 40) using the controller 60. The controller 60 controls each of the units in accordance with the print data that has been received from the computer 110 and prints an image on a paper. The detector group 50 monitors the conditions in the printer 1, and the detector group 50 outputs the results of this detection to the controller 60. The controller 60 controls each unit based on the detection results that are output from the detector group 50.

The carry unit 20 is for carrying a medium such as a paper in a predetermined direction (hereinafter, referred to as "carrying direction"). The carry unit 20 has a paper supply roller 21 as a media supplying section, a carry motor 22 (also called the "PF motor"), a carry roller 23, a platen 24, and a paper discharge roller 25. The paper supply roller 21 is a roller for supplying paper that has been inserted into a paper insert opening into the printer.

Figure 4:
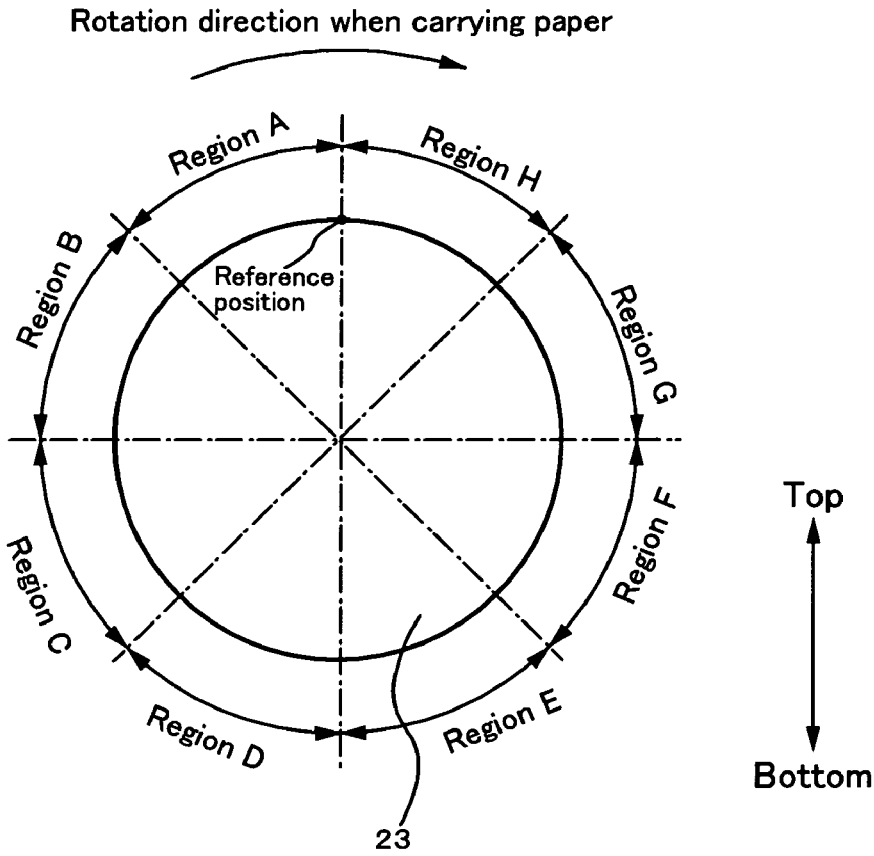
FIG. 4 is a diagram for explaining a reference position of a carry roller and set regions that are set in this embodiment.

The carry roller 23 of the printer of Embodiment 1 is a roller for carrying the paper S that has been supplied by the paper supply roller 21 up to a printable region. With respect to the carry roller 23, for example, when the theoretical carrying amount by which the paper is carried during one carrying operation by the carry roller in the interlace printing, which will be described below, is assumed to be "L", the diameter of the carry roller 23 is set so that the theoretical distance mL by which the paper is carried by "m" times of carrying operations coincides with the theoretical distance nH (H: the circumferential length of the carry roller) by which the paper is carried when the carry roller rotates "n" times. FIG. 4 is a diagram for explaining a reference position of the carry roller and set regions that are set in this embodiment. As shown, in this embodiment, the theoretical carrying amount in one rotation of the carry roller 23 is set so as to coincide with the distance by which the paper is carried by eight carrying operations.

The platen 24 supports the paper S during printing. The paper discharge roller 25 is a roller for discharging the paper S to outside the printer 1, and is provided on downstream side in the carrying direction of the printable region. The paper discharge roller 25 rotates in synchronization with the carry roller 23.

The carriage unit 30 is for making the head 41 move in a predetermined movement direction. The carriage unit 30 has a carriage 31 and a carriage motor 32 (also referred to as "CR motor"). The carriage 31 can move in a reciprocating manner along the movement direction. The carriage 31 detachably retains an ink cartridge containing ink. The carriage motor 32 is a motor for moving the carriage 31 in the movement direction.

The head unit 40 is for ejecting ink onto paper. The head unit 40 is provided with a head 41. The head 41 has a plurality of nozzles and intermittently ejects ink from those nozzles.

The head 41 is provided to the carriage 31 so that when the carriage 31 moves in the movement direction, the head 41 also moves in the movement direction. With ink in a droplet form (hereinafter referred to as "ink droplet") being intermittently ejected while the head 41 is moving in the movement direction, rows of dots arranged in the movement direction (raster lines) are formed on the paper as an example of media.

Figure 5:
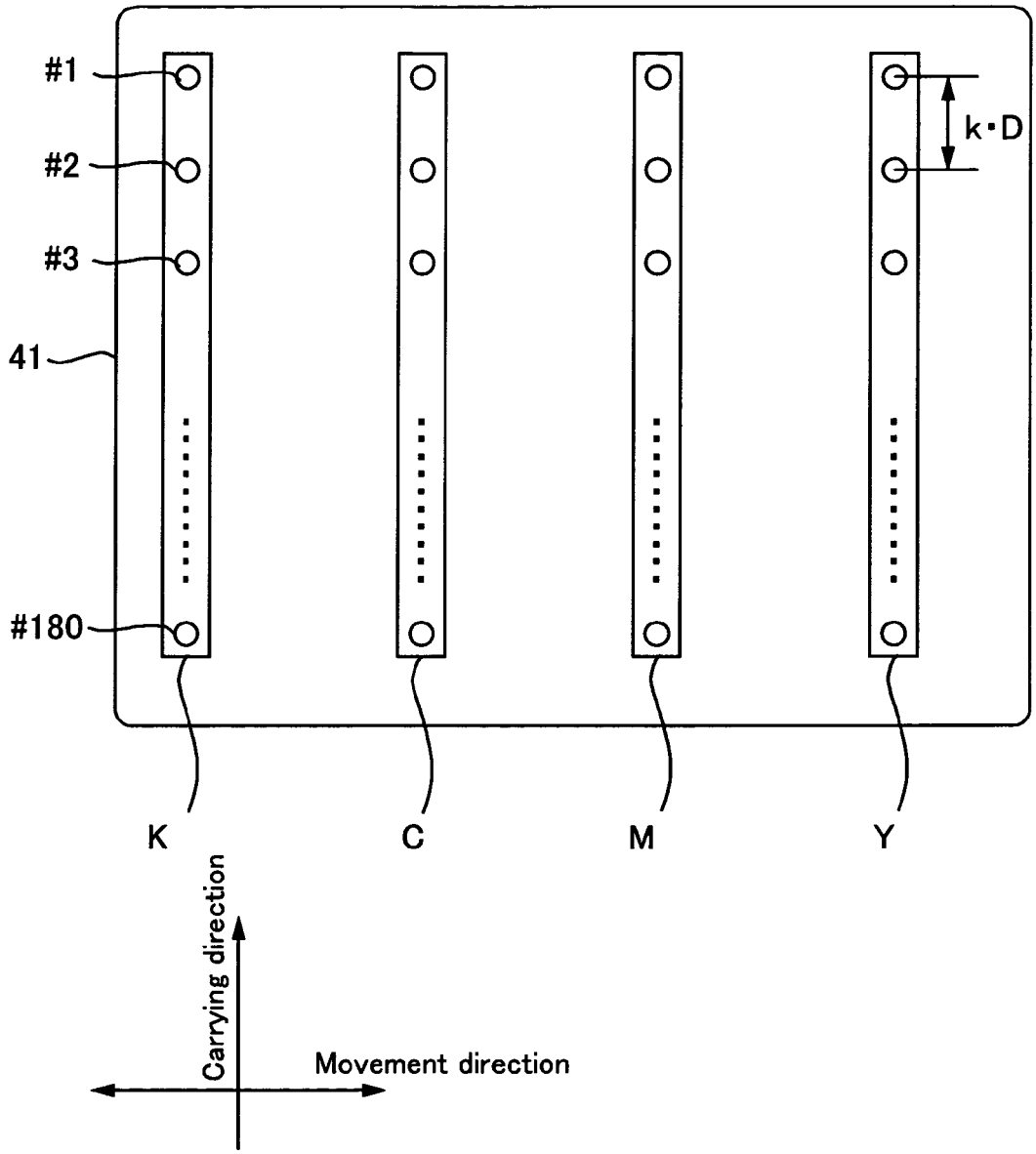
FIG. 5 is an explanatory diagram showing the arrangement of nozzles on a lower surface of a head.

FIG. 5 is an explanatory diagram of the arrangement of the nozzles on the lower surface of the head 41. A black ink nozzle group K, a cyan ink nozzle group C, a magenta ink nozzle group M, and a yellow ink nozzle group Y are formed in the lower surface of the head 41. Each nozzle group is provided with a plurality of nozzles that are ejection openings for ejecting inks of various colors. The plurality of nozzles in each nozzle group are arranged in a row at a constant spacing (nozzle pitch: k·D) in the carrying direction. Here, "D" is the minimum dot pitch in the carrying direction (that is, the spacing of dots formed on the paper S at the maximum resolution). Also, "K" is an integer of 1 or more. For example, if the nozzle pitch is 180 dpi (1/180 inch), and the dot pitch in the carrying direction is 720 dpi (1/720 inch), then K=4. The nozzles of each nozzle group are assigned a number (#1 through #180) that becomes smaller the further downstream the nozzle is. Each nozzle is provided with an ink chamber (not shown) and a piezo element (not shown). The ink chamber expands and contracts due to drive of the piezo element, and ink droplets are ejected from the nozzle.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting the amount of rotation of the carry roller 23, and a code plate 52*a* of the rotary encoder 52 is provided in the shaft of the carry roller 23. For this reason, one rotation detected by the rotary encoder 52 coincides with one rotation of the carry roller 23. The code plate 52*a* of the rotary encoder 52 has slits formed over the entire circumference in the circumferential direction at equal intervals and a small opening formed at one point on the entire circumference in the circumferential direction. In addition, two detectors (not shown) that are respectively constituted by a light-emitting section and a light-receiving section disposed so as to sandwich the plate surface of the code plate 52*a*, are disposed arranged in the diameter direction of the code plate 52*a* so as to detect both the slit and the small opening. That is, one detector detects light that passes the small opening and detects a predetermined position on the circumferential surface of the carry roller 23, such as the reference position, for example, or the fact that the carry roller 23 has finished one rotation. The other detector detects light that passes the slit and detects the rotation amount of the carry roller 23, namely, displacement of the reference position in the circumferential direction. In other words, the rotary encoder 52 is a detection section for detecting the rotation amount of the carry roller 23 and the reference position on the circumferential surface of the carry roller 23.

The paper detection sensor 53 is for detecting the position of the front end of a paper to be printed. The optical sensor 54 is attached to the carriage 31. The optical sensor 54 detects whether or not the paper is present by the light-receiving section detecting reflected light of light that has been irradiated onto the paper by the light-emitting section.

The controller 60 is a control section for performing control of the printer. The controller 60 has an interface section 61, a CPU 62, a memory 63, and a unit control circuit 64. The interface section 61 is for exchanging data between the computer 110, which is an external device, and the printer 1. The CPU 62 is a computational process device for carrying out the overall control of the printer. The memory 63 is for reserving a region for storing programs for the CPU 62 and a working region, for instance, and includes a storage device such as a RAM or an EEPROM. The CPU 62 controls the various units via the unit control circuit 64 in accordance with programs stored in the memory 63.

Scanner

Figure 6A:
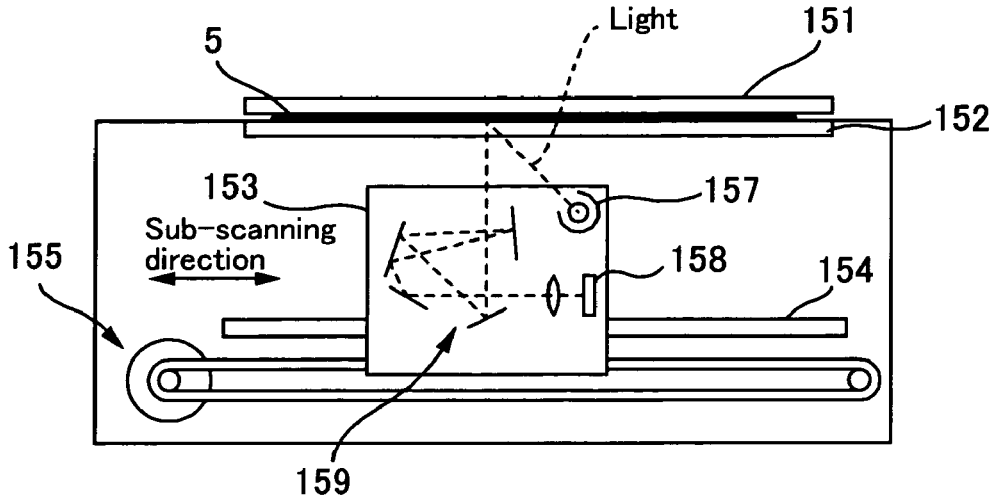
FIG. 6A is a vertical cross-sectional view of a scanner.
Figure 6B:
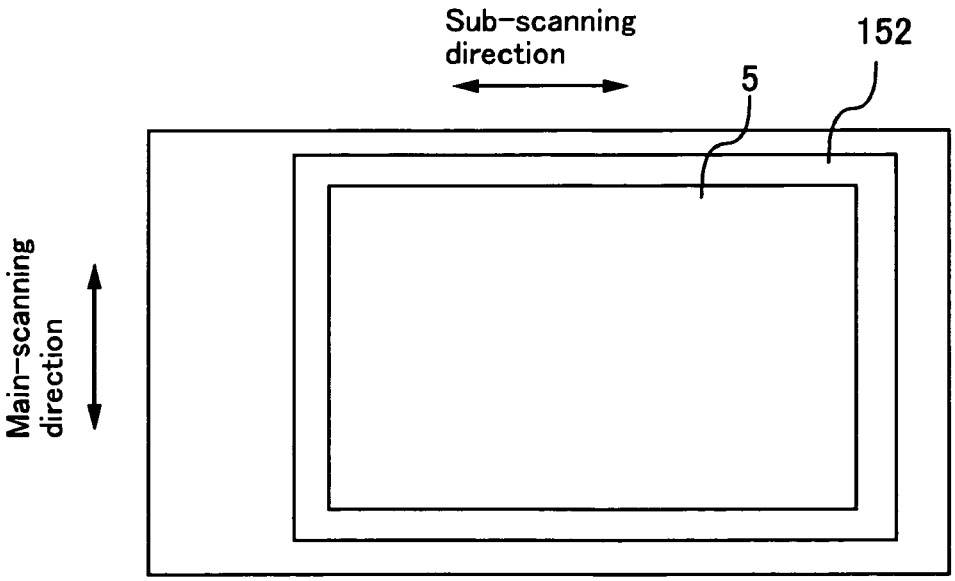
FIG. 6B is a top view of the scanner with an upper cover detached.

FIG. 6A is a vertical sectional view of the scanner 150. FIG. 6B is a top view of the scanner 150 with an upper cover 151 detached.

The scanner 150 is provided with the upper cover 151, a document platen glass 152 on which a document 5 is placed, a reading carriage 153 that moves in a sub-scanning direction while opposing the document 5 through the document platen glass 152, a guiding member 154 that guides the reading carriage 153 in the sub-scanning direction, a moving mechanism 155 for moving the reading carriage 153, and a scanner controller (not shown) that controls each section of the scanner 150. The reading carriage 153 is provided with an exposure lamp 157 that irradiates light on the document 5, a line sensor 158 that detects an image of a line in the main-scanning direction (in FIG. 6A, the direction perpendicular to the paper surface), and an optical system 159 for guiding light reflected by the document 5 to the line sensor 158. The dashed lines in the reading carriage 153 shown in FIG. 6A show the path of light.

When reading an image of the document 5, an operator opens the upper cover 151, places the document 5 on the document platen glass 152, and closes the upper cover 151. Then, the scanner controller causes the reading carriage 153 to move along the sub-scanning direction letting the exposure lamp 157 emit light, and the line sensor 158 reads the image on the surface of the document 5. The scanner controller transmits the read image data to the scanner driver of the computer 110, and the computer 110 obtains the image data of the document 5.

Printing Method

Regarding Printing Operation

Figure 7:
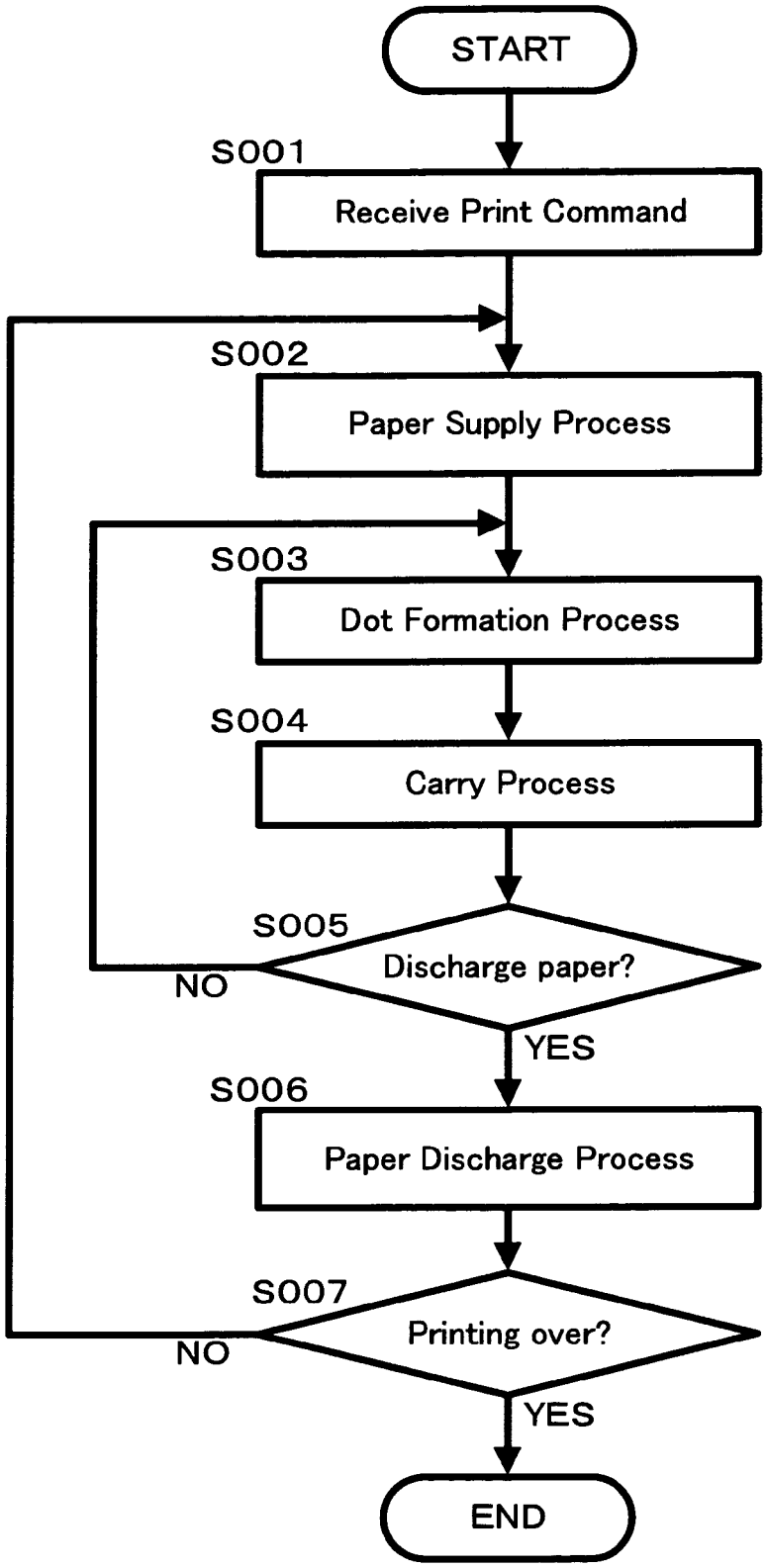
FIG. 7 is a flowchart of the processes during printing.

FIG. 7 is a flowchart of the processes during printing. The processes described below are executed by the controller 60 controlling the various units in accordance with programs stored in the memory 63. The programs include codes for executing the various processes.

Receive Print Command (S001): First, the controller 60 receives a print command from the computer 110 via the interface section 61. This print command is included in a header of the print data transmitted from the computer 110 along with information such as print conditions. The controller 60 then analyzes the content of the various commands included in the received print data, and performs the following processes such as a paper supply process, a carry process, and a dot forming process by using each of the units.

Paper supply process (S002): The paper supply process is a process for supplying paper to be printed into the printer and positioning the paper at a print start position (also referred to as "indexing position"). The controller 60 rotates the paper supply roller 21 and the carry roller 23, and positions the paper at the print start position.

Dot forming process (S003): The dot forming process is a process for causing ink to be intermittently ejected from the head 41 that moves along the movement direction so as to form dots on the paper. The controller 60 drives the carriage motor 32 and moves the carriage 31 in the movement direction, and then while the carriage 31 is moving, causes ink to be ejected from the head 41 in accordance with data for each unit region included in the print data (hereinafter referred to as "unit region data"). Dots are formed on the paper when ink droplets ejected from the head 41 land on the paper. Since ink is intermittently ejected from the head 41 that is moving, dot rows (raster lines) consisting of a plurality of dots in the movement direction are formed on the paper.

Carry process (S004): The carry process is a process for moving the paper relatively in respect to the head 41 in the carrying direction. The controller 60 rotates the carry roller 23 and carries the paper in the carrying direction. Through this carry process, the head 41 can form dots during a next dot forming process at positions that are different from the positions of the dots formed in the preceding dot forming process.

Paper Discharge Determination (S005): The controller 60 determines whether or not to eject (discharge) the paper being printed. The paper is not discharged if there remains data to be printed on the paper being printed. The controller 60 alternately repeats the dot forming process and the carry process until there is no more data to be printed, thereby gradually printing an image consisting of dots on the paper.

Paper Discharge Process (S006): When there is no more data to be printed on the paper being printed, the controller 60 discharges that paper by rotating the paper discharge roller. It should be noted that whether or not to discharge the paper can also be determined based on a paper discharge command included in the print data.

Print Over Determination (S007): Next, the controller 60 determines whether or not to continue printing. If the next sheet of paper is to be printed, then printing is continued, and the paper supply process for the next paper starts. If the next sheet of paper is not to be printed, then the printing operation is terminated.

Regarding Formation of Raster Lines

First, regular printing is described. The regular printing of the present embodiment is carried out using a printing mode referred to as interlace mode (hereinafter referred to as "interlace printing"). Here, "interlace printing" means a printing scheme in which a row region in which no raster line is recorded is sandwiched between raster lines that are recorded in one pass. Further, a "pass" refers to one dot forming process carried out while the carriage 31 moves one time, and "pass n" refers to the nth dot forming process. A "raster line" refers to a row of dots arranged in the movement direction and a "row region" is a region in which a raster line can be formed.

Figure 8:
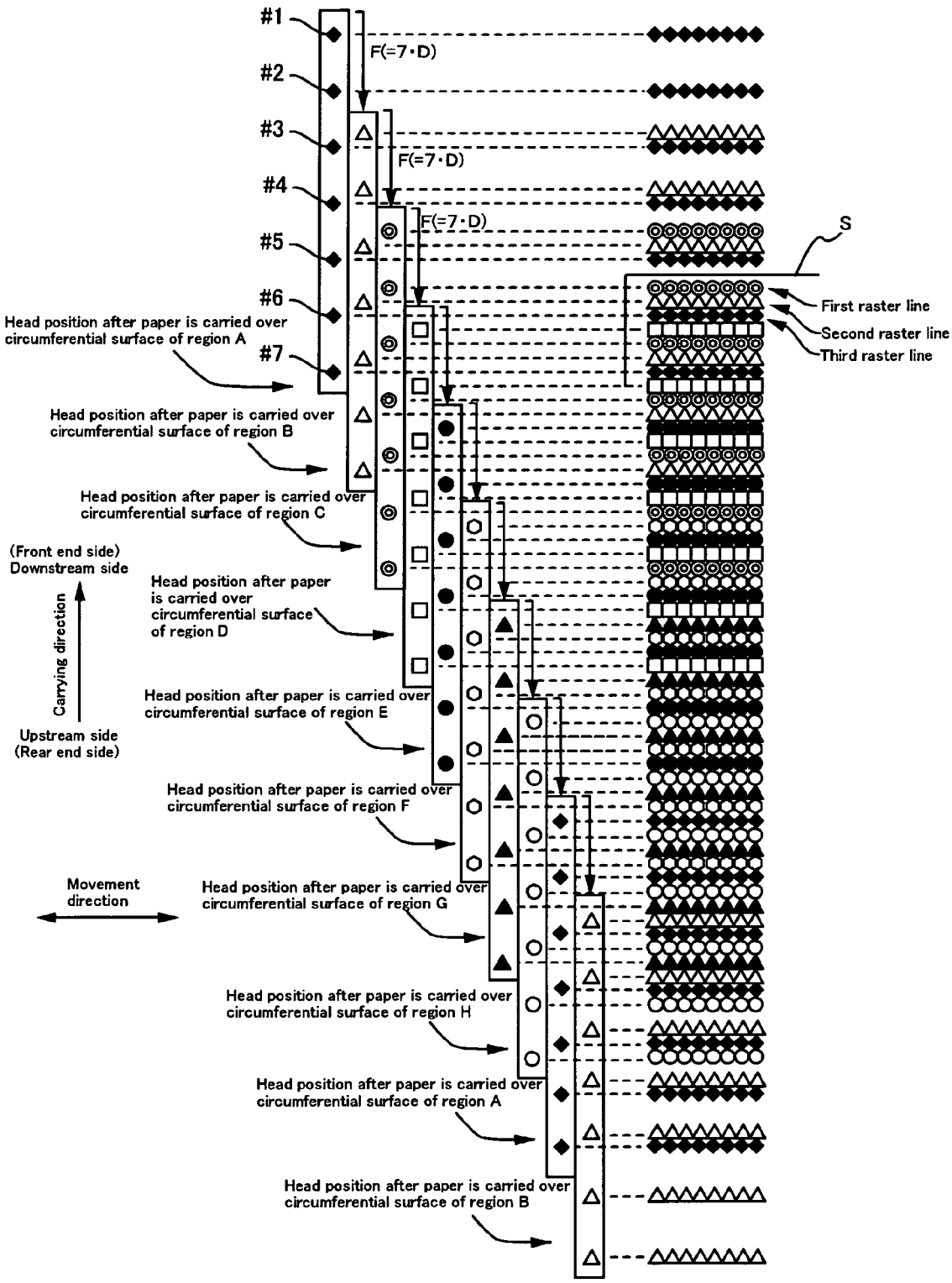
FIG. 8 is a diagram for explaining interlace printing.

FIG. 8 is a diagram for explaining the interlace printing. For the convenience of explanation, only one of a plurality of the nozzle groups is shown, and the number of nozzles of the nozzle group is reduced. In addition, the head 41 (or the nozzle group) is illustrated as if moving with respect to the paper, but FIG. 8 shows the relative position of the head 41 and the paper, and in reality the paper is moved in the carrying direction.

Furthermore, for the convenience of explanation, each of the nozzles are shown forming only a few dots, but in reality a large amount of dots are lined up in the movement direction (this row of dots is the raster line) because ink droplets are intermittently ejected from the nozzles that move in the movement direction. Of course, since ink is ejected according to the unit region data, there are cases in which a dot is not formed.

In FIG. 8, the representation of the positions of the nozzles after the carrying operations in the respective carrying processes by the controller 60, and the representation of the image of the dots formed on the paper by these nozzles are associated with each other by using the same symbols.

In this interlace printing, every time the paper is carried in the carrying direction by a constant carry amount F, each of the nozzles records a raster line immediately above another raster line that was recorded in the immediately prior pass, namely, a raster line on the downstream side in the carrying direction. In order to carry out recording with a constant carry amount in this way, it is necessary to satisfy the following conditions; (1) the number N (integer) of nozzles that can eject ink is coprime to k and (2) the carry amount F is set to N·D. Here, N=7, k=4, and F=7·D (D=1/720 inch).

Correction for Unevenness in Density (Outline)

Regarding Unevenness in Density (Banding)

In this section, for the convenience of explanation, a cause of unevenness in density that occurs in an image printed with monochrome printing is described. In the case of multi-color printing, the cause of the unevenness in density described below occurs for each color.

Figure 9A:
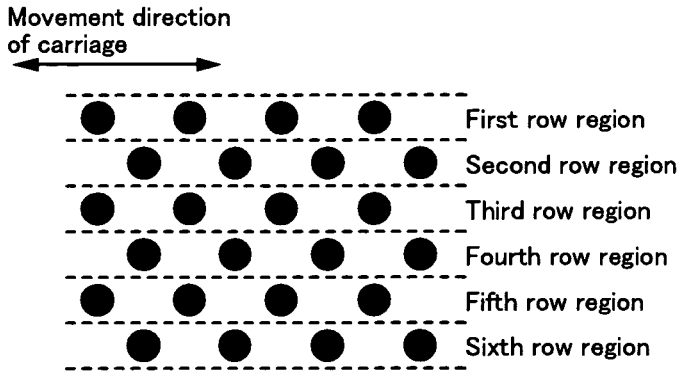
FIG. 9A is an explanatory diagram of a state in which dots are formed ideally.

FIG. 9A is an explanatory diagram of a state in which dots are formed in an ideal manner. In FIG. 9, dots are formed in an ideal manner so that each dot is formed precisely in the unit region and the raster line is formed precisely in the row region. In FIG. 9A, the row region is illustrated in the figure as a region between dotted lines, and in this case, the row region has a width of 1/720 inch in width in the carrying direction. In each row region, an image piece which has a density equivalent to the coloring of the region is formed. Here, for the convenience of explanation, an image is printed at a constant density so that the dot-generation rate becomes 50%.

Figure 9B:
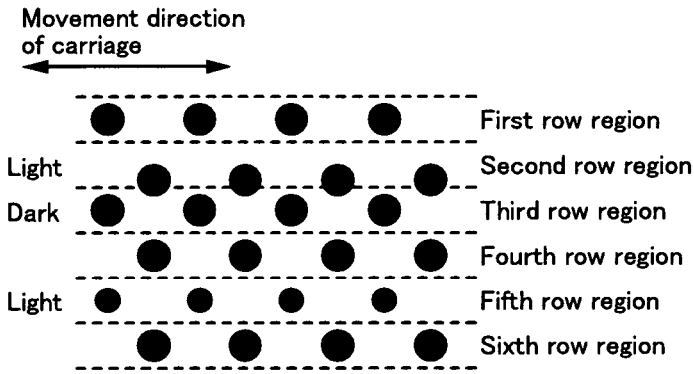
FIG. 9B is an explanatory diagram of how the variation in manufacturing precision among nozzles affects dot formation.

FIG. 9B is an explanatory diagram of the effects of variation in the process accuracy of the nozzles. Here, due to variations in the flying direction of the ink droplets ejected from the nozzles the raster line formed in the second row region is formed closer to the side of the third row region (the upstream side in the carrying direction). Moreover, the amount of ink of the ink droplets ejected toward the fifth row region is small, so that the dots formed in the fifth row region are small.

Although originally image pieces of the same density are supposed to be formed in each row region, a variation in the densities of the image pieces occurs depending on the positions in which the raster lines are formed due to variation in the process accuracy, or the like. For example, the image piece of the second row region becomes relatively light, and the image piece of the third row region becomes relatively dark. Further, the image piece of the fifth row region becomes relatively light.

When a printed image constituted by such raster lines is seen macroscopically, unevenness in density in the form of a stripe along the movement direction of the carriage is recognized. This unevenness in density causes the image quality of the print image to deteriorate.

Figure 9C:
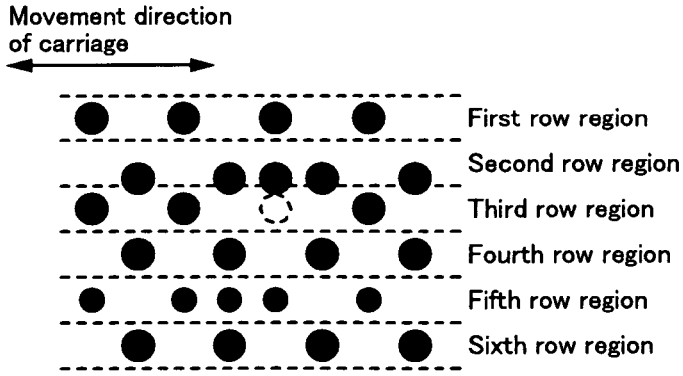
FIG. 9C is an explanatory diagram of a state in which dots are formed by the printing method of the present embodiment.

FIG. 9C is an explanatory diagram of dots formed by the printing method of this embodiment. In this embodiment, with respect to a row region that tends to be recognized dark, tone values of the unit region data (CMYK unit region data) of the unit regions corresponding to that row region are corrected so that the image piece is formed to be light. Also, with respect to a row region that tends to be recognized light, tone values of the unit region data of the unit regions corresponding to that row region are corrected so that the image piece is formed to be dark. For example, in FIG. 9C, tone values of the unit region data of the unit regions corresponding to each of the row regions are corrected so that the dot generation rate of the second row region becomes high, the dot generation rate in the third row region becomes low, and the dot generation rate in the fifth row region becomes high. As a result, the dot generation rates of the raster lines formed in each of the row regions are changed, the densities of the image pieces of the row regions are corrected, and the unevenness in density of the entire print image is suppressed.

By the way, in FIG. 9B, the reason that the image piece formed in the third row region becomes dark is not because of the effect of the nozzle that forms a raster line in the third row region, but because of the effect of the nozzle that forms a raster line in adjacent the second row region. Accordingly, if the nozzle that forms a raster line in the third row region forms a raster line in another row region, the image piece formed in the other row region is not necessarily formed dark. In short, even if the image pieces are formed by the same nozzle, if nozzles that form image pieces adjacent to those image pieces are different, the density of those image pieces may be different. In such a case, the unevenness in density cannot be suppressed merely with correction values associated with the nozzles. Thus, in the present embodiment, the tone value of the unit region data is corrected based on the correction values set for the respective row regions.

Therefore, in this embodiment, in the inspection process at a printer manufacturing factory, the printer is caused to print a correction pattern, the correction pattern is read by the scanner, and correction values corresponding to the respective row regions are stored in a memory of the printer based on the densities of the respective row regions in the correction pattern. The correction values stored in the printer reflect the characteristics of unevenness in density of the individual printer.

Then, on the side of the user who has purchased the printer, the printer driver reads the correction values from the printer, and corrects tone values of the unit region data based on the correction values. Then, print data is generated based on the corrected tone values, and the printer performs printing based on the print data.

Regarding Process in Printer Manufacturing Factory

Figure 10:
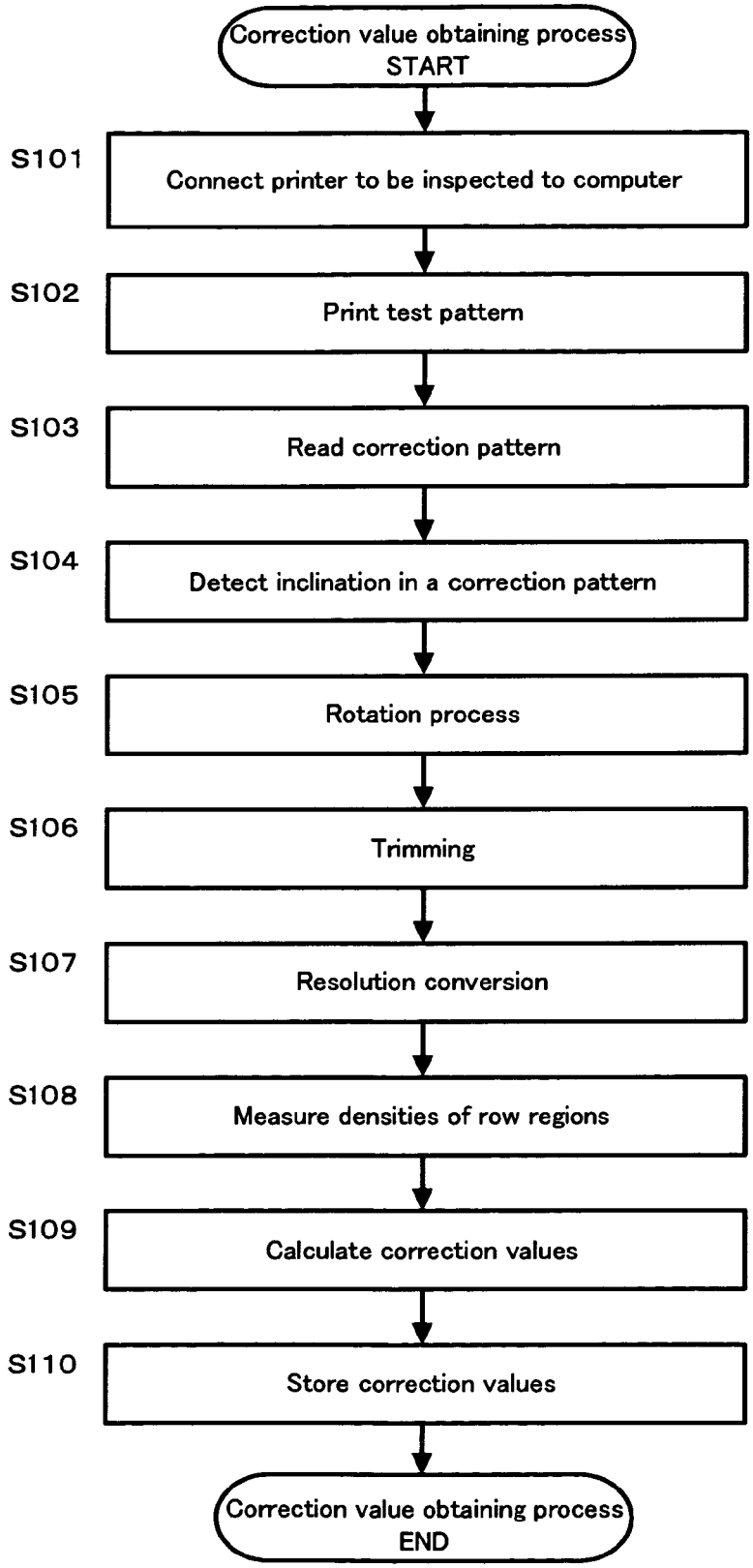
FIG. 10 is a flowchart of correction value obtaining processes carried out after the printer has been manufactured.

FIG. 10 is a flow chart of the correction value obtaining process that is carried out after the printer is manufactured. First, an operator connects a printer 1 to be inspected to a computer 110 in a factory (S101). The scanner 150 is also connected to the computer 110 in the factory. A printer driver for making the printer 1 print a test pattern, a scanner driver for controlling the scanner 150, and a correction value obtaining program for performing image processing, or analyzing, and so forth, with respect to the image data of the correction pattern read by the scanner are installed on the computer 110 in advance.

Next, the printer driver of the computer 110 makes the printer 1 print the test pattern (S102).

When the printer 1 is powered on, the controller 60 drives the carrying motor 22 to rotate the carry roller 23. At this time, the controller 60 detects the reference position of the carry roller 23 based on the output from the rotary encoder 52, and manages the displacement in the circumferential direction of the reference position based on outputs from the rotary encoder 52 after the detection. In this embodiment, when the controller 60 detects the reference position, the controller 60 rotates the carry roller 23 so as to position the detected reference position at a position that is set in advance as the initial position of the carry roller 23, for example, the position vertically above the shaft of the carry roller 23.

Also, the theoretical circumferential length of the carry roller 23 of this embodiment is set so as to coincide with the theoretical carrying amount carried by eight carrying operations in the interlace printing. As shown in FIG. 4, the carry roller 23 has eight set regions (region A, region B, region C, . . . and region H) that are set by virtually dividing the carry roller 23 into eight regions in the circumferential direction at equal angles. These set regions are set so that the theoretical length of the circumferential surface of each set region is equal to the theoretical carrying amount in one carrying operation. Then, the position of each set region is stored in a memory as information indicating the relative position of that set region with respect to the reference position of the carry roller 23.

The interlace printing shown in FIG. 8 is described as an example below. Namely, the interlace printing in which a head provided with seven nozzles is used and paper is carried by a distance that corresponds to seven raster lines by one carrying operation. In the example of FIG. 8, the raster line formed at the most front end side of the paper (the first raster line) is formed by ink ejected from the second nozzle #2 in the dot forming operation performed after the paper is carried over the circumferential surface of the region C by the carrying operation. The second raster line is formed by ink ejected from the fourth nozzle #4 in the dot forming operation performed after the paper is carried over the circumferential surface of the region B by the carrying operation. In this manner, for each of the raster lines to be formed, it is specified which nozzle the raster line is formed by and in which region of the carry roller 23 the paper is carried over before the dot forming operation. When the raster line formed by ink ejected from the second nozzle #2 in the dot forming operation performed after the carrying operation at the circumferential surface of the region C is considered as the first raster line, in order to print the correction pattern that includes all types of the raster lines that are formed by ink ejected from each of the nozzles in the dot forming operations after the paper is carried over each of the set regions, it is necessary to print raster lines higher than the 56th raster line.

In printing the correction pattern, for example, a paper that is supplied is carried by the carry roller 23 to position a front end of the paper at a predetermined position. At this time, the controller 60 detects the displacement of the reference position of the carry roller 23 based on the output from the rotary encoder 52, and detects the set region of the carry roller 23 at which the paper was last contacting the carry roller 23 during the carrying operation for positioning the paper, based on the position in the circumferential direction of the reference position when the paper was positioned. For example, if it is detected by the output from the rotary encoder 52 that the boundary between the region A and the region B was positioned vertically above the shaft of the carry roller 23 when the paper was positioned, it is detected that the paper was carried over the region A during this carrying operation.

Then, the third raster line is formed by ink ejected from the sixth nozzle and the seventh raster line is formed by ink ejected from the seventh nozzle by the first dot forming operation. In the following carrying operation, the paper is carried over the region B. Accordingly, the second raster line is formed by ink ejected from the fourth nozzle, the sixth raster line is formed by ink ejected from the fifth nozzle, the tenth raster line is formed by ink ejected from the sixth nozzle, and the fourteenth raster line is formed by ink ejected from the seventh nozzle, during the dot forming operation carried out after the second carrying operation. In this manner, the nozzles and the raster lines that are formed by ink ejected from those nozzles are associated with each other for each set region that is in contact with the paper during each carrying operation. Hereafter, the carrying operation and the dot forming operation are alternately performed and when the dot forming operation performed after the second carrying operation over the region C is finished, the paper is discharged.

Figure 11:
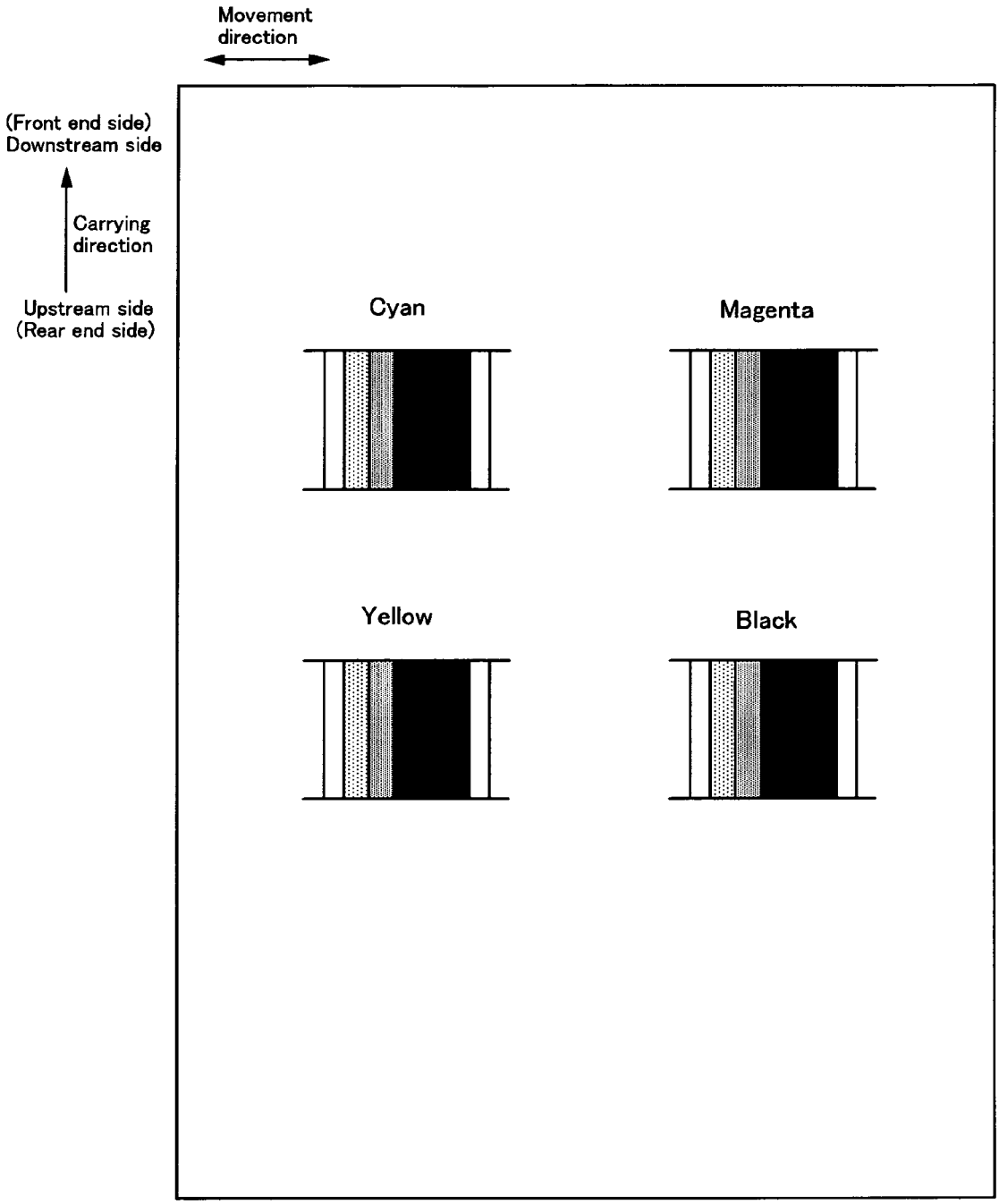
FIG. 11 is an explanatory diagram of a test pattern.
Figure 12:
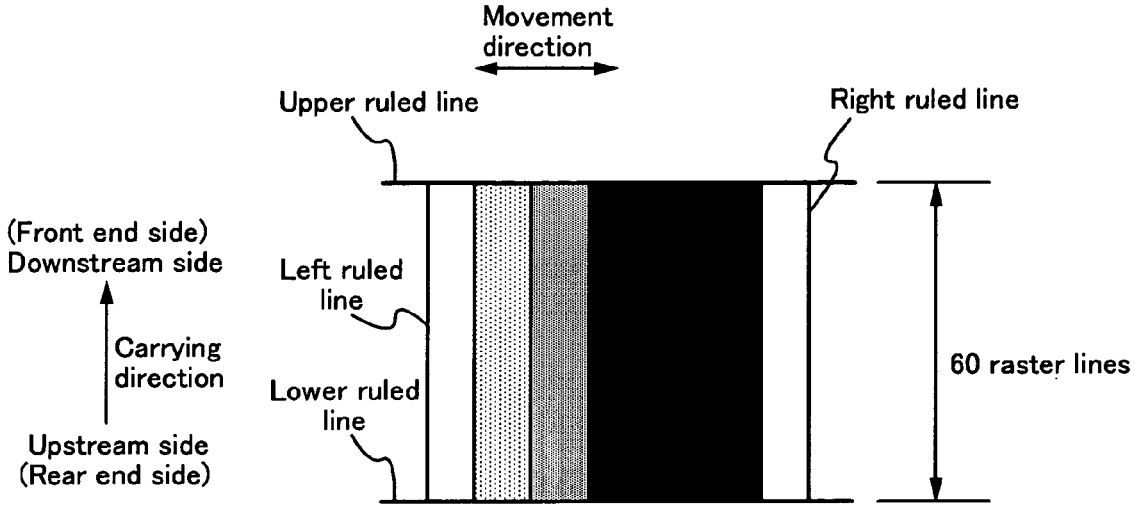
FIG. 12 is an explanatory diagram of a correction pattern.

FIG. 11 is an explanatory diagram of a test pattern. FIG. 12 is an explanatory diagram of a correction pattern. Four correction patterns are formed in the test pattern according to the colors. Each correction pattern is constituted by band-like patterns in five density levels, an upper ruled line, a lower ruled line, a left ruled line, and a right ruled line. Each band-like pattern is generated from image data of a constant tone value, and the band-like patterns consist of, from the left-end band-like pattern to the right side, patterns of the tone value 76 (30% density), tone value 102 (40% density), tone value 128 (50% density), tone value 153 (60% density), and tone value 179 (70% density), with the density increasing in this order. It should be noted that the five tone values (densities) are referred to as "instruction tone values (instruction densities)", and are respectively expressed by symbols as Sa (=76), Sb (=102), Sc (=128), Sd (=153), and Se (=179). Though thousands of raster lines can be formed in the printing region in the normal printing, each band-like pattern is not required to include such a number of raster lines as can be formed in the printing region in printing the correction pattern. In this embodiment, the theoretical carrying amount in one rotation of the carry roller 23 is set so as to coincide with the distance by which the paper is carried by eight carrying operations. In other words, the eight virtual set regions that are mutually different are set to the carry roller 23. For this reason, each band-like pattern is printed so as to include at least one row of dots formed by ink ejected from each of the nozzles during the dot forming operations performed after the paper is carried over each of the set regions. At this time, if the last formed raster line is formed in the row region whose density is read for obtaining the correction values, since no raster line is formed adjacent to that raster line in the carrying direction, there is fear that the density of the last raster line is read low. Therefore, the number of raster lines formed in the band-like pattern is larger by several lines than the number of raster lines actually required (56 raster lines in this embodiment). In this case, it is assumed that each band-like pattern is constituted by 60 raster lines.

The upper ruled line is formed by the first raster line that configures the band-like pattern (the raster line in the side furthest downstream in the carrying direction). The lower ruled line is formed by the last raster line that configures the band-like pattern (the raster line in the side furthest upstream in the carrying direction).

Next, the operator places the test pattern printed by the printer 1 on the document platen glass 152 of the scanner 150, closes the upper cover 151, to set the test pattern on the scanner 150. Then, the scanner driver of the computer 110 makes the scanner 150 read the correction pattern (S103). Reading of the cyan correction pattern is described below (it should be noted that the correction patterns of other colors are read in the same manner).

Figure 13:
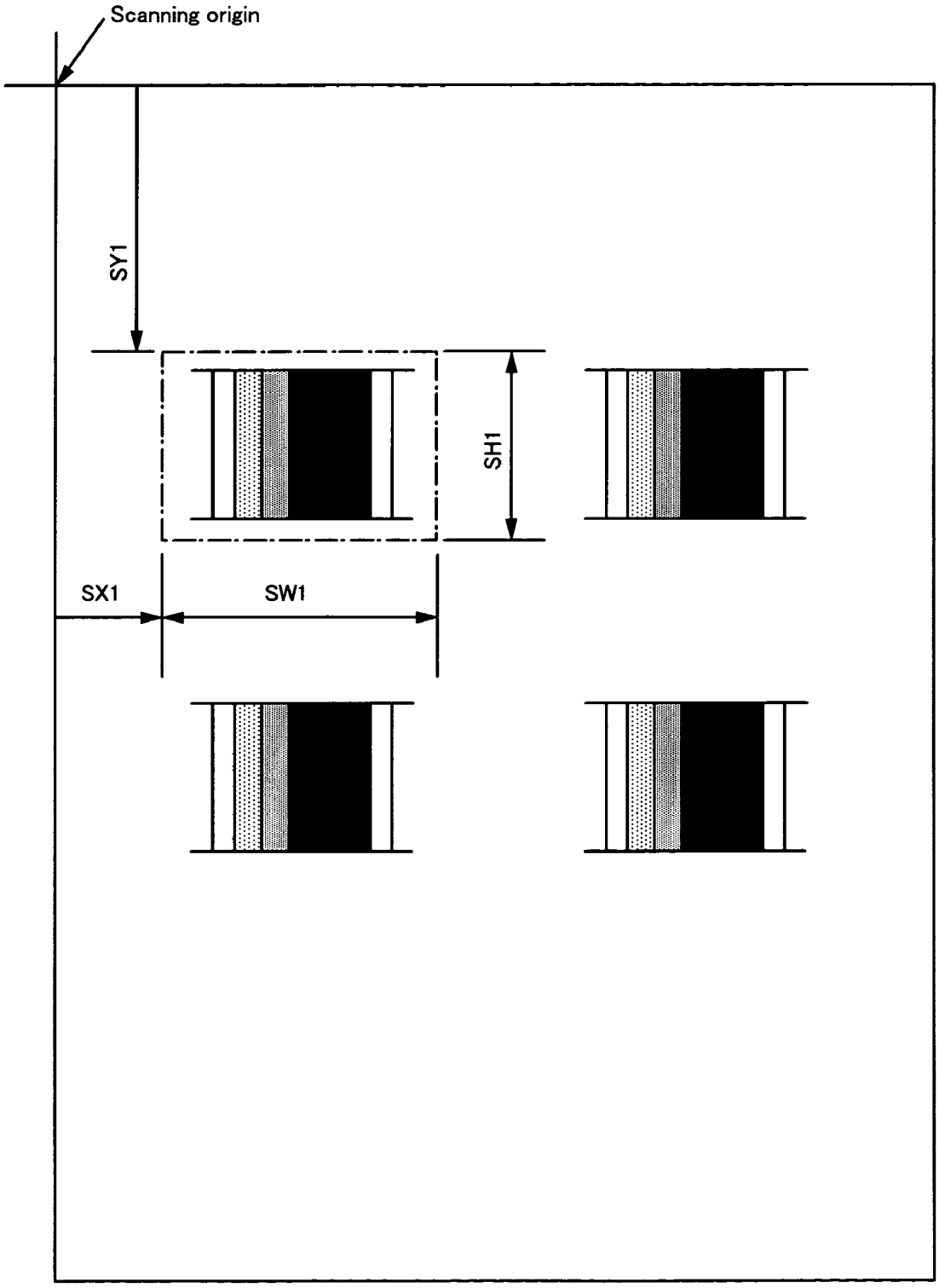
FIG. 13 is an explanatory diagram of a reading range of a cyan correction pattern.

FIG. 13 is an explanatory diagram of the reading range of the cyan correction pattern. The range surrounding the cyan correction pattern with the alternate long-and-short dashed line represents the reading range in reading the cyan correction pattern. The parameters SX1, SY1, SW1, and SH1 for specifying this range are set in advance in the scanner driver by the correction value obtaining program. By making the scanner 150 read this range, it is possible to read the entire cyan correction pattern, even if the test pattern is set on the scanner 150 in a slightly misaligned state. With this process, an image in the reading range shown in the figure is read by the computer 110 as the read image data that contains unit read image data corresponding to each of the minimum read regions that are divided into squares at a resolution of 2880×2880 dpi.

Next, the correction value obtaining program of the computer 110 detects an inclination θ in the correction pattern included in the read image data (S104), and performs rotation process to the read image data in accordance with the inclination θ (S105).

Figure 14A:
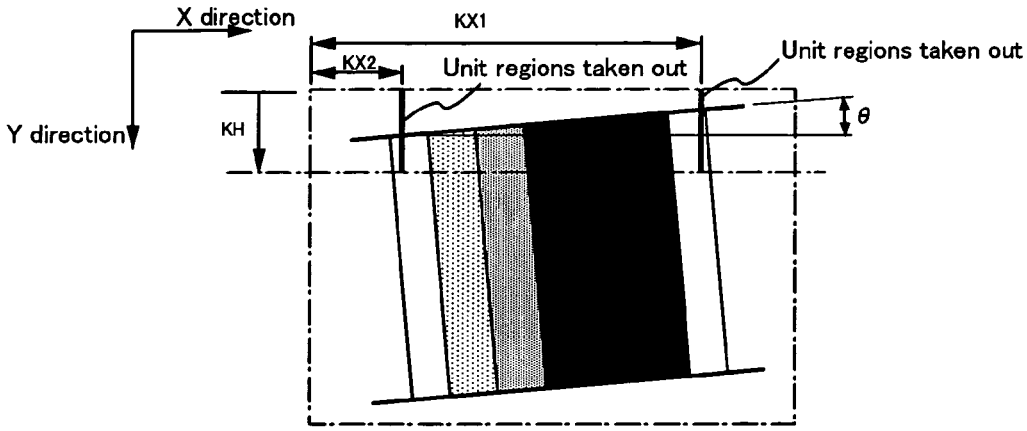
FIG. 14A is an explanatory diagram of read image data at the time when detecting an inclination.
Figure 14B:
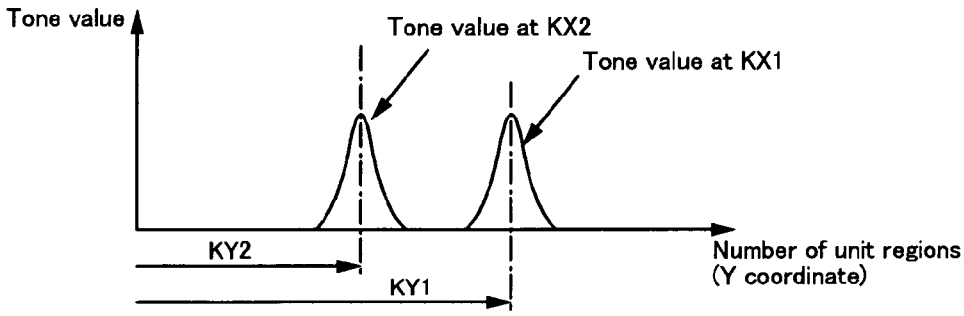
FIG. 14B is an explanatory diagram of detection of the position of an upper ruled line.
Figure 14C:
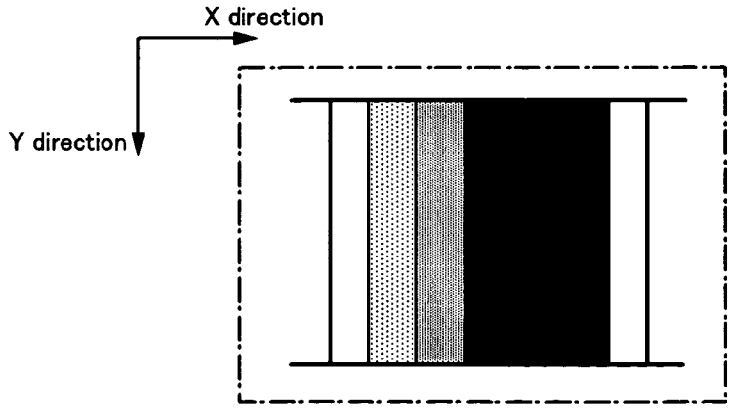
FIG. 14C is an explanatory diagram of read image data after the rotation process.

FIG. 14A is an explanatory diagram of read image data at the time of detecting the inclination. FIG. 14B is an explanatory diagram of detecting the position of the upper ruled line. FIG. 14C is an explanatory diagram of the read image data after the rotation process. From the read image data that was read, the correction value obtaining program takes out unit read image data for read regions that has the minimum read region located from the left by a distance of KX1 and consists of KH minimum read regions from the top, and unit read image data for read regions that has the minimum read region located from the left by a distance of KX2 and consists of KH minimum read regions from the top. At this time, the parameters KX1, KX2, and KH are set in advance so that the minimum read regions that are taken out include the upper ruled line, and do not include the right and left ruled lines. Then, in order to detect the position of the upper ruled line, the correction value obtaining program obtains the respective center of gravity positions KY1 and KY2 of the tone values of the KH pieces of pixel data that have been taken out, namely, the center of gravity positions in terms of density distribution.

Then, based on the parameters KX1 and KX2 and the center of gravity positions in terms of density distribution KY1 and KY2, the correction value obtaining program calculates the inclination θ of the correction pattern by the following formula, and performs the rotation process of the read image data based on the calculated inclination θ.

$$\theta=\tan-1\{(KY2-KY1)/(KX2-KX1)\}$$

Next, the correction value obtaining program of the computer 110 performs trimming of the read image data and extracts necessary unit read image data from the read image data (S106).

Figure 15A:
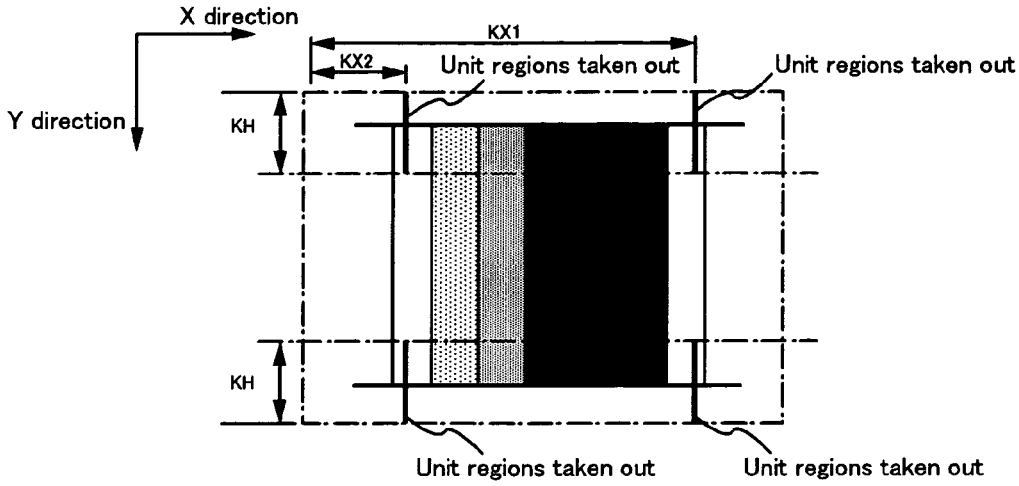
FIG. 15A is an explanatory diagram of read image data at the time of trimming.
Figure 15B:
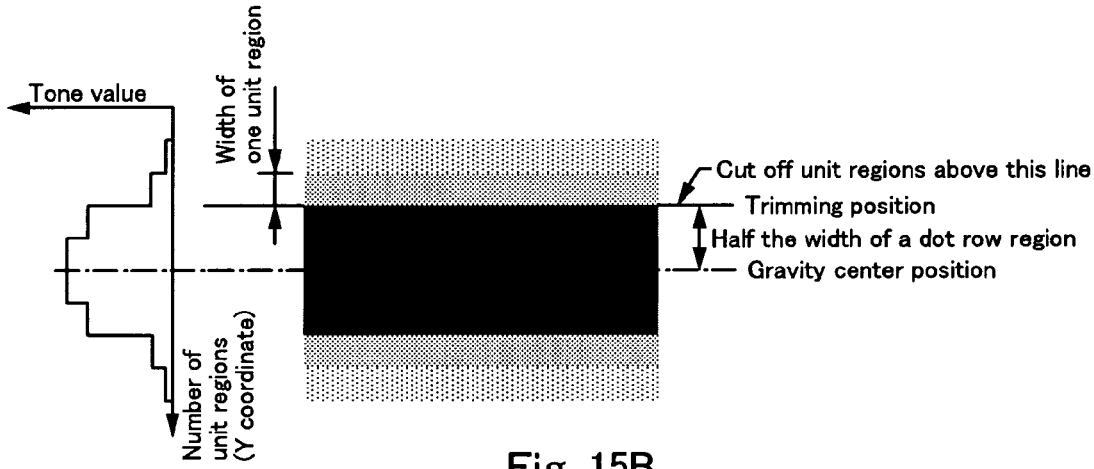
FIG. 15B is an explanatory diagram of the trimming position at the upper ruled line.

FIG. 15A is an explanatory diagram of read image data at the time of trimming. FIG. 15B is an explanatory diagram of the trimming position at the upper ruled line. As with the process in step S104, the correction value obtaining program takes out, from the read image data that has been subjected to the rotation process, the unit read image data of KH minimum read regions from the top which are located at a distance of KX1 from the left, and the unit read image data of KH minimum read regions from the top which are located at a distance of KX2 from the left. Then, in order to detect the position of the upper ruled line, the correction value obtaining program obtains the respective center of gravity positions KY1 and KY2 of the tone values of the KH unit read image data that have been taken out, and calculates the average value of the two center of gravity positions. Then the trimming position is determined as the boundary of the minimum read region that is the closest to the position that is shifted to the upper side from the center of gravity position by half the width of the row region. It should be noted that, in this embodiment, the resolution of the read image data is 2880 dpi and the width of the row region is 720 dpi, and therefore a half of the width of the row region corresponds to the width of two minimum read regions. Then, the correction value obtaining program cuts off the minimum read regions in the upper side than the determined trimming position and performs trimming.

Figure 15C:
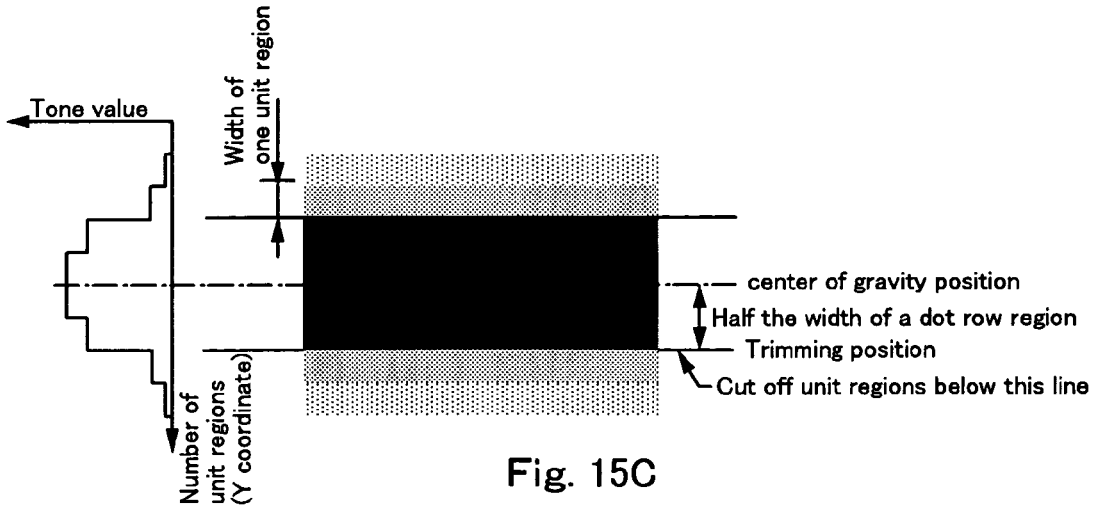
FIG. 15C is an explanatory diagram of the trimming position at the lower ruled line.

FIG. 15C is an explanatory diagram of the trimming position at the lower ruled line. As similar to the upper ruled line side, the correction value obtaining program takes out, from the read image data that has been subjected to the rotation process, unit read image data for read regions that has the minimum read region located separate from the left by a distance of KX1 and consists of KH minimum read regions, and the unit read image data for read regions that has the minimum read region located separated from the left by a distance of KX2 and consists of KH minimum read regions, and calculates the center of gravity position of the lower ruled line. The trimming position is determined as the boundary of the minimum read region that is the closest to the position that is shifted to the lower side from the center of gravity position by half the width of the row region. Then, the correction value obtaining program cuts off minimum read regions in the lower side than the determined trimming position and performs trimming.

Next, the correction value obtaining program of the computer 110 converts the resolution of the trimmed read image data so that the number of minimum read regions in the Y direction becomes equal to the number of raster lines configuring the correction pattern (S107).

Figure 16:
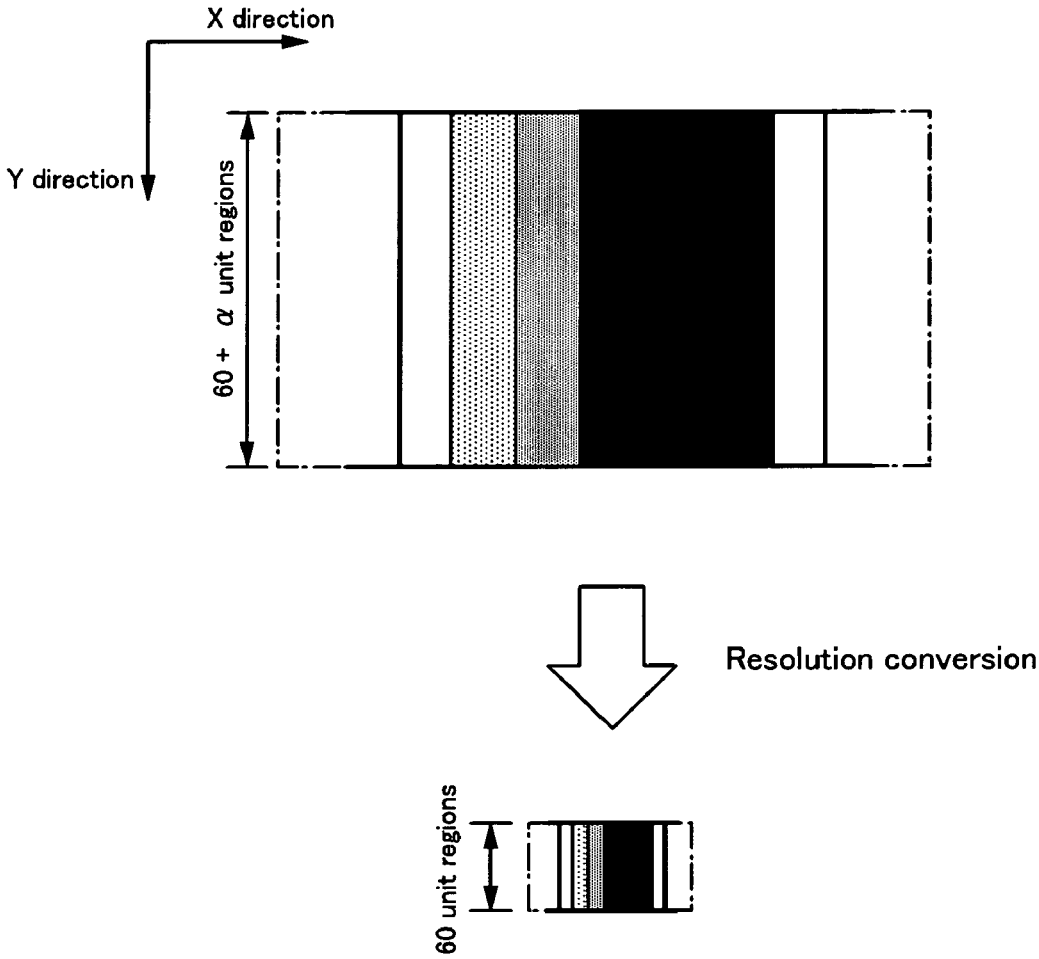
FIG. 16 is an explanatory diagram of resolution conversion.

FIG. 16 is an explanatory diagram of resolution conversion. If the printer 1 ideally forms a correction pattern consisting of n raster lines at 720 dpi and the scanner 150 ideally reads the correction pattern at 2880 dpi (four times the resolution of the correction pattern), the number of minimum read regions in the Y direction of the read image data after trimming should be "4n". In reality, however, there are cases in which the number of minimum read regions in the Y direction of the read image data does not become 4n due to influence of misalignment during printing or reading, and here, the number of minimum read regions in the Y direction of the read image data after trimming is "4n+α". The correction value obtaining program of the computer 110 performs resolution conversion (size-reduction process) on the read image data at a magnification of n/(4n+α) (="number of raster lines configuring the correction pattern"/"number of minimum read regions in the Y direction of the read image data after trimming"). Here, the Bicubic method is used for the resolution conversion. As a result, the number of data in the Y direction of the read image data after resolution conversion becomes n. The region indicated by each of the read image data thus converted corresponds to a unit region which is a region where one dot can be formed. Each of these read image data is referred to as the unit region data. In other words, the read image data of the correction pattern constituted by unit read image data in 2880 dpi is converted into read image data of a correction pattern constituted by unit region data in 720 dpi. As a result, the number of unit regions in the Y direction becomes equal to the number of row regions, and a row of unit regions in the X direction will have a one-to-one correspondence with a row region. For example, the row of unit regions in the X direction located at the top will correspond to the first row region, and the row of unit regions located below the top row will correspond to the second row region. It should be noted that in this resolution conversion, since the object is to adjust the number of the unit region rows in the Y direction to n, resolution conversion (size-reduction process) in the X direction may be omitted.

Next, the correction value obtaining program of the computer 110 measures the density of each of the five band-like patterns in each row region (S108). Hereinbelow, there is described how the density in the first row region of the band-like pattern on the left formed at the tone value 76 (30% density) is measured (it should be noted that measurement in the other row regions is performed in the same way. Further, measurement of the other band-like patterns is also performed in the same way).

Figure 17A:
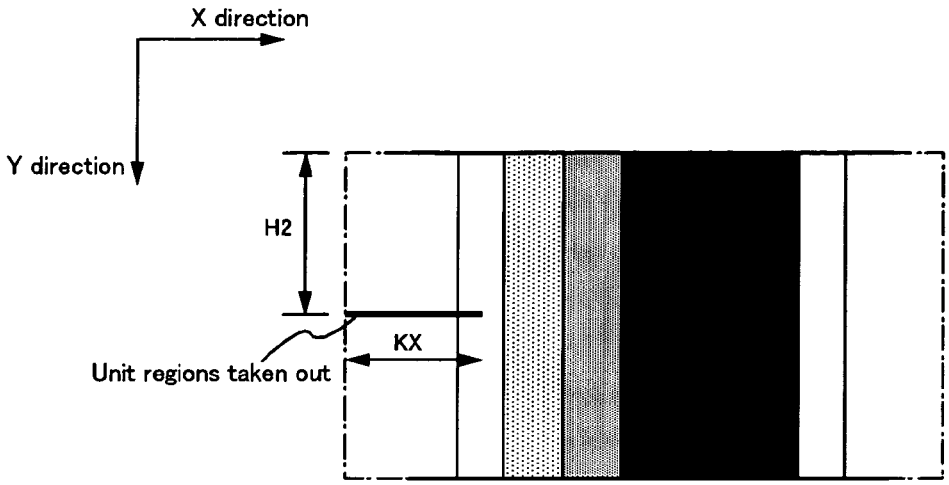
FIG. 17A is an explanatory diagram of an image data at the time of detecting the left ruled line.
Figure 17B:
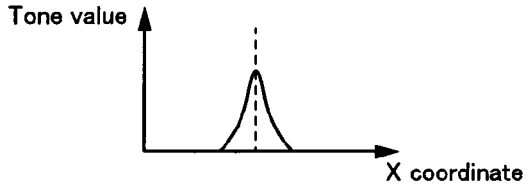
FIG. 17B is an explanatory diagram of detection of the position of the left ruled line.
Figure 17C:
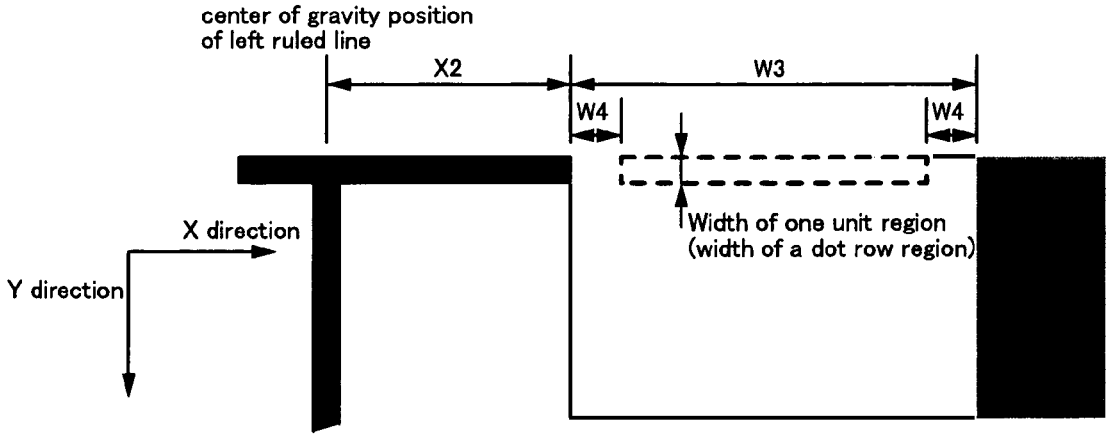
FIG. 17C is an explanatory diagram of a measurement range for measuring the density of a band-like pattern at 30% density in the first row region.

FIG. 17A is an explanatory diagram of image data at the time of detecting the left ruled line. FIG. 17B is an explanatory diagram of detecting the position of the left ruled line. FIG. 17C is an explanatory diagram of the measuring range of the density of a band-like pattern at 30% density in the first row region. From the read image data that was subjected to the resolution conversion, the correction value obtaining program takes out unit region data for unit regions that has the unit region located from the top by a distance of H2 and consists of KX unit regions from the left. The parameter KX is set in advance so that the left ruled line is included in the unit region data that are taken out at this time. Then, in order to detect the position of the left ruled line, the correction value obtaining program obtains the center of gravity position of the tone values of the unit region data of the KX unit regions that have been taken out. From the shape of the correction pattern, it is known that there is the band-like pattern at 30% density with a width of W3 on the right side of the center of gravity position (the position of the left ruled line) separated by a distance X2. Therefore, the correction value obtaining program uses the center of gravity position as a reference and extracts the unit region data of the range surrounded by the dotted line, excluding the areas on the left and right ends of the band-like pattern with a width W4. The average value of the tone values of the unit region data within that range is determined as the measured value for 30% density of the first row region. It should be noted that when measuring the density of the band-like pattern at 30% density of the first row region, the unit region data of a range that is one unit region below the range in the dotted line in the figure is extracted. In this manner, the correction value obtaining program measures the densities of the five band-like patterns for each row region.

Figures 18, 19:
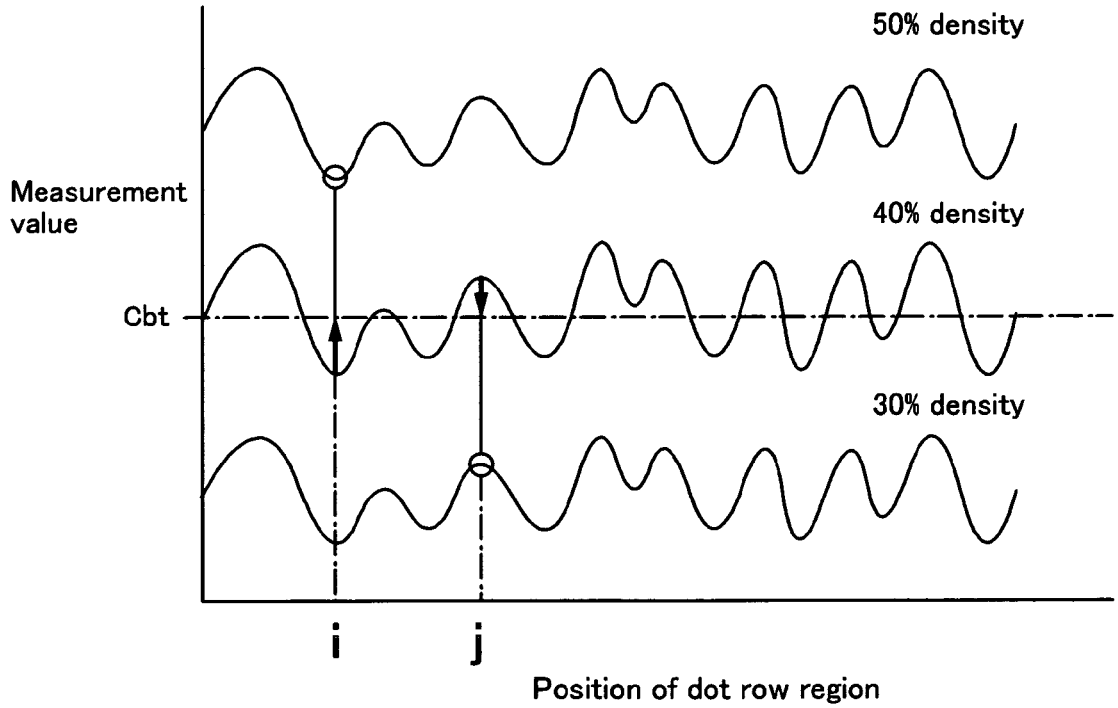
FIG. 18 is a measured value table in which the results of measuring the density of five band-like patterns for cyan are summarized.
FIG. 19 is a graph of the measured values of the cyan band-like patterns at 30% density, 40% density, and 50% density.

FIG. 18 is a measured value table summarizing measurement results of the density of the five band-like patterns of cyan. As shown in the figure, the correction value obtaining program of the computer 110 associates the measured values of the densities of the five band-like patterns with every corresponding row regions, and creates the measured value table. The measured value tables are also created for the other colors. It should be noted that in the following explanation, with respect to a certain row region, measured values of the band-like patterns having tone values of Sa to Se are indicated respectively as Ca to Ce.

FIG. 19 is a graph showing the measured values of the cyan band-like patterns at 30% density, 40% density, and 50% densities of cyan. Although the band-like patterns are uniformly formed at their respective instruction values, there is an unevenness in density among each of the row regions. These differences in density among each of the row regions are the cause of unevenness in density in a print image.

In order to eliminate the unevenness in density, it is preferable to make the measured values of each band-like pattern to be uniform. Accordingly, a process for making the measured values of the band-like pattern at a tone value Sb (40% density) uniform is considered. Here, an average value Cbt of the measured values of all the row regions in the band-like pattern at the tone value Sb is specified as the target value for 40% density. With respect to the row region i whose measured value is lighter than the target value Cbt, it is considered that the tone value can be corrected in a manner to make the density darker in order for the measured value of density to approach the target value Cbt. On the other hand, with respect to the row region j whose measured value is darker than the target value Cbt, it is considered that the tone value may be corrected in a manner to make the density lighter in order for the measured value of density to approach the target value Cbt.

Accordingly, the correction value obtaining program of the computer 110 calculates correction values corresponding to the row regions (S109). Here, calculation of a correction value for the instruction tone value Sb in a certain row region is described. As described below, the correction value of the row region i for the instruction tone value Sb (40% density) shown in FIG. 19 is calculated based on the measured values for the tone value Sb and tone value Sc (50% density). On the other hand, the correction value for the instruction tone value Sb (40% density) of the row region j is calculated based on the measured values of the tone value Sb and tone value Sa (30% density).

Figure 20A:
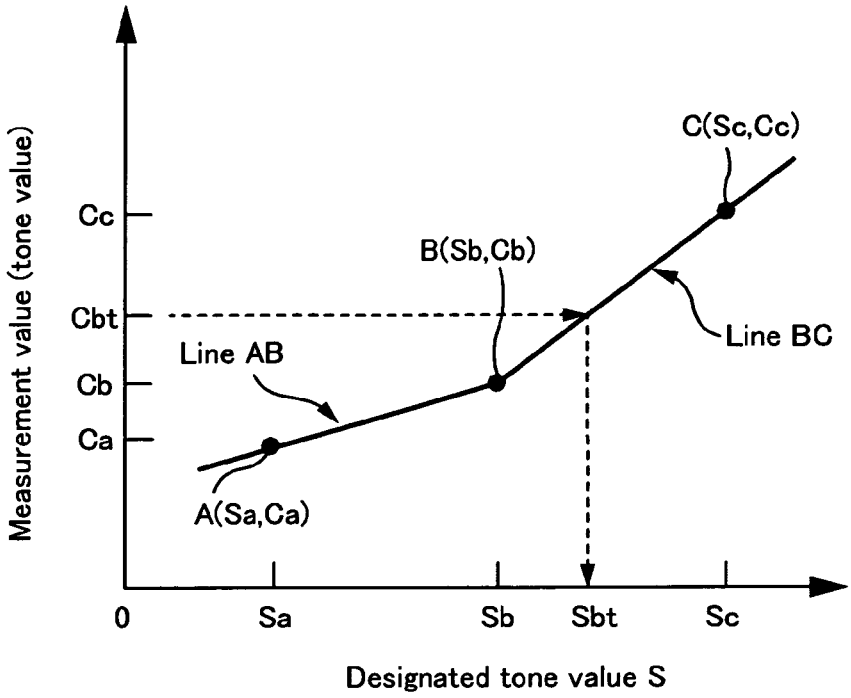
FIG. 20A is an explanatory diagram of a target instruction tone value Sbt with respect to the instruction tone value Sb in the row region i.

FIG. 20A is an explanatory diagram of the target instruction tone value Sbt for the instruction tone value Sb in the row region i. In this row region, the measured value Cb of the density of the band-like pattern formed at the instruction tone value Sb shows a tone value smaller than the target value Cbt (the density of this row region is lighter than the average density of the band-like pattern at 30% density). If the printer driver causes the printer to form a pattern at the density of the target value Cbt in this row region, the printer driver can provide necessary instructions based on the target instruction tone value Sbt calculated by the following formula (linear interpolation based on a line BC).

$$Sbt=Sb+(Sc-Sb)\times\{(Cbt-Cb)/(Cc-Cb)\}$$

Figure 20B:
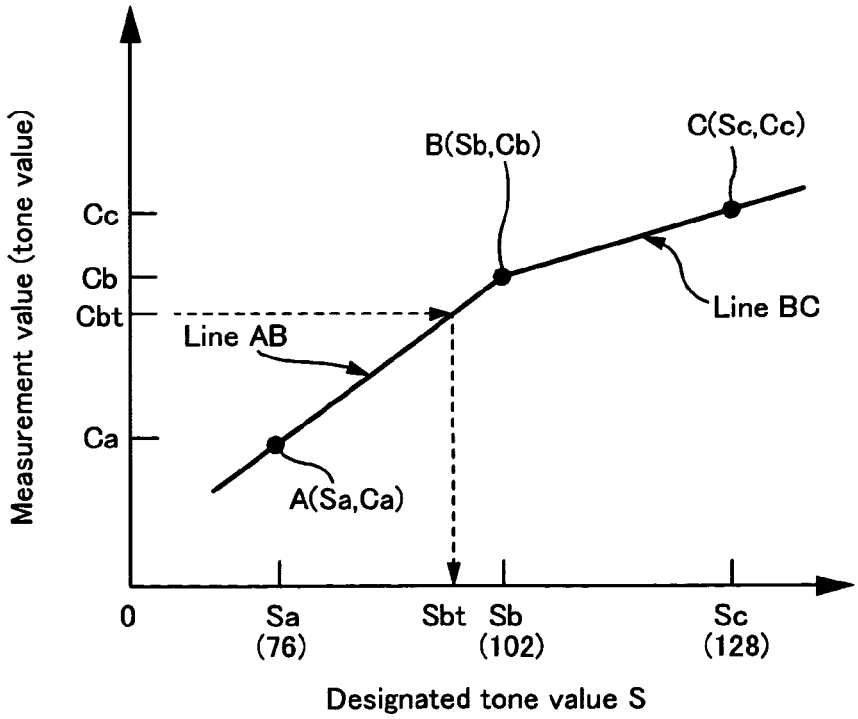
FIG. 20B is an explanatory diagram of a target instruction tone value Sbt with respect to the instruction tone value Sb in the row region j.

FIG. 20B is an explanatory diagram of the target instruction tone value Sbt for the instruction tone value Sb in the row region j. In this row region, the measured value Cb of the density of the band-like pattern formed at the instruction tone value Sb shows a tone value larger than the target value Cbt (this row region is lighter than the average density of the band-like pattern at 30% density). If the printer driver causes the printer to form a pattern of a density of the target value Cbt in this row region, then the printer driver can provide necessary instructions based on the target instruction tone value Sbt that is calculated by the following formula (linear interpolation based on a line AB).

$$Sbt=Sb-(Sb-Sa)\times\{(Cbt-Cb)/(Ca-Cb)\}$$

After calculating the target instruction tone value Sbt in this manner, the correction value obtaining program calculates a correction value Hb for the instruction tone value Sb in this row region by the following formula.

$$Hb=(Sbt-Sb)/Sb$$

The correction value obtaining program of the computer 110 calculates the correction values Hb for the tone value Sb (40% density) for the respective row regions. Similarly, the correction value obtaining program calculates the correction values Hc for the tone value Sc (50% density) for the respective row regions based on the measured values Cc and the measured values Cb or Cd of the row regions. Further, similarly, the correction value obtaining program calculates the correction values Hd for the tone value Sd (60% density) for the respective row regions based on the measured values Cd and the measured values Cc or Ce of the respective row regions. Further, with respect to other colors, three correction values (Hb, Hc, and Hd) are calculated for the respective row regions.

Next, the correction value obtaining program of the computer 110 stores the correction values in the memory 63 of the printer 1 (S110).

FIG. 21 is an explanatory diagram of a cyan correction value table. In the correction value table, three correction values (Hb, Hc, and Hd) are associated with the region of the carry roller 23 that was in contact with paper in the carrying operation immediately before a row of dots is formed in each row region, and the nozzle that ejects ink to form that row of dots when the row of dots is formed in each row region. Specifically, as already described with reference to FIG. 8, it is specified in advance based on printing conditions such as the printing method, which carrying operation and which nozzle that ejects ink for forming that raster line the raster line is formed by. For this reason, based on printing conditions, three correction values associated with each row region are associated with the region over which the paper is carried and the nozzle that ejects ink. In this embodiment, based on the printing conditions that the correction pattern is printed by the interlace printing in which the carrying amount in one carry operation is a distance corresponding to seven row regions, and one raster line is formed by ink ejected from one nozzle, for example, three correction values (Hb_1, Hc_1, and Hd_1) associated with the first row region on the front end side of paper are associated with the region C and the second nozzle. Three correction values (Hb_n, Hc_n and Hd_n) respectively associate with the instruction tone values Sb (=102), Sc (=128), and Sd (=153). The above description is also applicable to the correction value tables for other colors.

After storing the correction values in the memory 63 of the printer 1, the correction value obtaining process is ended. Then, the printer 1 and the computer 110 are disconnected, and after other inspections of the printer 1, the printer 1 is shipped from the factory. A CD-ROM storing the printer driver is packed together with the printer 1.

Regarding Processes by Users

Figure 22:
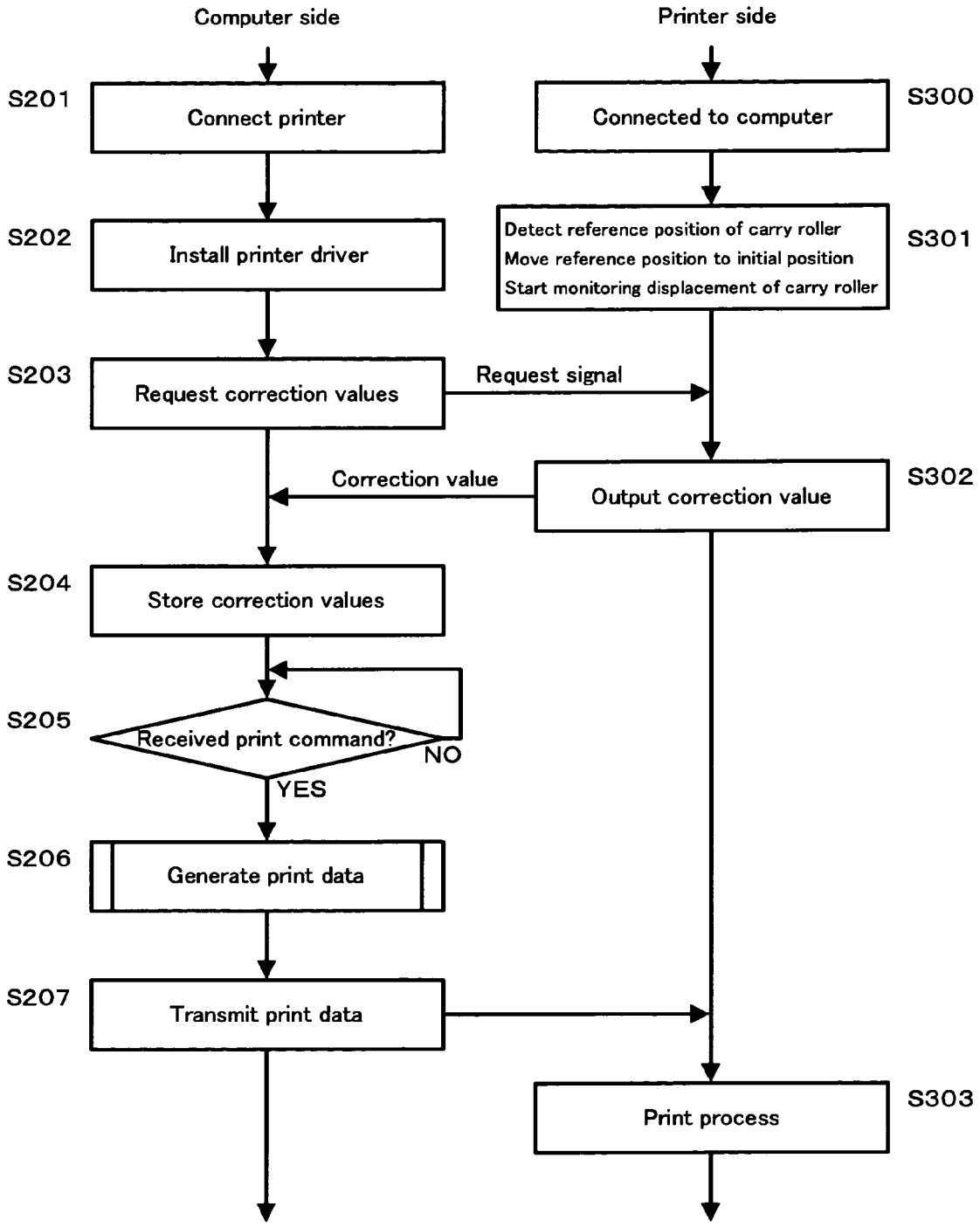
FIG. 22 is a flowchart of processes performed by a user.

FIG. 22 is a flowchart of the processes performed by the user.

A user who has purchased the printer 1 connects the printer 1 to the computer 110 owned by the user (a computer different from the computer at the printer manufacturing factory, of course) (S201, S300). It should be noted that the scanner 150 does not have to be connected to the user's computer 110.

When the printer 1 is powered on by the user, the printer 1 performs predetermined initial operations. At this time, the controller 60 makes the carry roller 23 rotate while monitoring the output from the rotary encoder 52, detects the reference position of the carry roller 23, and makes the detected reference position be rotated to the initial position of the carry roller 23 (S301). In this embodiment, the initial position is set to a position in which the reference position is located vertically above the shaft of the carry roller 23. The controller 60 manages the displacement of the carry roller 23 with the initial position as the reference, which enables the controller 60 to detect the region at which a paper being carried contacts the carry roller 23 when the paper is being carried later.

Next, the user sets an included CD-ROM to the record/play device 140, and installs the printer driver (S202). The printer driver installed on the computer 110 requests the printer 1 to send the correction values to the computer 110 (S203). Upon such a request, the printer 1 sends to the computer 110 the correction value tables stored in its memory 63 (S302). The printer driver stores the correction values sent from the printer 1 in the memory (S204). As a result, the correction value table is created on the computer side. After the above processes are completed, the printer driver stands by until there is a print command from the user ("NO" in S205).

When the printer driver receives a print command from the user (YES at S205), it generates print data in accordance with the correction values (S206), and sends the print data to the printer 1. The printer 1 then performs the print process in accordance with the print data (S303).

Figure 23:
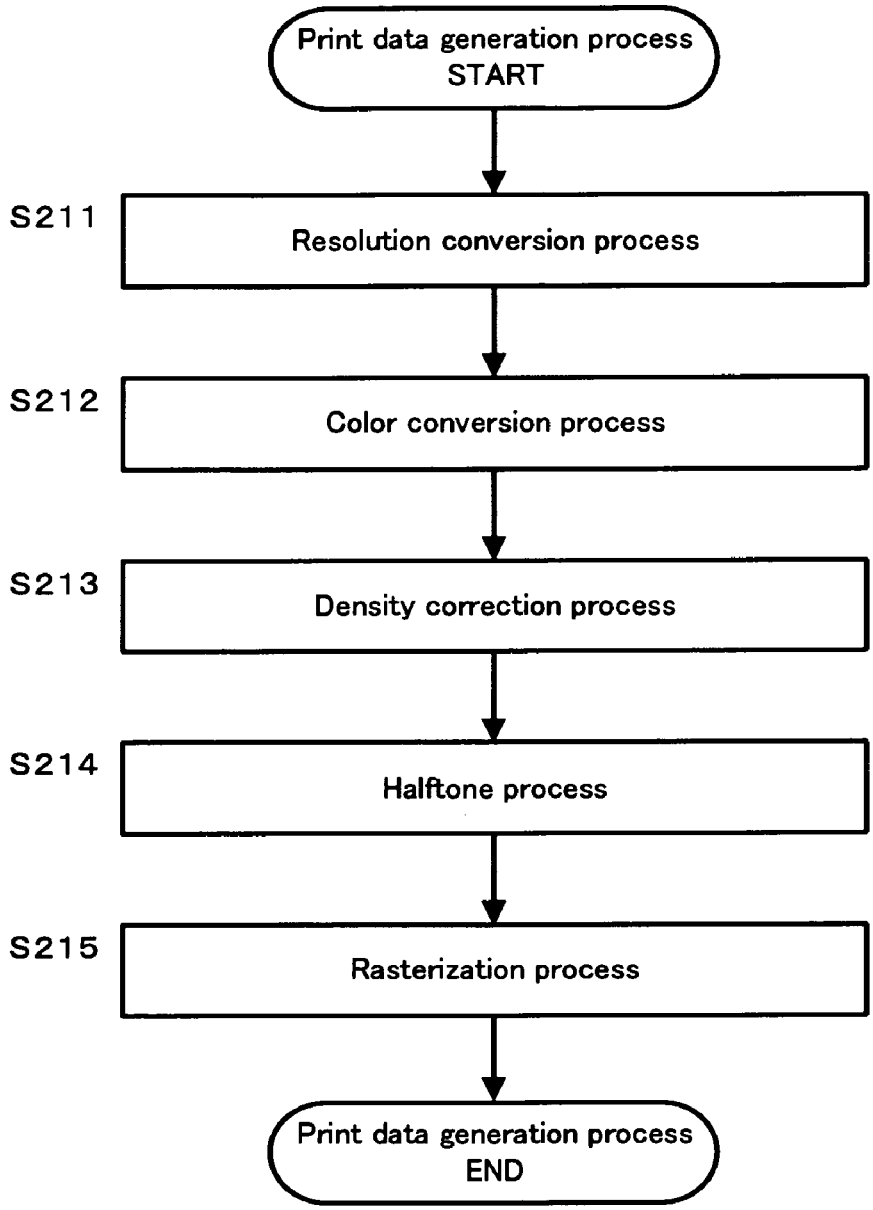
FIG. 23 is a flowchart of print-data generation process.

FIG. 23 is a flowchart of print-data generation processes. The processes are performed by the printer driver.

First, the printer driver performs the resolution conversion process (S211). The resolution conversion process is a process in which image data (such as text data and image data) output from the application program is converted to image data of a resolution when printing on paper. For example, when the resolution for when printing an image on paper is specified as 720×720 dpi, then the image data received from the application program is converted to image data of a resolution of 720×720 dpi. It should be noted that, the image data after the resolution conversion process is data with 256 tones expressed using the RGB color space ("RGB data") Next, the printer driver performs a color conversion process (S212). The color conversion process is a process in which the RGB data is converted to CMYK data that is expressed using the CMYK color space. The color conversion process is performed by the printer driver referencing a table in which the tone values of the RGB data and the tone values of the CMYK data are associated ("color conversion lookup table LUT"). By this color conversion process, the RGB data for each unit region is converted into CMYK data which corresponds to ink colors. It should be noted that data after the color conversion process is CMYK data having 256 tones expressed using the CMYK color space.

Next, the printer driver performs density correction process (S213). The density correction process is a process in which the tone value of each unit region data is corrected based on the correction value table stored in the memory. In other words, based on print information such as print conditions when printing the image, it is specified that each unit region data of image data that is the basis of an image to be printed, is data for forming dots in the unit region in any row region. Also, it is specified, for each row region, the carry operation before a dot forming operation for forming the dots, and the nozzle that ejects ink for forming the dots in respect to a dot row of each row region. For this reason, the controller 60 corrects each of the unit region data of the image data based on the correction value table. At this time, the printer driver determines the set region that was last in contact with the paper carried during the carry operation immediately before performing the initial dot forming operation, namely, the carrying operation for positioning the paper, from the carrying amount by which the paper is to be carried based on the print information. Then, the image data is corrected based on the correction values associated with the specified set region. For example, if the set region that was last contacting the paper carried by the carrying operation for positioning the paper is determined as the region A, as shown in FIG. 8, the unit region data for forming the first raster line is corrected based on the correction value associated with the second nozzle #2 of the region C, the unit region data for forming the second raster line is corrected based on the correction value associated with the fourth nozzle #4 of the region B. The unit region data for forming the third raster line is corrected based on the correction value associated with the sixth nozzle #6 of the region A. In this way, the image data is corrected based on the correction value table, and corrected data is generated.

Figure 24:
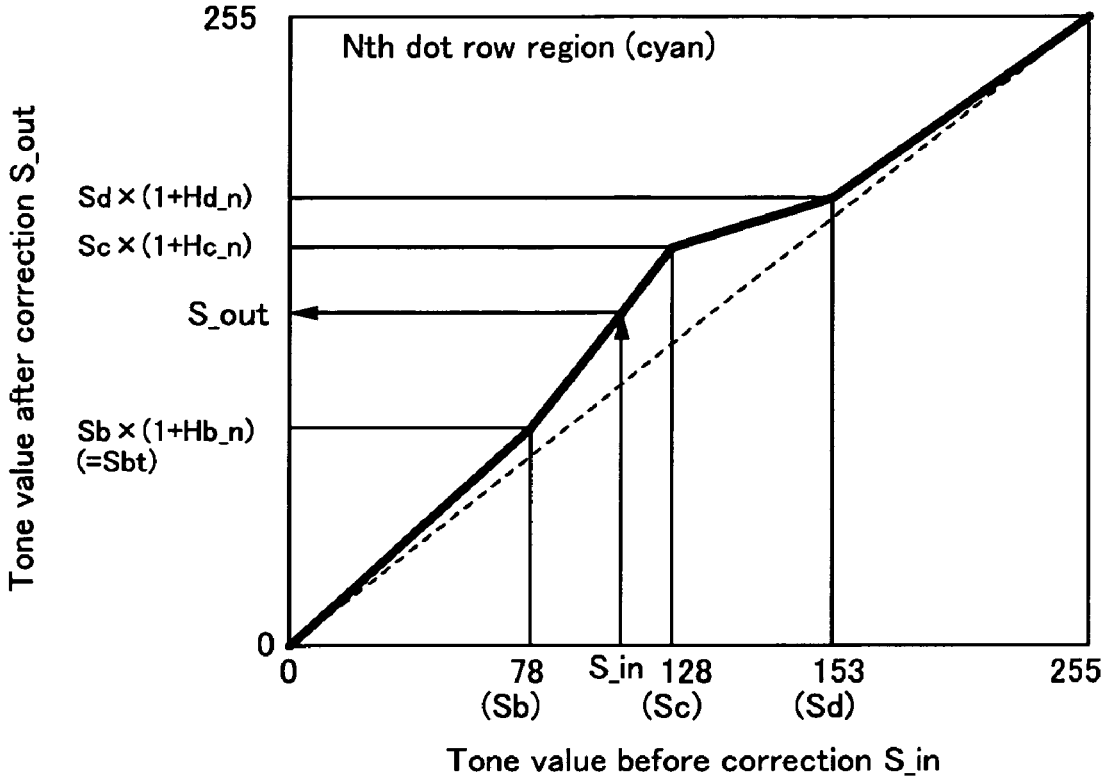
FIG. 24 is an explanatory diagram of density correction process for an nth row region of cyan.

FIG. 24 is an explanatory diagram of the density correction process for an nth row region for cyan. FIG. 24 shows how the tone value S_in of unit region data of a unit region belonging to the nth row region for cyan is corrected. It should be noted that the tone value after correction is S_out.

If the tone value S_in of the unit region data before correction is the same as the instruction tone value Sb, the printer driver can form an image at the target density Cbt in the unit region corresponding to that unit region data, by correcting the tone value S_in to the target instruction tone value Sbt. That is, if the tone value S_in of the unit region data before correction is the same as the instruction tone value Sb, then it is preferable to correct the tone value S_in (=Sb) to Sb×(1+Hb) using the correction value Hb corresponding to the instruction tone value Sb. Similarly, if the tone value S of the unit region data before correction is the same as the instruction tone value Sc, then it is preferable to correct the tone value S_in (=Sc) to Sc×(1+Hc).

On the contrary, when the tone value S_in before correction is different from the instruction tone value, then the tone value S_out to be output is calculated using linear interpolation as shown in FIG. 24. In the linear interpolation shown in the figure, linear interpolation is performed between the respective tone values S_out after correction (Sbt, Sct, and Sdt) which correspond to the respective instruction tone values (Sb, Sc, and Sd). This, however, is not a limitation. For example, it is possible to calculate a correction value H corresponding to the tone value S_in by performing linear interpolation between the respective correction values (Hb, Hc, and Hd) corresponding to the respective instruction tone values, and calculate the tone value after correction as S_in×(1+H) using the calculated correction value H.

By the density correction process described above, with respect to a row region that tends to be recognized dark, the tone values of the unit region data (CMYK data) of unit regions corresponding to that row region are corrected to a lower value. On the other hand, with respect to a row region that tends to be recognized light, the tone values of the unit region data of unit regions corresponding to that row region are corrected to a higher value. It should be noted that the printer driver performs a similar correction process with respect to the other row regions of other colors as well. Image data is corrected in this manner and corrected data is generated.

Next, the printer driver performs the half tone process (S214). The halftone process is a process in which data with a high number of tones is converted to data with a number of tones that can be formed by the printer. For example, through the halftone process, data indicating 256 tones is converted to one-bit data indicating two tones or two-bit data indicating four tones. In the halftone process, the unit region data is generated such that the printer can form dots in a dispersed manner using methods such as dithering, γ-correction, and error diffusion. During the halftone process, the printer driver references a dither table when performing the dithering, references a gamma table when performing the γ-correction, and references an error memory for storing diffused errors when performing the error diffusion. Data that has been subjected to the halftone process has the same resolution (for example, 720×720 dpi) as that of the RGB data described above.

In this embodiment, the printer driver subjects the unit region data whose tone value has been corrected by the density correction process to the halftone process. As a result, with respect to a row region that tends to be recognized dark, the tone value of the unit region data of that row region is corrected to a lower value. Thus, the dot-generation rate of dots configuring the raster line in that row region becomes low. On the other hand, the dot-generation rate becomes high with respect to a row region that tends to be recognized light.

Next, the printer driver performs the rasterization process (S215). The rasterization process is a process in which image data in a matrix form is changed in an order for transfer to the printer. Rasterized data is output to the printer as the unit region data included in print data.

When the printer performs the print process in accordance with the print data generated as described above, the dot-generation rate of the raster line in each row region is changed as shown in FIG. 9C and the density of the image piece in that row region is corrected, thereby suppressing unevenness in density in the entire printed image.

In the printer 1 of this embodiment, the set regions that are virtually set so that the theoretical circumferential surface length of the set region from the reference position in the circumferential direction of the carry roller 23 coincides with the theoretical carry amount by which the paper is intermittently carried by the carry roller 23 in one carry operation, are associated with the correction values for correcting the image data. Therefore, it is possible to correct the image data with respect to one carry operation in the carry operations. Accordingly, it is possible to perform correction of the image data corresponding to each of the carry operations in which paper is intermittently carried.

In addition, since the correction values are associated with the set region that was in contact with the paper during the carry operation immediately before dots are formed based on the corrected data, the correction values with which the image data is corrected are associated with the portion of the carry roller 23 that was in contact with the paper during the carry operation immediately before dots are formed. Incidentally, the correction in this embodiment is for suppressing the unevenness in density among the row regions where rows of dots are formed along the movement direction of the carriage 31 that intersects the carrying direction. The corrected values are obtained based on the read results of the correction pattern printed on paper that is carried over the same regions as regions to be used when printing an image. That is to say, even in the case the carry amount by which the paper is carried by the carry operation immediately before the dot forming operation differs from the theoretical carry amount and includes an error or the like, it is possible to print an image of fine quality by setting the correction values so as to correct the image data in order to suppress the error. Specifically, even when the carry roller 23 is decentered, both in printing an image and printing the correction pattern, the image data is corrected based on the correction values that correspond to the same set regions over which the paper is carried. Therefore, it is possible to suppress the occurrence of the unevenness in density due to variance in the carry amount due to decentering.

In addition, in the correction pattern of this embodiment, a plurality of rows of dots that are formed by ink ejected from the nozzles moved in the movement direction are printed arranged along the carry direction based on the tone values indicating predetermined densities. Therefore, it is possible to read the unevenness in density actually present among the row regions in which rows of dots are formed, by reading the correction pattern that is printed. Since the image data is corrected based on the read results of this correction pattern, it is possible to correct the image data based on the characteristics of carrying that are unique to respective printers, and to suitably suppress the unevenness in density among the row regions in the image.

In addition, the theoretical circumferential surface length of the set region corresponding to n (n is an integer) rotations of the carry roller 23 is set so as to coincide with an amount obtained by multiplying by an integer the theoretical carry amount by which the paper is carried in one carry operation. Therefore, when the carry roller 23 rotates n times or more, the carry operations for carrying the paper over the same set regions are repeated. For example, when the carry roller 23 rotates for exactly n times after repeating "m" times of the carrying operation, the set region that is in contact with the paper during the (m+1)th carry operation is the same as the set region that was in contact with the paper in the first carrying operation. As a result, it is not necessary to set the correction values for each set region that contacts the paper corresponding to all the carry operations performed when printing an image. Only the correction values for set regions that contact the paper in the carry operations performed while the carry roller 23 rotates n times are necessary. Accordingly, it is possible to reduce the number of correction values associated with the set regions and reduce the area in the memory occupied by the correction value table.

Also, since the size of the band-like pattern included in the correction pattern is configured in the size which includes all of the rows of dots formed by ink ejected from each of the nozzles while the carry roller 23 rotates n times, it is possible to obtain the correction values that correspond to all the row regions in which raster lines that constitute the image are formed, while reducing the size of the correction pattern. For this reason, it is possible to suppress the consumption of consumables when printing the correction pattern.

In this embodiment, an example was described in which the theoretical circumferential surface length of the set region of the carry roller 23 coincides with the theoretical distance carried by eight carry operations. However, there is no limitation to this. For example, it is possible to set two or three times the theoretical circumferential distance of the carry roller 23 to coincide with the theoretical distance carried by fifteen carrying operations.

In addition, since the configuration includes a rotary encoder 52 for detecting the reference position of the carry roller 23 and the displacement amount of the reference position in the carrying operation, the controller 60 can more accurately detect the set region that was in contact with paper when the paper was carried by the carrying operation, by detecting the displacement amount of the reference position by the rotary encoder 52.

In this embodiment, a case where the boundary between the region A and region B of the carry roller 23 is located vertically above the shaft of the carry roller 23 in the carrying operation when positioning the front end of the paper, that is, an example in which the initial dot forming operation is performed to the paper carried over the region A was described. However, there is no limitation to this. Other set regions can be located vertically above the shaft of the carry roller 23, such as the boundary between the region C and the region D, the boundary between the region F and the region G of the carry roller 23. In such a case, when the boundary between the region C and the region D of the carry roller 23 is located vertically above the shaft of the carry roller 23, the paper was carried over the region C during the immediately preceding carrying operation. Therefore, the image data for forming the first raster line is corrected by the correction values associated with the region E and the second nozzle. Also, the position that is located vertically above the shaft of the carry roller 23 in the condition that the front end of the paper is positioned may not be a boundary of two set regions. For example, when the front end of the paper is in a positioned state, and any portion of the region E is located vertically above the shaft of the carry roller 23, the same correction values used for a case where the paper was carried over the region E during the immediately preceding carrying operation can be used. In such a case, although the correction values obtained by reading the row regions of the correction pattern do not precisely correspond to the row regions used in printing an image, at least it is possible to suppress the unevenness in density better than a case in which the image data is corrected with the correction values corresponding to the region A that is located at the opposite side to the region E.

Second Embodiment

The configuration of the printer in Embodiment 2 is substantially similar to that of the configuration of Embodiment 1 described above. Therefore, the summary of the configuration of the printer of Embodiment 2 is described referring to FIG. 2, FIG. 3A, and FIG. 3B, with similar portions shown by same reference numerals.

Printer

The basic configuration of the printer of Embodiment 2 is described below.

The printer 1 has a carry unit 20, a carriage unit 30, a head unit 40, a detector group 50, and a controller 60. The printer 1 that has received the print data from the computer 110, which is an external device, controls each of the units (the carry unit 20, the carriage unit 30, and the head unit 40) using the controller 60. The controller 60 controls each of the units in accordance with the print data that has been received from the computer 110 and prints an image on a paper. The detector group 50 monitors the conditions in the printer 1, and the detector group 50 outputs the results of this detection to the controller 60. The controller 60 controls each unit based on the detection results that are output from the detector group 50.

The carry unit 20 is for carrying a medium such as a paper in a predetermined direction (hereinafter, referred to as "carrying direction"). The carry unit 20 has a paper supply roller 21 as a media supplying section, a carry motor 22 (also called the "PF motor"), a carry roller 23, a platen 24, and a paper discharge roller 25. The paper supply roller 21 is a roller for supplying paper that has been inserted into a paper insert opening into the printer. The paper supply roller 21 has a D-shaped cross-section, and the length of its circumferential portion is set to be longer than the carry distance up to the carry roller 23. Therefore, it is possible to let the front end of the paper S reach the carry roller 23 by rotating the paper supply roller for one turn from a state in which the circumferential portion is away from the paper surface, thus carrying the paper S by the length of the circumferential portion. The carry roller 23 is a roller for carrying the paper S that has been supplied by the paper supply roller 21 up to a printable region.

Figure 25:
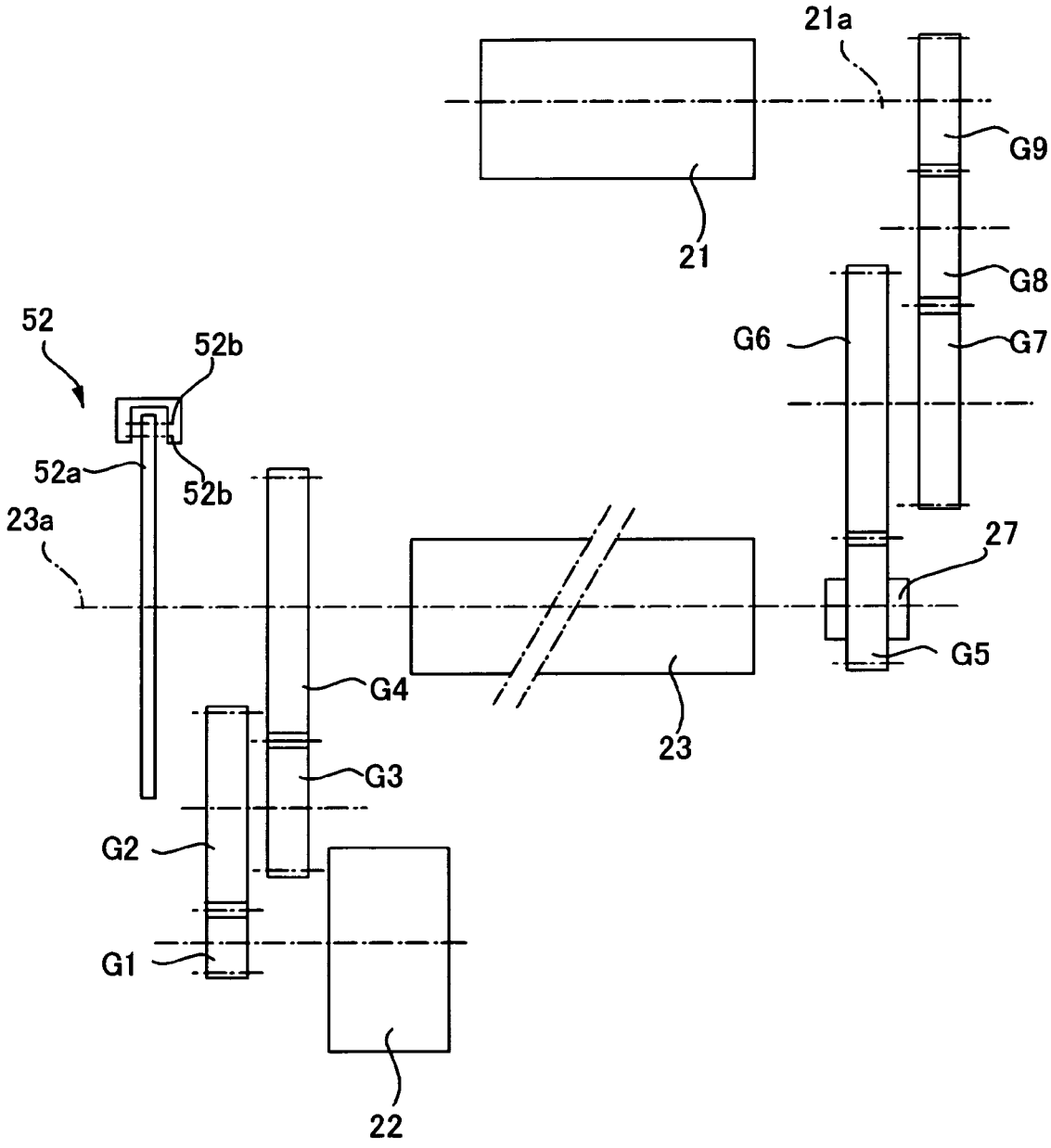
FIG. 25 is a model diagram for explaining a configuration of the drive portion of the carry unit.

FIG. 25 is a model diagram for describing a configuration of a drive section of the carry unit 20. The paper supply roller 21 and the carry roller 23 are driven by a single carry motor 22 connected through respective gears. Therefore, there is provided a clutch 27 between the paper supply roller 21 and the carry roller 22, and the carry roller 23 can be rotated alone by disengaging the clutch 27. That is, the power of the carry motor 22 is transmitted to a gear G4 provided at one end of the axis 23*a* of the carry roller 23 through gears G1, G2, and G3, so as to rotate the carry roller 23. Further, the power transmitted to the carry roller 23 is transmitted to a gear G9 provided to an axis 21*a* of the paper supply roller 21 from the gear G5 provided through the clutch 27 at an other end of the axis 23*a* of the carry roller 23 through three gears G6, G7, and G8, and the paper supply roller 21 is rotated. Here, the ON/OFF timing of the clutch 27 is turned ON in a state that the paper supply roller 21 is not in contact with paper, and is turned off after it is rotated once. That is, the carry roller 21 starts to rotate from a certain position, and then rotates once and stops at the original position.

The platen 24 supports the paper S during printing. The paper discharge roller 25 is a roller for discharging the paper S to outside the printer 1, and is provided on downstream side in the carrying direction of the printable region. The paper discharge roller 25 rotates in synchronization with the carry roller 23.

The carriage unit 30 is for making the head 41 move in a predetermined movement direction. The carriage unit 30 has a carriage 31 and a carriage motor 32 (also referred to as "CR motor"). The carriage 31 can move in a reciprocating manner along the movement direction. The carriage 31 detachably retains an ink cartridge containing ink. The carriage motor 32 is a motor for moving the carriage 31 in the movement direction.

The head unit 40 is for ejecting ink onto paper. The head unit 40 is provided with a head 41. The head 41 has a plurality of nozzles and intermittently ejects ink from those nozzles. The head 41 is provided to the carriage 31 so that when the carriage 31 moves in the movement direction, the head 41 also moves in the movement direction. With ink in a droplet form (hereinafter referred to as "ink droplet") being intermittently ejected while the head 41 is moving in the movement direction, rows of dots arranged in the movement direction (raster lines) are formed on the paper as an example of media.

Figure 26:
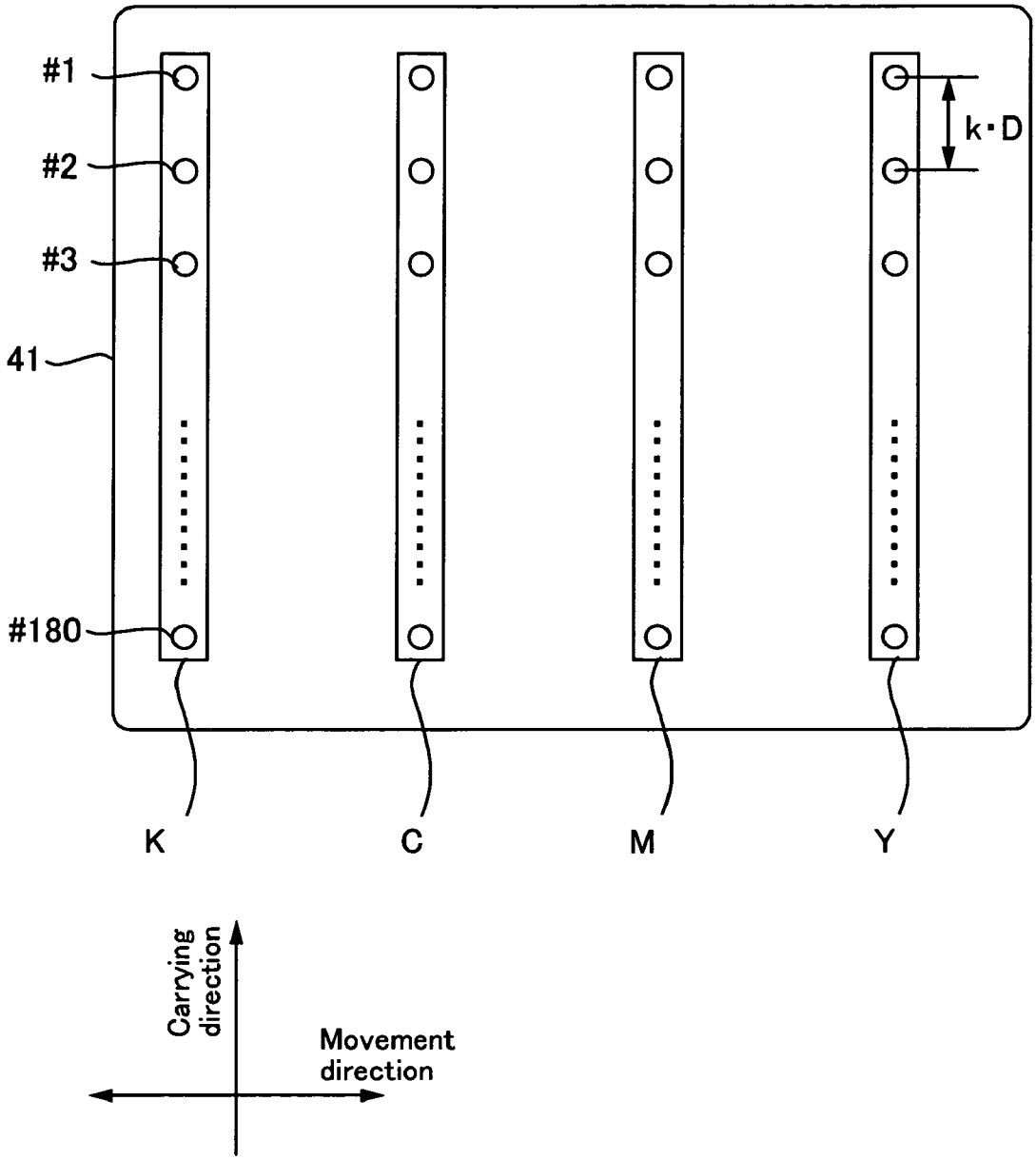
FIG. 26 is an explanatory diagram showing the arrangement of nozzles on a lower surface of a head.

FIG. 26 is an explanatory diagram of the arrangement of the nozzles on the lower surface of the head 41. A black ink nozzle group K, a cyan ink nozzle group C, a magenta ink nozzle group M, and a yellow ink nozzle group Y are formed in the lower surface of the head 41. Each nozzle group is provided with a plurality of nozzles that are ejection openings for ejecting inks of various colors. The plurality of nozzles in each nozzle group are arranged in a row at a constant spacing (nozzle pitch: k·D) in the carrying direction. Here, "D" is the minimum dot pitch in the carrying direction (that is, the spacing of dots formed on the paper S at the maximum resolution). Also, "K" is an integer of 1 or more. For example, if the nozzle pitch is 180 dpi (1/180 inch), and the dot pitch in the carrying direction is 720 dpi (1/720 inch), then K=4. The nozzles of each nozzle group are assigned a number (#1 through #180) that becomes smaller the further downstream the nozzle is. Each nozzle is provided with an ink chamber (not shown) and a piezo element (not shown). The ink chamber expands and contracts due to drive of the piezo element, and ink droplets are ejected from the nozzle.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting the amount of rotation of the carry roller 23, and a code plate 52*a* of the rotary encoder 52 is provided in the shaft of the carry roller 23. For this reason, one rotation detected by the rotary encoder 52 coincides with one rotation of the carry roller 23. The code plate 52*a* of the rotary encoder 52 has slits formed over the entire circumference in the circumferential direction at equal intervals and a small opening formed at one point on the entire circumference in the circumferential direction. In addition, two detectors 52*b* that are respectively constituted by a light-emitting section and a light-receiving section disposed so as to sandwich the plate surface of the code plate 52*a*, are disposed arranged in the diameter direction of the code plate 52*a* so as to detect both the slit and the small opening. That is, one detector 52*b* detects light that passes the slit and detects the rotation amount of the carry roller 23, and the other detector 52*b* detects light that passes the small opening and detects a predetermined position on the circumferential surface of the carry roller 23, such as the reference position, for example, or the fact that the carry roller 23 has finished one rotation. In other words, the rotary encoder 52 is also a detection section for detecting the reference position on the circumferential surface of the carry roller 23. Further, the rotary encoder 52 also detects the rotation amount of the carry roller 21 that has been connected through a gear with the carry roller 23.

The paper detection sensor 53 is for detecting the position of the front end of a paper to be printed. The optical sensor 54 is attached to the carriage 31. The optical sensor 54 detects whether or not the paper is present by the light-receiving section detecting reflected light of light that has been irradiated onto the paper by the light-emitting section.

The controller 60 is a control section for performing control of the printer. The controller 60 has an interface section 61, a CPU 62, a memory 63, and a unit control circuit 64. The interface section 61 is for exchanging data between the computer 110, which is an external device, and the printer 1. The CPU 62 is a computational process device for carrying out the overall control of the printer. The memory 63 is for reserving a region for storing programs for the CPU 62 and a working region, for instance, and includes a storage device such as a RAM or an EEPROM. The CPU 62 controls the various units via the unit control circuit 64 in accordance with programs stored in the memory 63.

Scanner

Figure 27A:
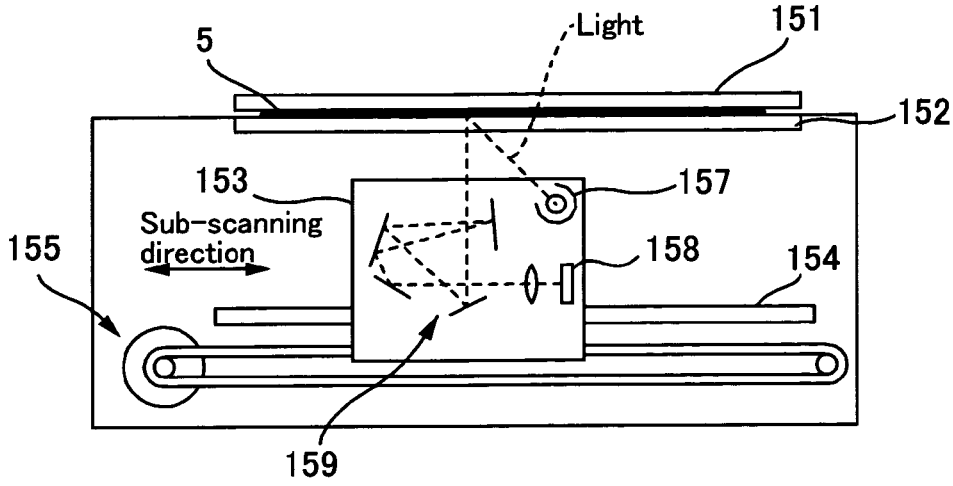
FIG. 27A is a vertical cross sectional view of a scanner.
Figure 27B:
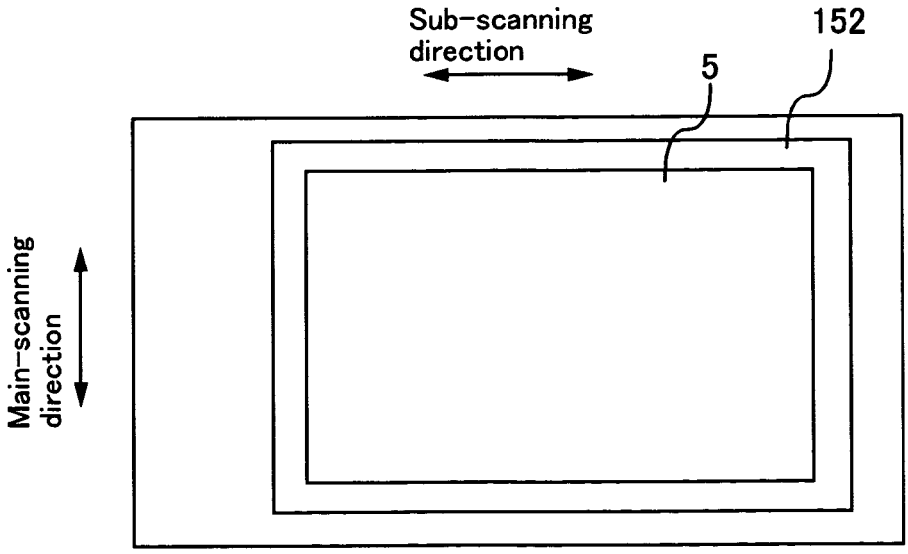
FIG. 27B is a top view of a scanner with the scanner 150 with an upper cover 151 detached.

FIG. 27A is a vertical sectional view of the scanner 150. FIG. 27B is a top view of the scanner 150 with an upper cover 151 detached.

The scanner 150 is provided with the upper cover 151, a document platen glass 152 on which a document 5 is placed, a reading carriage 153 that moves in a sub-scanning direction while opposing the document 5 through the document platen glass 152, a guiding member 154 that guides the reading carriage 153 in the sub-scanning direction, a moving mechanism 155 for moving the reading carriage 153, and a scanner controller (not shown) that controls each section of the scanner 150. The reading carriage 153 is provided with an exposure lamp 157 that irradiates light on the document 5, a line sensor 158 that detects an image of a line in the main-scanning direction (in FIG. 27A, the direction perpendicular to the paper surface), and an optical system 159 for guiding light reflected by the document 5 to the line sensor 158. The dashed lines in the reading carriage 153 shown in FIG. 27A show the path of light.

When reading an image of the document 5, an operator opens the upper cover 151, places the document 5 on the document platen glass 152, and closes the upper cover 151. Then, the scanner controller causes the reading carriage 153 to move along the sub-scanning direction letting the exposure lamp 157 emit light, and the line sensor 158 reads the image on the surface of the document 5. The scanner controller transmits the read image data to the scanner driver of the computer 110, and the computer 110 obtains the image data of the document 5.

Printing Method

Regarding Printing Operation

Figure 28:
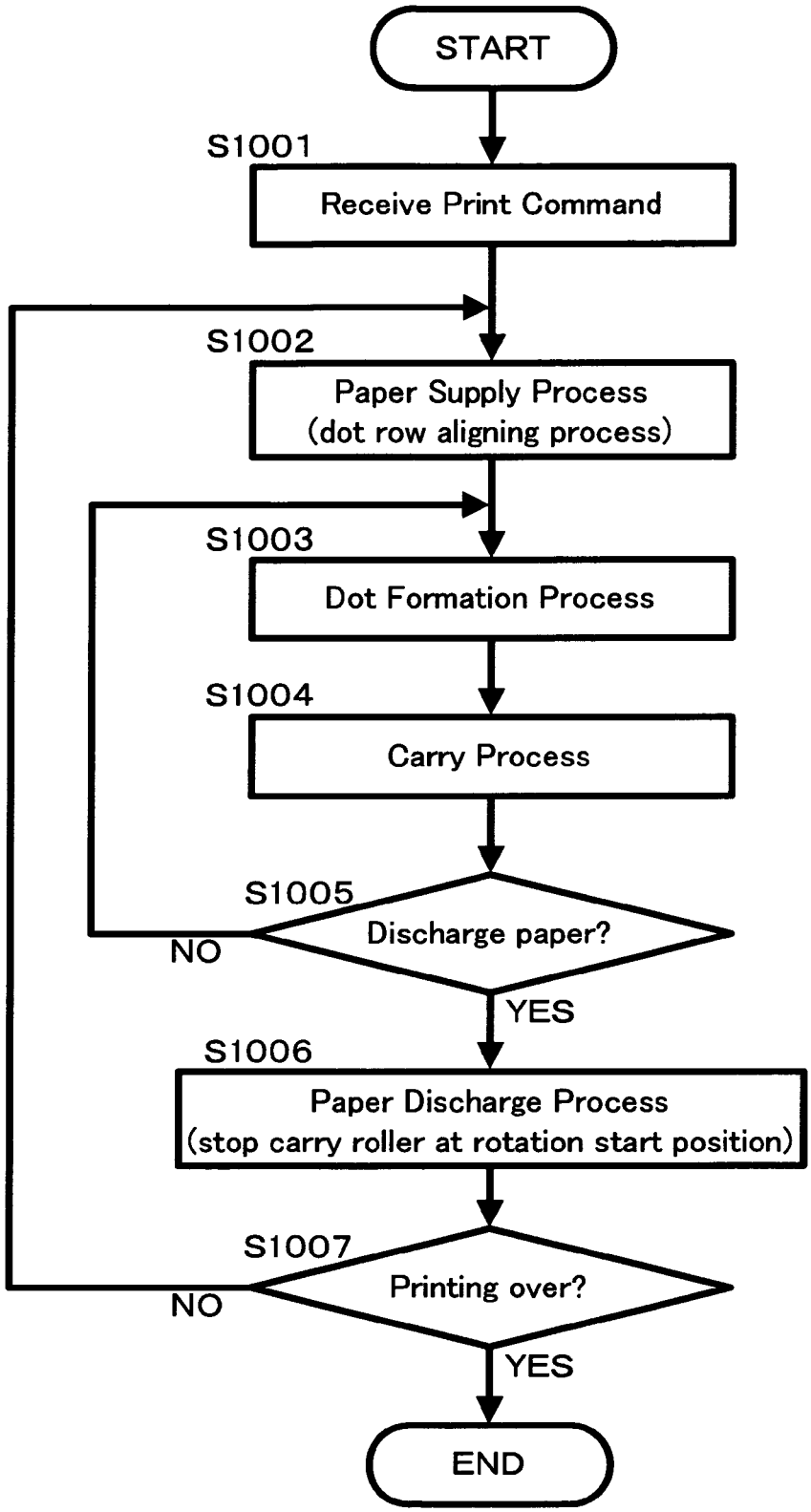
FIG. 28 is a flowchart of the processes during printing.

FIG. 28 is a flowchart of the processes during printing. The processes described below are executed by the controller 60 controlling the various units in accordance with programs stored in the memory 63. The programs include codes for executing the various processes.

Receive Print Command (S1001): First, the controller 60 receives a print command from the computer 110 via the interface section 61. This print command is included in a header of the print data transmitted from the computer 110 along with information such as print conditions. The controller 60 then analyzes the content of the various commands included in the received print data, and performs the following processes such as a paper supply process, a carry process, and a dot forming process by using each of the units.

Paper supply process (S1002): The paper supply process is a process for supplying paper to be printed into the printer and positioning the paper at a print start position (also referred to as "indexing position"). The controller 60 rotates the paper supply roller 21 and the carry roller 23, and positions the paper at the print start position.

Dot forming process (S1003): The dot forming process is a process for causing ink to be intermittently ejected from the head 41 that moves along the movement direction so as to form dots on the paper. The controller 60 drives the carriage motor 32 and moves the carriage 31 in the movement direction, and then while the carriage 31 is moving, causes ink to be ejected from the head 41 in accordance with data for each unit region included in the print data (hereinafter referred to as "unit region data"). Dots are formed on the paper when ink droplets ejected from the head 41 land on the paper. Since ink is intermittently ejected from the head 41 that is moving, dot rows (raster lines) consisting of a plurality of dots in the movement direction are formed on the paper.

Carry process (S1004): The carry process is a process for moving the paper relatively in respect to the head 41 in the carrying direction. The controller 60 rotates the carry roller 23 and carries the paper in the carrying direction. Through this carry process, the head 41 can form dots during a next dot forming process at positions that are different from the positions of the dots formed in the preceding dot forming process. The details of the paper supply process and the carry process are described later.

Paper Discharge Determination (S1005): The controller 60 determines whether or not to eject (discharge) the paper being printed. The paper is not discharged if there remains data to be printed on the paper being printed. The controller 60 alternately repeats the dot forming process and the carry process until there is no more data to be printed, thereby gradually printing an image consisting of dots on the paper.

Paper Discharge Process (S1006): When there is no more data to be printed on the paper being printed, the controller 60 discharges that paper by rotating the paper discharge roller. It should be noted that whether or not to discharge the paper can also be determined based on a paper discharge command included in the print data.

Print Over Determination (S1007): Next, the controller 60 determines whether or not to continue printing. If the next sheet of paper is to be printed, then printing is continued, and the paper supply process for the next paper starts. If the next sheet of paper is not to be printed, then the printing operation is terminated.

Regarding Formation of Raster Lines

First, regular printing is described. The regular printing of the present embodiment is carried out using a printing mode referred to as interlace mode (hereinafter referred to as "interlace printing"). Here, "interlace printing" means a printing scheme in which a row region in which no raster line is recorded is sandwiched between raster lines that are recorded in one pass. Further, a "pass" refers to one dot forming process carried out while the carriage 31 moves one time, and "pass n" refers to the nth dot forming process. A "raster line" refers to a row of dots arranged in the movement direction and a "row region" is a region in which a raster line can be formed.

Figure 29A:
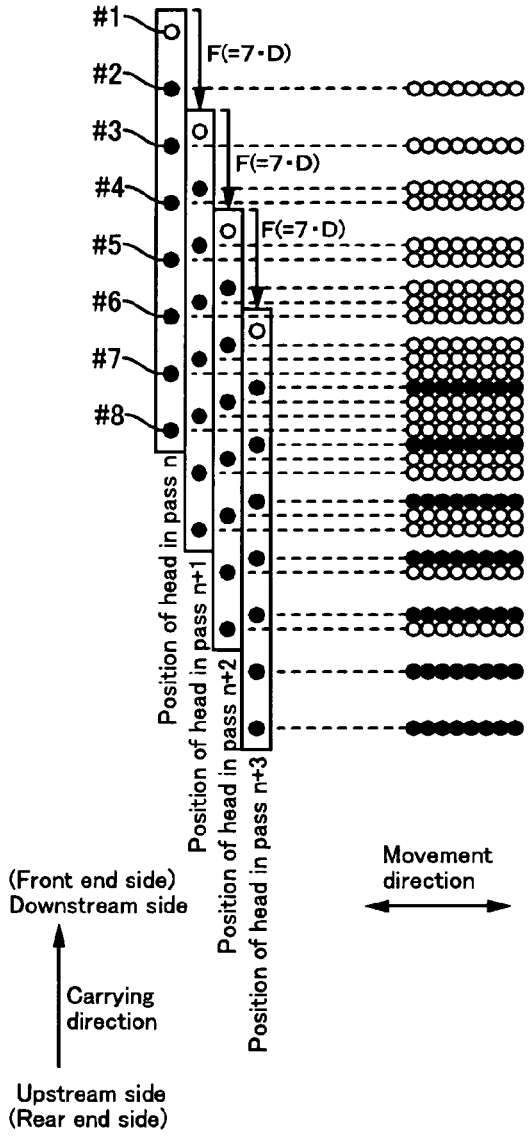
FIG. 29A shows the position of the head and how dots are formed in pass n to pass n+3.
Figure 29B:
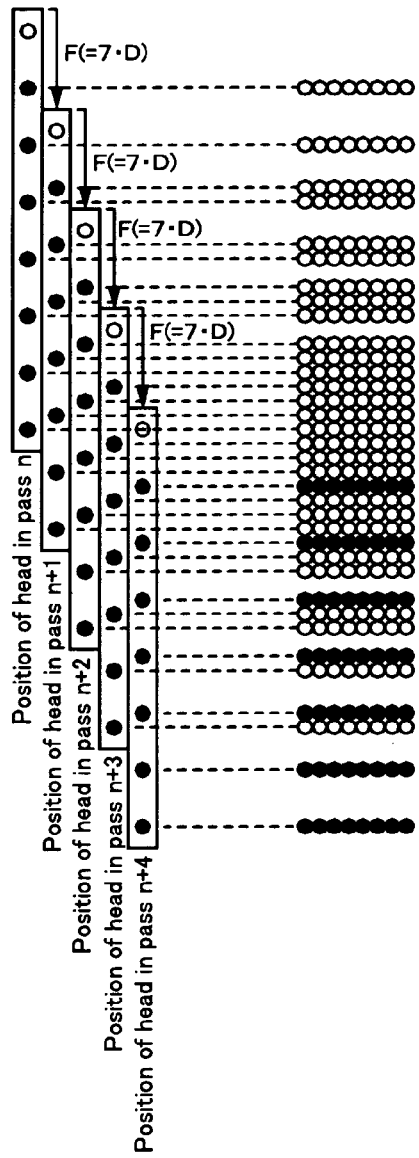
FIG. 29B shows the position of the head and how the dots are formed in pass n to pass n+4.

FIGS. 29A and 29B are diagrams for explaining the normal printing. FIG. 29A shows the position of the head and how dots are formed in pass n to pass n+3, and FIG. 29B shows the position of the head and how the dots are formed in pass n to pass n+4.

For the convenience of explanation, only one of a plurality of the nozzle groups is shown, and the number of nozzles of the nozzle group is reduced. In addition, the head 41 (or the nozzle group) is illustrated as if moving with respect to the paper, but FIG. 8 shows the relative position of the head 41 and the paper, and in reality the paper is moved in the carrying direction. Furthermore, for the convenience of explanation, each of the nozzles are shown forming only a few dots (circles in the figure), but in reality a large amount of dots are lined up in the movement direction (this row of dots is the raster line) because ink droplets are intermittently ejected from the nozzles that move in the movement direction. Of course, according to the unit region data, there are cases in which a dot is not formed.

In the figure, the nozzle shown by a black circle is a nozzle that can eject ink, and a nozzle shown by an empty circle is a nozzle that can not eject ink. Further in the figure, the dots shown by black circles are dots formed in the last pass, and the dots shown by empty circles are dots formed in previous passes.

In this interlace printing, every time the paper is carried in the carrying direction by a constant carry amount F, each of the nozzles records a raster line immediately above another raster line that was recorded in the immediately prior pass, namely, a raster line on the downstream side in the carrying direction. In order to carry out recording with a constant carry amount in this way, it is necessary to satisfy the following conditions; (1) the number N (integer) of nozzles that can eject ink is coprime to k and (2) the carry amount F is set to N·D. Here, N=7, k=4, and F=7·D (D=1/720 inch).

Correction for Unevenness in Density (Outline)

Regarding Unevenness in Density (Banding)

In this section, for the convenience of explanation, a cause of unevenness in density that occurs in an image printed with monochrome printing is described. In the case of multi-color printing, the cause of the unevenness in density described below occurs for each color.

Figure 30A:
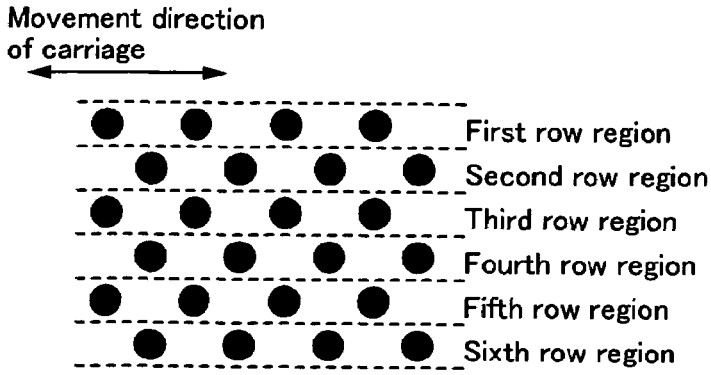
FIG. 30A is an explanatory diagram of a state in which dots are formed in an ideal manner.

FIG. 30A is an explanatory diagram of a state in which dots are formed in an ideal manner. In FIG. 30A, dots are formed in an ideal manner so that each dot is formed precisely in the unit region and the raster line is formed precisely in the row region. In FIG. 30A, the row region is illustrated in the figure as a region between dotted lines, and in this case, the row region has a width of 1/720 inch in width in the carrying direction. In each row region, an image piece which has a density equivalent to the coloring of the region is formed. Here, for the convenience of explanation, an image is printed at a constant density so that the dot-generation rate becomes 50%.

Figure 30B:
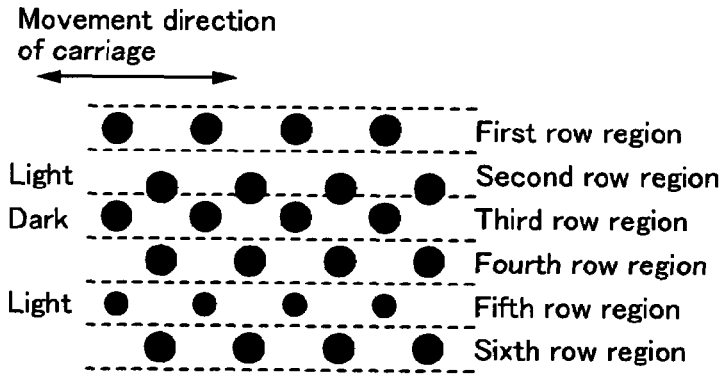
FIG. 30B is an explanatory diagram of the effects of variation in the process accuracy of the nozzles.

FIG. 30B is an explanatory diagram of the effects of variation in the process accuracy of the nozzles. Here, due to variations in the flying direction of the ink droplets ejected from the nozzles the raster line formed in the second row region is formed closer to the side of the third row region (the upstream side in the carrying direction). Moreover, the amount of ink of the ink droplets ejected toward the fifth row region is small, so that the dots formed in the fifth row region are small.

Although originally image pieces of the same density are supposed to be formed in each row region, a variation in the densities of the image pieces occurs depending on the positions in which the raster lines are formed due to variation in the process accuracy, or the like. For example, the image piece of the second row region becomes relatively light, and the image piece of the third row region becomes relatively dark. Further, the image piece of the fifth row region becomes relatively light.

When a printed image constituted by such raster lines is seen macroscopically, unevenness in density in the form of a stripe along the movement direction of the carriage is recognized. This unevenness in density causes the image quality of the print image to deteriorate.

Figure 30C:
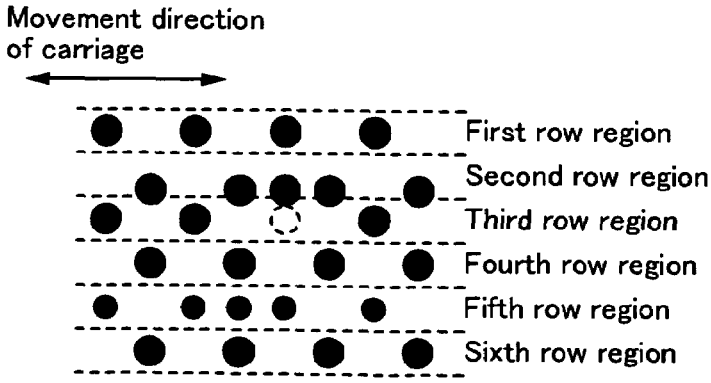
FIG. 30C is an explanatory diagram of when dots are formed by the printing method of this embodiment.

FIG. 30C is an explanatory diagram of dots formed by the printing method of this embodiment. In this embodiment, with respect to a row region that tends to be recognized dark, tone values of the unit region data (CMYK unit region data) of the unit regions corresponding to that row region are corrected so that the image piece is formed to be light. Also, with respect to a row region that tends to be recognized light, tone values of the unit region data of the unit regions corresponding to that row region are corrected so that the image piece is formed to be dark. For example, in FIG. 30C, tone values of the unit region data of the unit regions corresponding to each of the row regions are corrected so that the dot generation rate of the second row region becomes high, the dot generation rate in the third row region becomes low, and the dot generation rate in the fifth row region becomes high. As a result, the dot generation rates of the raster lines formed in each of the row regions are changed, the densities of the image pieces of the row regions are corrected, and the unevenness in density of the entire print image is suppressed.

By the way, in FIG. 30B, the reason that the image piece formed in the third row region becomes dark is not because of the effect of the nozzle that forms a raster line in the third row region, but because of the effect of the nozzle that forms a raster line in adjacent the second row region. Accordingly, if the nozzle that forms a raster line in the third row region forms a raster line in another row region, the image piece formed in the other row region is not necessarily formed dark. In short, even if the image pieces are formed by the same nozzle, if nozzles that form image pieces adjacent to those image pieces are different, the density of those image pieces may be different. In such a case, the unevenness in density cannot be suppressed merely with correction values associated with the nozzles. Thus, in the present embodiment, the tone value of the unit region data is corrected based on the correction values set for the respective row regions.

Therefore, in this embodiment, in the inspection process at a printer manufacturing factory, the printer is caused to print a correction pattern, the correction pattern is read by the scanner, and correction values corresponding to the respective row regions are stored in a memory of the printer based on the densities of the respective row regions in the correction pattern. The correction values stored in the printer reflect the characteristics of unevenness in density of the individual printer.

Then, on the side of the user who has purchased the printer, the printer driver reads the correction values from the printer, and corrects tone values of the unit region data based on the correction values. Then, print data is generated based on the corrected tone values, and the printer performs printing based on the print data.

Regarding Process in Printer Manufacturing Factory

Figure 31:
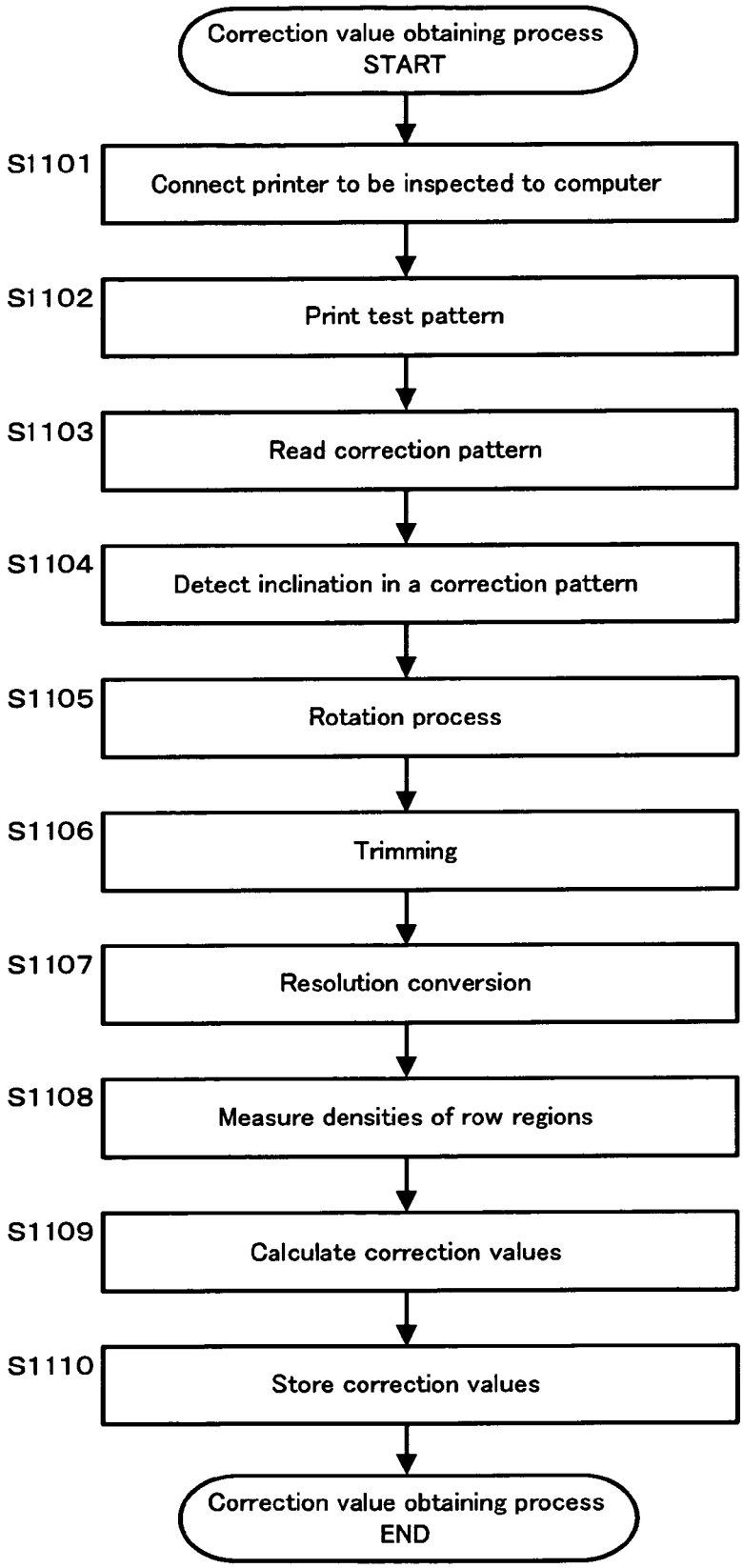
FIG. 31 is a flow chart of the correction value obtaining process that is carried out in the inspection process after the printer is manufactured.

FIG. 31 is a flow chart of the correction value obtaining process that is carried out in the inspection process after the printer is manufactured. First, an inspector connects a printer 1 to be inspected to a computer 110 in a factory (S1101). The scanner 150 is also connected to the computer 110 in the factory. A printer driver for making the printer 1 print a test pattern, a scanner driver for controlling the scanner 150, and a correction value obtaining program for performing image processing, or analyzing, and so forth, with respect to the image data of the correction pattern read by the scanner are installed on the computer 110 in advance.

Next, the printer driver of the computer 110 makes the printer 1 print the test pattern (S1102).

Figure 32:
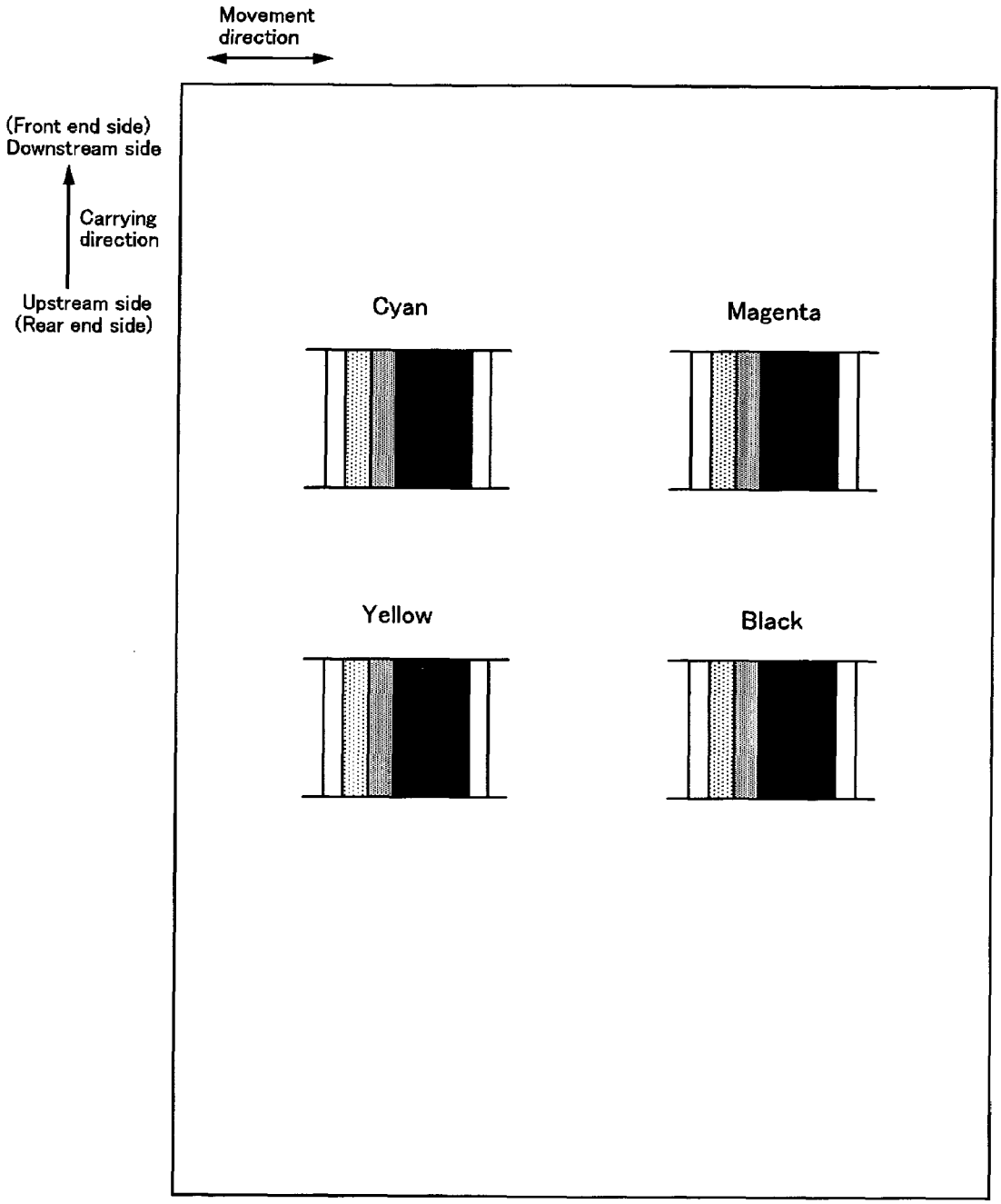
FIG. 32 is an explanatory diagram of a test pattern.
Figure 33:
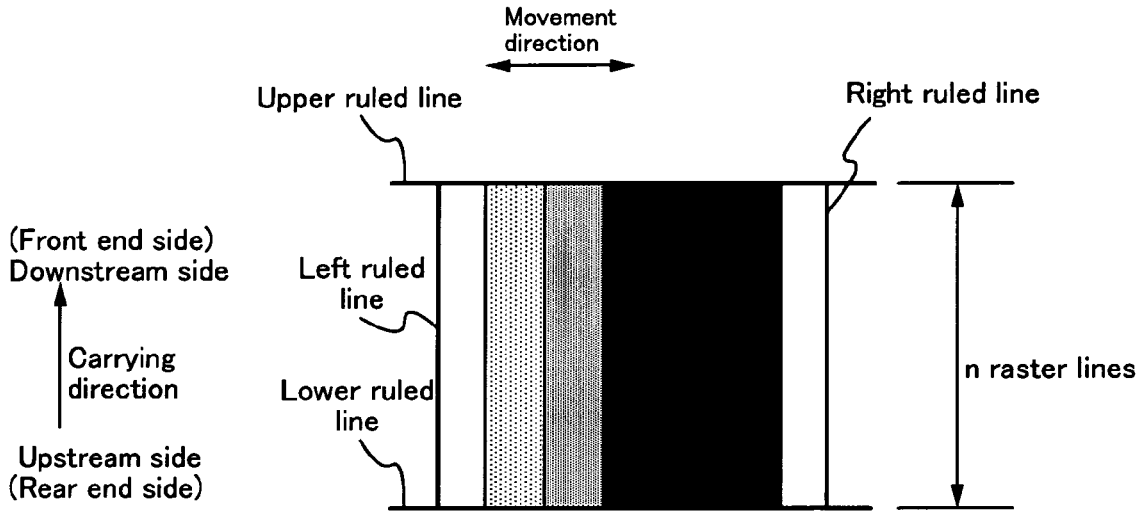
FIG. 33 is an explanatory diagram of a correction pattern.

FIG. 32 is an explanatory diagram of a test pattern. FIG. 33 is an explanatory diagram of a correction pattern. Four correction patterns are formed in the test pattern according to the colors. Each correction pattern is constituted by band-like patterns in five density levels, an upper ruled line, a lower ruled line, a left ruled line, and a right ruled line. Each band-like pattern is generated from image data of a constant tone value, and the band-like patterns consist of, from the left-end band-like pattern to the right side, patterns of the tone value 76 (30% density), tone value 102 (40% density), tone value 128 (50% density), tone value 153 (60% density), and tone value 179 (70% density), with the density increasing in this order. It should be noted that the five tone values (densities) are referred to as "instruction tone values (instruction densities)", and are respectively expressed by symbols as Sa (=76), Sb (=102), Sc (=128), Sd (=153), and Se (=179). Though thousands of raster lines can be formed in the printing region in the normal printing, each band-like pattern is formed arranged in the carrying direction with a number of raster lines corresponding to at least the circumferential length of the carry roller 23 in the printing region in printing the correction pattern. The upper ruled line is formed by the first raster line that configures the band-like pattern (the raster line in the side furthest downstream in the carrying direction). The lower ruled line is formed by the last raster line that configures the band-like pattern (the raster line in the side furthest upstream in the carrying direction).

Next, the inspector places the test pattern printed by the printer 1 on the document platen glass 152 of the scanner 150, closes the upper cover 151, to set the test pattern on the scanner 150. Then, the scanner driver of the computer 110 makes the scanner 150 read the correction pattern (S1103). Reading of the cyan correction pattern is described below (it should be noted that the correction patterns of other colors are read in the same manner).

Figure 34:
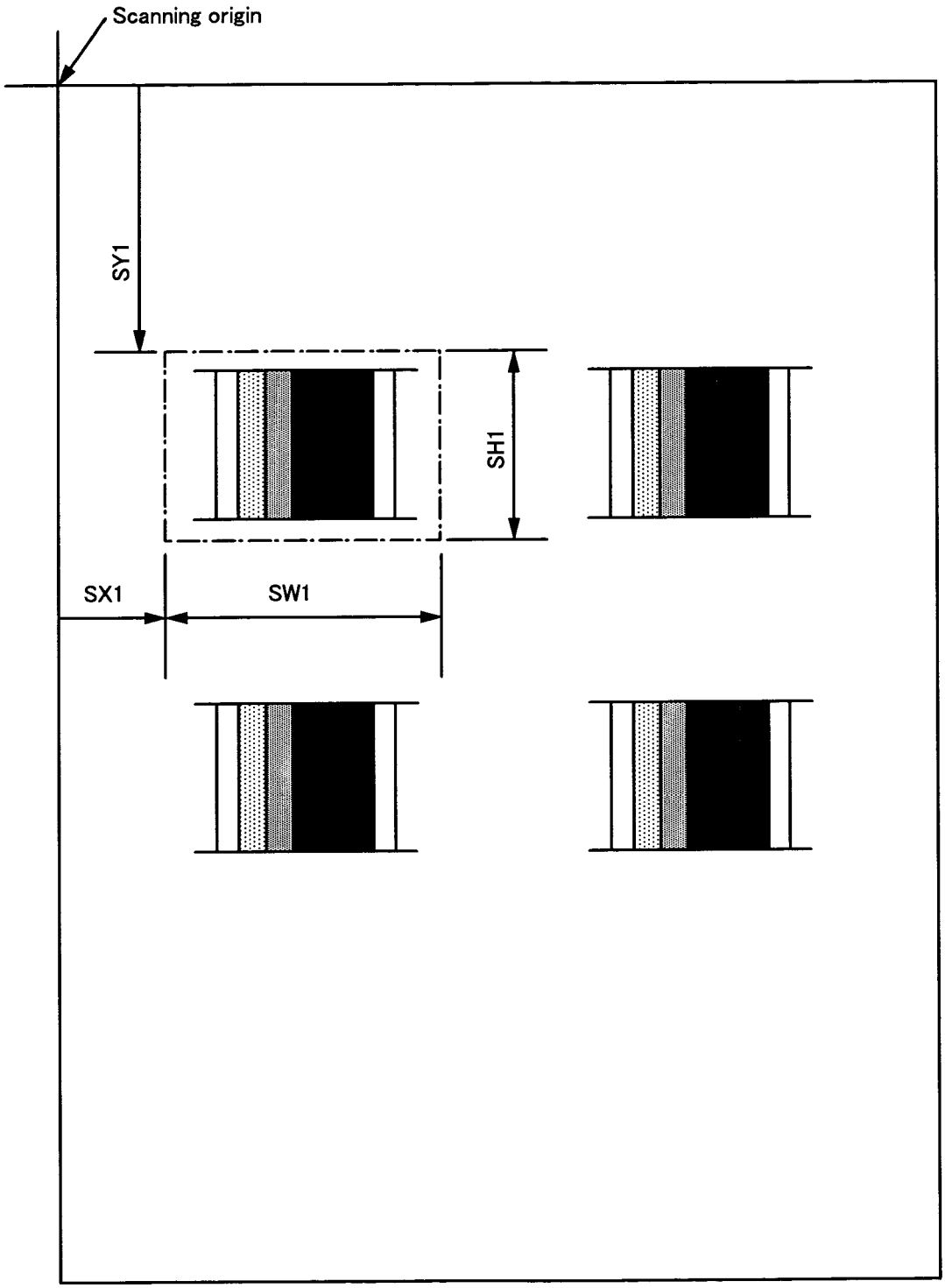
FIG. 34 is an explanatory diagram of the reading range of the cyan correction pattern.

FIG. 34 is an explanatory diagram of the reading range of the cyan correction pattern. The range surrounding the cyan correction pattern with the alternate long-and-short dashed line represents the reading range in reading the cyan correction pattern. The parameters SX1, SY1, SW1, and SH1 for specifying this range are set in advance in the scanner driver by the correction value obtaining program. By making the scanner 150 read this range, it is possible to read the entire cyan correction pattern, even if the test pattern is set on the scanner 150 in a slightly misaligned state. With this process, an image in the reading range shown in the figure is read by the computer 110 as the read image data that contains unit read image data corresponding to each of the minimum read regions that are divided into squares at a resolution of 2880×2880 dpi.

Next, the correction value obtaining program of the computer 110 detects an inclination θ in the correction pattern included in the read image data (S1104), and performs rotation process to the read image data in accordance with the inclination θ (S1105).

Figure 35A:
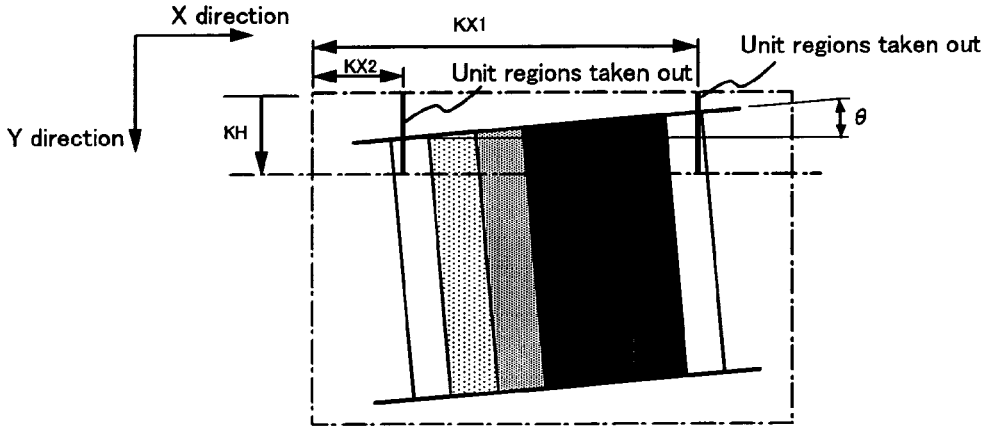
FIG. 35A is an explanatory diagram of read image data at the time of detecting the inclination.
Figure 35B:
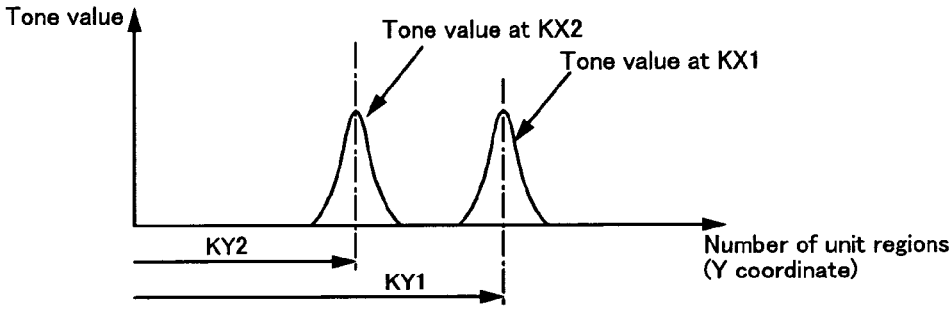
FIG. 35B is an explanatory diagram of detecting the position of the upper ruled line.
Figure 35C:
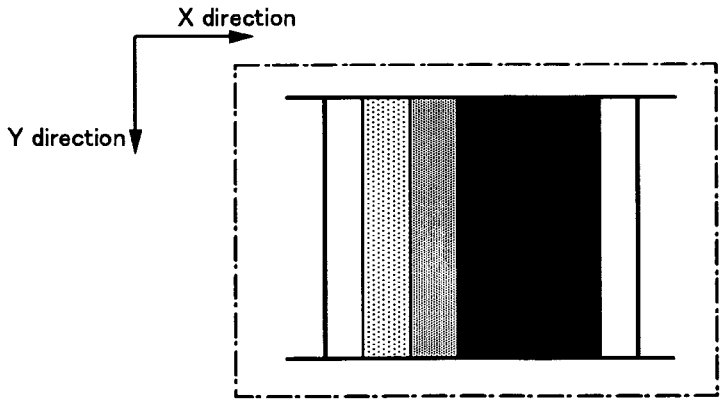
FIG. 35C is an explanatory diagram of the read image data after the rotation process.

FIG. 35A is an explanatory diagram of read image data at the time of detecting the inclination. FIG. 35B is an explanatory diagram of detecting the position of the upper ruled line. FIG. 35C is an explanatory diagram of the read image data after the rotation process.

From the read image data that was read, the correction value obtaining program takes out unit read image data for read regions that has the minimum read region located from the left by a distance of KX1 and consists of KH minimum read regions from the top, and unit read image data for read regions that has the minimum read region located from the left by a distance of KX2 and consists of KH minimum read regions from the top. At this time, the parameters KX1, KX2, and KH are set in advance so that the minimum read regions that are taken out include the upper ruled line, and do not include the right and left ruled lines. Then, in order to detect the position of the upper ruled line, the correction value obtaining program obtains the respective center of gravity positions KY1 and KY2 of the tone values of the KH pieces of pixel data that have been taken out, namely, the center of gravity positions in terms of density distribution. Then, based on the parameters KX1 and KX2 and the center of gravity positions in terms of density distribution KY1 and KY2, the correction value obtaining program calculates the inclination θ of the correction pattern by the following formula, and performs the rotation process of the read image data based on the calculated inclination θ.

$$\theta=\tan-1\{(KY2-KY1)/(KX2-KX1)\}$$

Next, the correction value obtaining program of the computer 110 performs trimming of the read image data and extracts necessary unit read image data from the read image data (S1106).

Figure 36A:
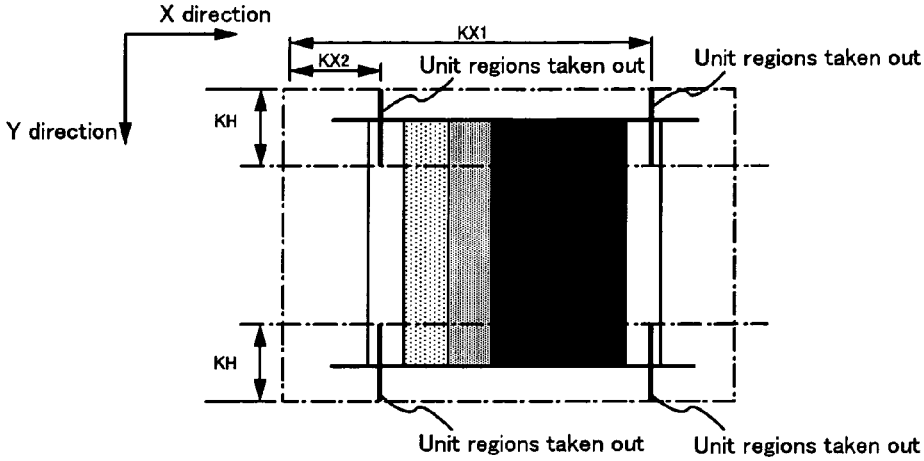
FIG. 36A is an explanatory diagram of read image data at the time of trimming.
Figure 36B:
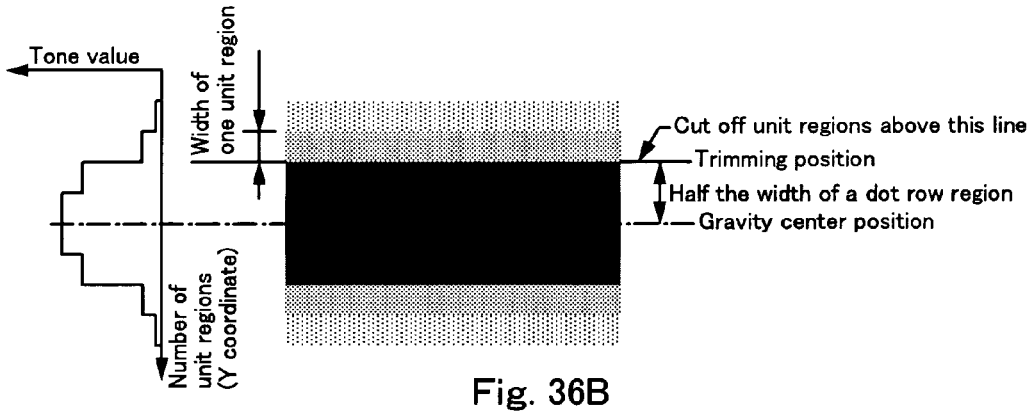
FIG. 36B is an explanatory diagram of the trimming position at the upper ruled line.

FIG. 36A is an explanatory diagram of read image data at the time of trimming. FIG. 36B is an explanatory diagram of the trimming position at the upper ruled line.

As with the process in step S1104, the correction value obtaining program takes out, from the read image data that has been subjected to the rotation process, the unit read image data of KH minimum read regions from the top which are located at a distance of KX1 from the left, and the unit read image data of KH minimum read regions from the top which are located at a distance of KX2 from the left. Then, in order to detect the position of the upper ruled line, the correction value obtaining program obtains the respective center of gravity positions KY1 and KY2 of the tone values of the KH unit read image data that have been taken out, and calculates the average value of the two center of gravity positions. Then the trimming position is determined as the boundary of the minimum read region that is the closest to the position that is shifted to the upper side from the center of gravity position by half the width of the row region. It should be noted that, in this embodiment, the resolution of the read image data is 2880 dpi and the width of the row region is 720 dpi, and therefore a half of the width of the row region corresponds to the width of two minimum read regions. Then, the correction value obtaining program cuts off the minimum read regions in the upper side than the determined trimming position and performs trimming.

Figure 36C:
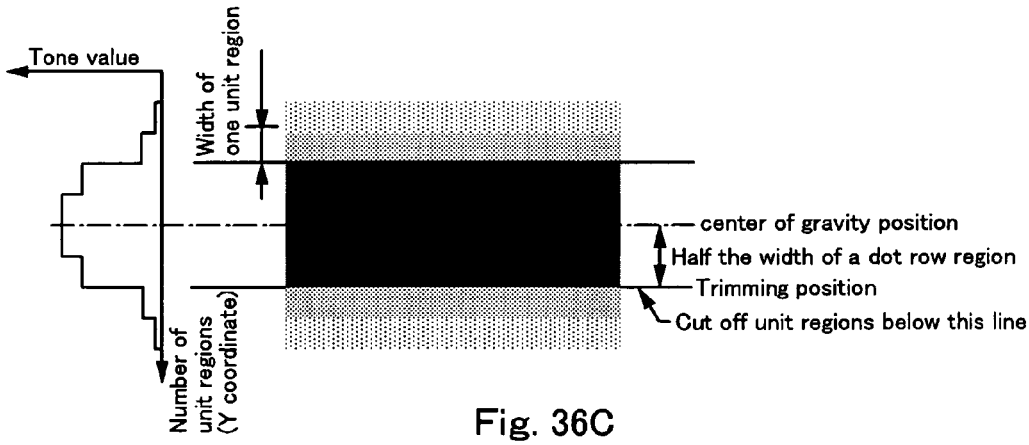
FIG. 36C is an explanatory diagram of the trimming position at the lower ruled line.

FIG. 36C is an explanatory diagram of the trimming position at the lower ruled line.

As similar to the upper ruled line side, the correction value obtaining program takes out, from the read image data that has been subjected to the rotation process, unit read image data for read regions that has the minimum read region located separate from the left by a distance of KX1 and consists of KH minimum read regions, and the unit read image data for read regions that has the minimum read region located separated from the left by a distance of KX2 and consists of KH minimum read regions, and calculates the center of gravity position of the lower ruled line. The trimming position is determined as the boundary of the minimum read region that is the closest to the position that is shifted to the lower side from the center of gravity position by half the width of the row region. Then, the correction value obtaining program cuts off minimum read regions in the lower side than the determined trimming position and performs trimming. Next, the correction value obtaining program of the computer 110 converts the resolution of the trimmed read image data so that the number of minimum read regions in the Y direction becomes equal to the number of raster lines configuring the correction pattern (S1107).

Figure 37:
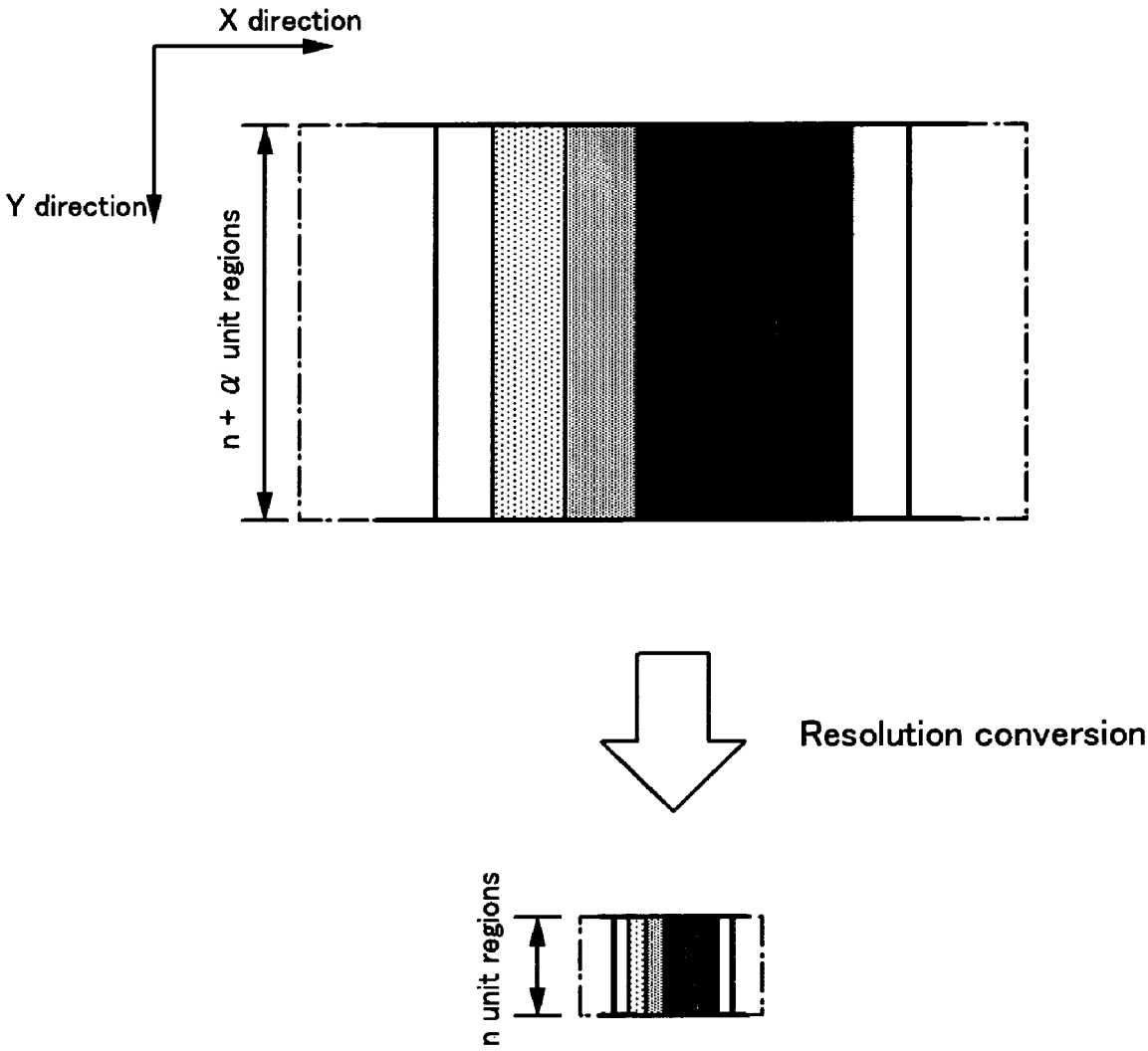
FIG. 37 is an explanatory diagram of resolution conversion.

FIG. 37 is an explanatory diagram of resolution conversion.

If the printer 1 ideally forms a correction pattern consisting of n raster lines at 720 dpi and the scanner 150 ideally reads the correction pattern at 2880 dpi (four times the resolution of the correction pattern), the number of minimum read regions in the Y direction of the read image data after trimming should be "4n". In reality, however, there are cases in which the number of minimum read regions in the Y direction of the read image data does not become 4n due to influence of misalignment during printing or reading, and here, the number of minimum read regions in the Y direction of the read image data after trimming is "$4n+\alpha$". The correction value obtaining program of the computer 110 performs resolution conversion (size-reduction process) on the read image data at a magnification of $n/(4n+\alpha)$ (="number of raster lines configuring the correction pattern"/"number of minimum read regions in the Y direction of the read image data after trimming"). Here, the Bicubic method is used for the resolution conversion. As a result, the number of data in the Y direction of the read image data after resolution conversion becomes n. The region indicated by each of the read image data thus converted corresponds to a unit region which is a region where one dot can be formed. Each of these read image data is referred to as the unit region data. In other words, the read image data of the correction pattern constituted by unit read image data in 2880 dpi is converted into read image data of a correction pattern constituted by unit region data in 720 dpi. As a result, the number of unit regions in the Y direction becomes equal to the number of row regions, and a row of unit regions in the X direction will have a one-to-one correspondence with a row region. For example, the row of unit regions in the X direction located at the top will correspond to the first row region, and the row of unit regions located below the top row will correspond to the second row region. It should be noted that in this resolution conversion, since the object is to adjust the number of the unit region rows in the Y direction to n, resolution conversion (size-reduction process) in the X direction may be omitted.

Next, the correction value obtaining program of the computer 110 measures the density of each of the five band-like patterns in each row region (S1108). Hereinbelow, there is described how the density in the first row region of the band-like pattern on the left formed at the tone value 76 (30% density) is measured (it should be noted that measurement in the other row regions is performed in the same way. Further, measurement of the other band-like patterns is also performed in the same way).

Figure 38A:
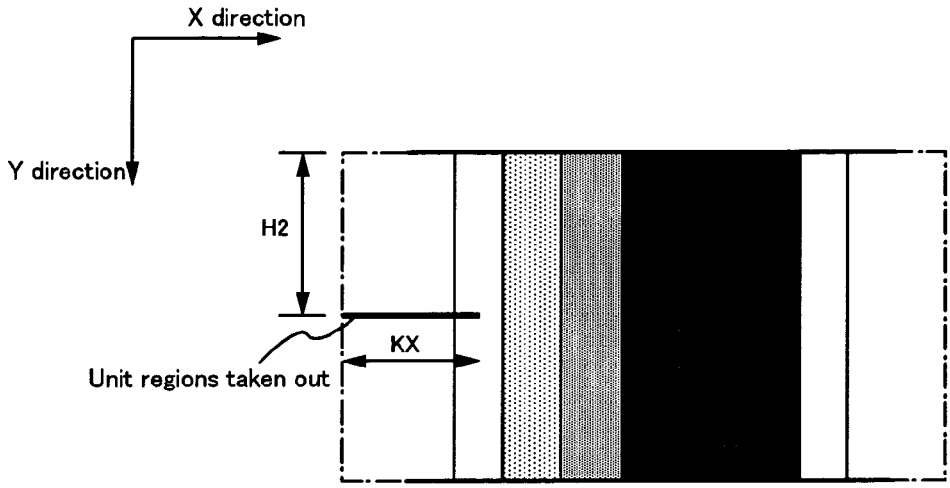
FIG. 38A is an explanatory diagram of image data at the time of detecting the left ruled line.
Figure 38B:
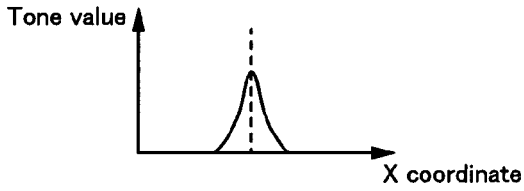
FIG. 38B is an explanatory diagram of detecting the position of the left ruled line.
Figure 38C:
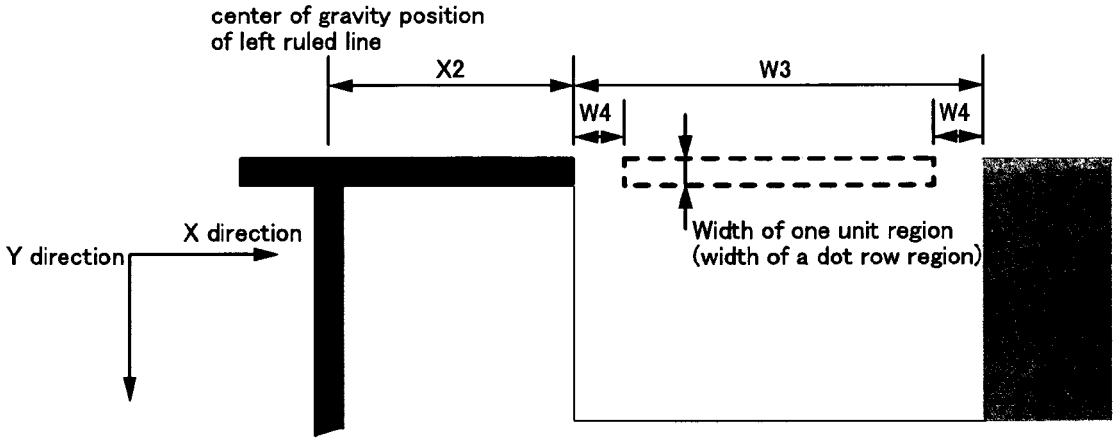
FIG. 38C is an explanatory diagram of the measuring range of the density of a band-like pattern at 30% density in the first row region.

FIG. 38A is an explanatory diagram of image data at the time of detecting the left ruled line. FIG. 38B is an explanatory diagram of detecting the position of the left ruled line. FIG. 38C is an explanatory diagram of the measuring range of the density of a band-like pattern at 30% density in the first row region.

From the read image data that was subjected to the resolution conversion, the correction value obtaining program takes out unit region data for unit regions that has the unit region located from the top by a distance of H2 and consists of KX unit regions from the left. The parameter KX is set in advance so that the left ruled line is included in the unit region data that are taken out at this time. Then, in order to detect the position of the left ruled line, the correction value obtaining program obtains the center of gravity position of the tone values of the unit region data of the KX unit regions that have been taken out. From the shape of the correction pattern, it is known that there is the band-like pattern at 30% density with a width of W3 on the right side of the center of gravity position (the position of the left ruled line) separated by a distance X2. Therefore, the correction value obtaining program uses the center of gravity position as a reference and extracts the unit region data of the range surrounded by the dotted line, excluding the areas on the left and right ends of the band-like pattern with a width W4. The average value of the tone values of the unit region data within that range is determined as the measured value for 30% density of the first row region. It should be noted that when measuring the density of the band-like pattern at 30% density of the first row region, the unit region data of a range that is one unit region below the range in the dotted line in the figure is extracted. In this manner, the correction value obtaining program measures the densities of the five band-like patterns for each row region.

Figures 39, 40:
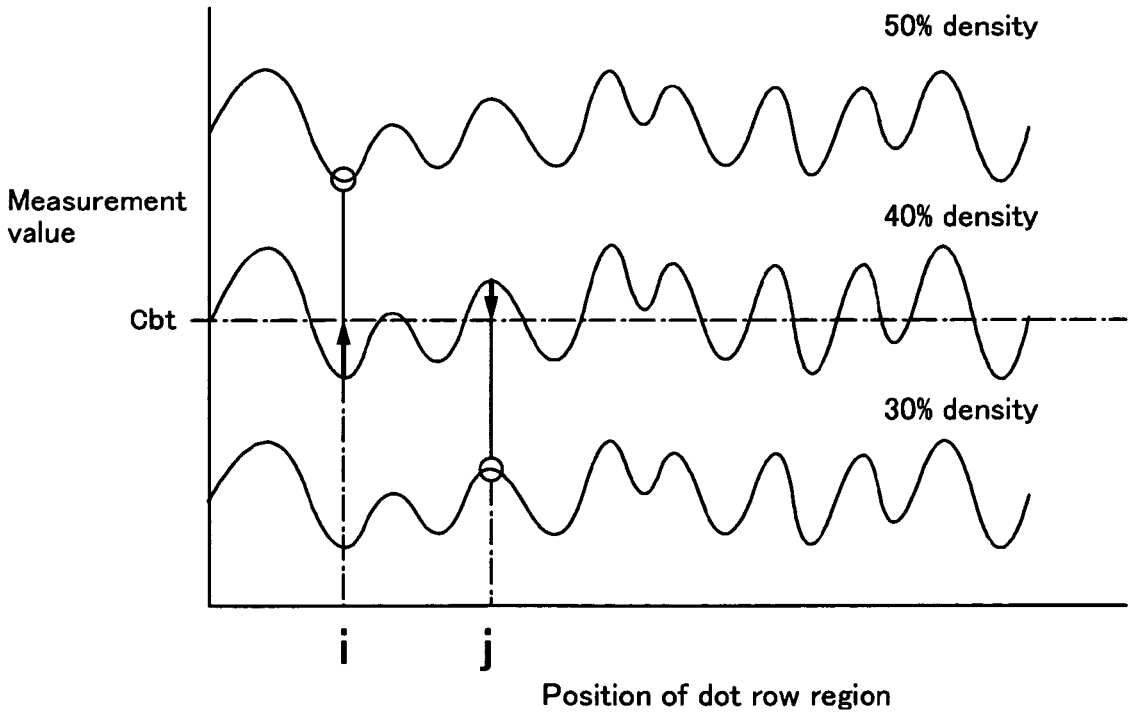
FIG. 39 is a measured value table summarizing measurement results of the density of the five band-like patterns of cyan.
FIG. 40 is a graph showing the measured values of the cyan band-like patterns at 30% density, 40% density, and 50% densities of cyan.

FIG. 39 is a measured value table summarizing measurement results of the density of the five band-like patterns of cyan. As shown in the figure, the correction value obtaining program of the computer 110 associates the measured values of the densities of the five band-like patterns with every corresponding row regions, and creates the measured value table. The measured value tables are also created for the other colors. It should be noted that in the following explanation, with respect to a certain row region, measured values of the band-like patterns having tone values of Sa to Se are indicated respectively as Ca to Ce.

FIG. 40 is a graph showing the measured values of the cyan band-like patterns at 30% density, 40% density, and 50% densities of cyan. Although the band-like patterns are uniformly formed at their respective instruction values, there is an unevenness in density among each of the row regions. These differences in density among each of the row regions are the cause of unevenness in density in a print image.

In order to eliminate the unevenness in density, it is preferable to make the measured values of each band-like pattern to be uniform. Accordingly, a process for making the measured values of the band-like pattern at a tone value Sb (40% density) uniform is considered. Here, an average value Cbt of the measured values of all the row regions in the band-like pattern at the tone value Sb is specified as the target value for 40% density. With respect to the row region i whose measured value is lighter than the target value Cbt, it is considered that the tone value can be corrected in a manner to make the density darker in order for the measured value of density to approach the target value Cbt. On the other hand, with respect to the row region j whose measured value is darker than the target value Cbt, it is considered that the tone value may be corrected in a manner to make the density lighter in order for the measured value of density to approach the target value Cbt.

Accordingly, the correction value obtaining program of the computer 110 calculates correction values corresponding to the row regions (S1109). Here, calculation of a correction value for the instruction tone value Sb in a certain row region is described. As described below, the correction value of the row region i for the instruction tone value Sb (40% density) shown in FIG. 40 is calculated based on the measured values for the tone value Sb and tone value Sc (50% density). On the other hand, the correction value for the instruction tone value Sb (40% density) of the row region j is calculated based on the measured values of the tone value Sb and tone value Sa (30% density).

Figure 41A:
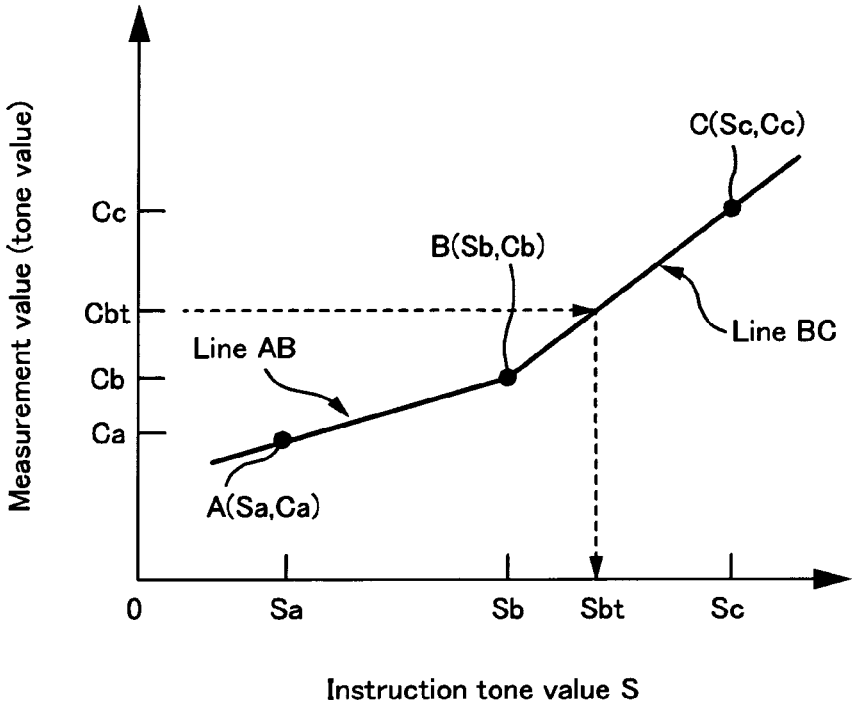
FIG. 41A is an explanatory diagram of the target instruction tone value Sbt for the instruction tone value Sb in the row region i.

FIG. 41A is an explanatory diagram of the target instruction tone value Sbt for the instruction tone value Sb in the row region i. In this row region, the measured value Cb of the density of the band-like pattern formed at the instruction tone value Sb shows a tone value smaller than the target value Cbt (the density of this row region is lighter than the average density of the band-like pattern at 30% density). If the printer driver causes the printer to form a pattern at the density of the target value Cbt in this row region, the printer driver can provide necessary instructions based on the target instruction tone value Sbt calculated by the following formula (linear interpolation based on a line BC).

$$Sbt=Sb+(Sc-Sb)\times\{(Cbt-Cb)/(Cc-Cb)\}$$

Figure 41B:
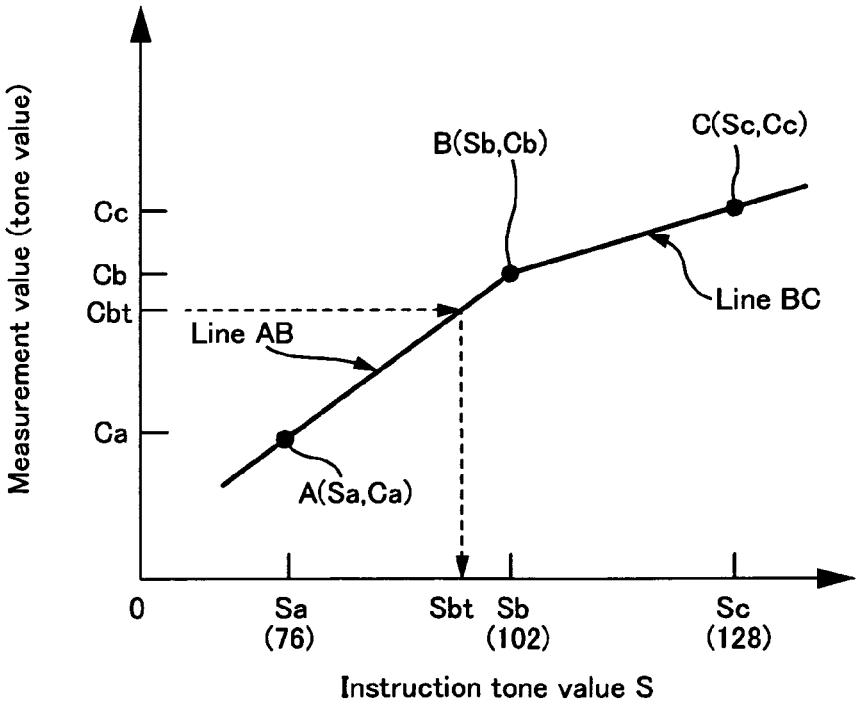
FIG. 41B is an explanatory diagram of the target instruction tone value Sbt for the instruction tone value Sb in the row region j.

FIG. 41B is an explanatory diagram of the target instruction tone value Sbt for the instruction tone value Sb in the row region j. In this row region, the measured value Cb of the density of the band-like pattern formed at the instruction tone value Sb shows a tone value larger than the target value Cbt (this row region is lighter than the average density of the band-like pattern at 30% density). If the printer driver causes the printer to form a pattern of a density of the target value Cbt in this row region, then the printer driver can provide necessary instructions based on the target instruction tone value Sbt that is calculated by the following formula (linear interpolation based on a line AB).

$$Sbt=Sb-(Sb-Sa)\times\{(Cbt-Cb)/(Ca-Cb)\}$$

After calculating the target instruction tone value Sbt in this manner, the correction value obtaining program calculates a correction value Hb for the instruction tone value Sb in this row region by the following formula.

$$Hb=(Sbt-Sb)/Sb$$

The correction value obtaining program of the computer 110 calculates the correction values Hb for the tone value Sb (40% density) for the respective row regions. Similarly, the correction value obtaining program calculates the correction values Hc for the tone value Sc (50% density) for the respective row regions based on the measured values Cc and the measured values Cb or Cd of the row regions. Further, similarly, the correction value obtaining program calculates the correction values Hd for the tone value Sd (60% density) for the respective row regions based on the measured values Cd and the measured values Cc or Ce of the respective row regions. Further, with respect to other colors, three correction values (Hb, Hc, and Hd) are calculated for the respective row regions.

Next, the correction value obtaining program of the computer 110 stores the correction values in the memory 63 of the printer 1 (S1110).

FIG. 42 is an explanatory diagram of a cyan correction value table. In the correction value table, three correction values (Hb, Hc, and Hd) are associated with each row region. For example, three correction values (Hb_n, Hc_n, and Hd_n) are associated with the nth raster line of each row region. Three correction values (Hb_n, Hc_n and Hd_n) respectively associate with the instruction tone values Sb (=102), Sc (=128), and Sd (=153). The above description is also applicable to the correction value tables for other colors.

After storing the correction values in the memory 63 of the printer 1, the correction value obtaining process is ended. Then, the printer 1 and the computer 110 are disconnected, and after other inspections of the printer 1, the printer 1 is shipped from the factory. A CD-ROM storing the printer driver is packed together with the printer 1.

Regarding Processes by Users

Figure 43:
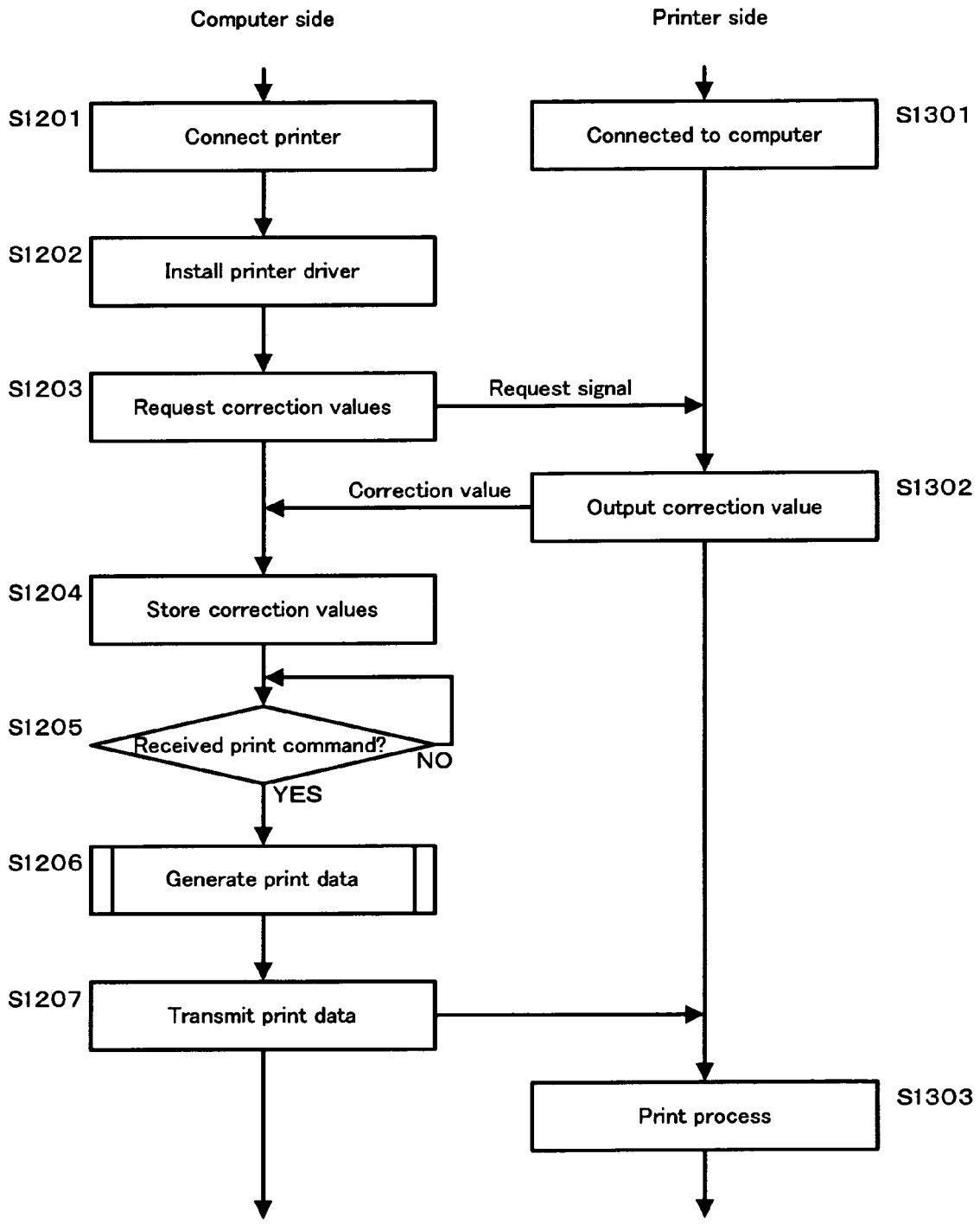
FIG. 43 is a flowchart of the processes performed by the user.

FIG. 43 is a flowchart of the processes performed by the user.

A user who has purchased the printer 1 connects the printer 1 to the computer 110 owned by the user (a computer different from the computer at the printer manufacturing factory, of course) (S1201, S1301). It should be noted that the scanner 150 does not have to be connected to the user's computer 110.

Next, the user sets an included CD-ROM to the record/play device 140, and installs the printer driver (S1202). The printer driver installed on the computer 110 requests the printer 1 to send the correction values to the computer 110 (S1203). Upon such a request, the printer 1 sends to the computer 110 the correction value tables stored in its memory 63 (S1302). The printer driver stores the correction values sent from the printer 1 in the memory (S1204). As a result, the correction value table is created on the computer side. After the above processes are completed, the printer driver stands by until there is a print command from the user ("NO" in S1205).

When the printer driver receives a print command from the user (YES at S1205), it generates print data in accordance with the correction values (S1206), and sends the print data to the printer 1. The printer 1 then performs the print process in accordance with the print data (S1303).

Figure 44:
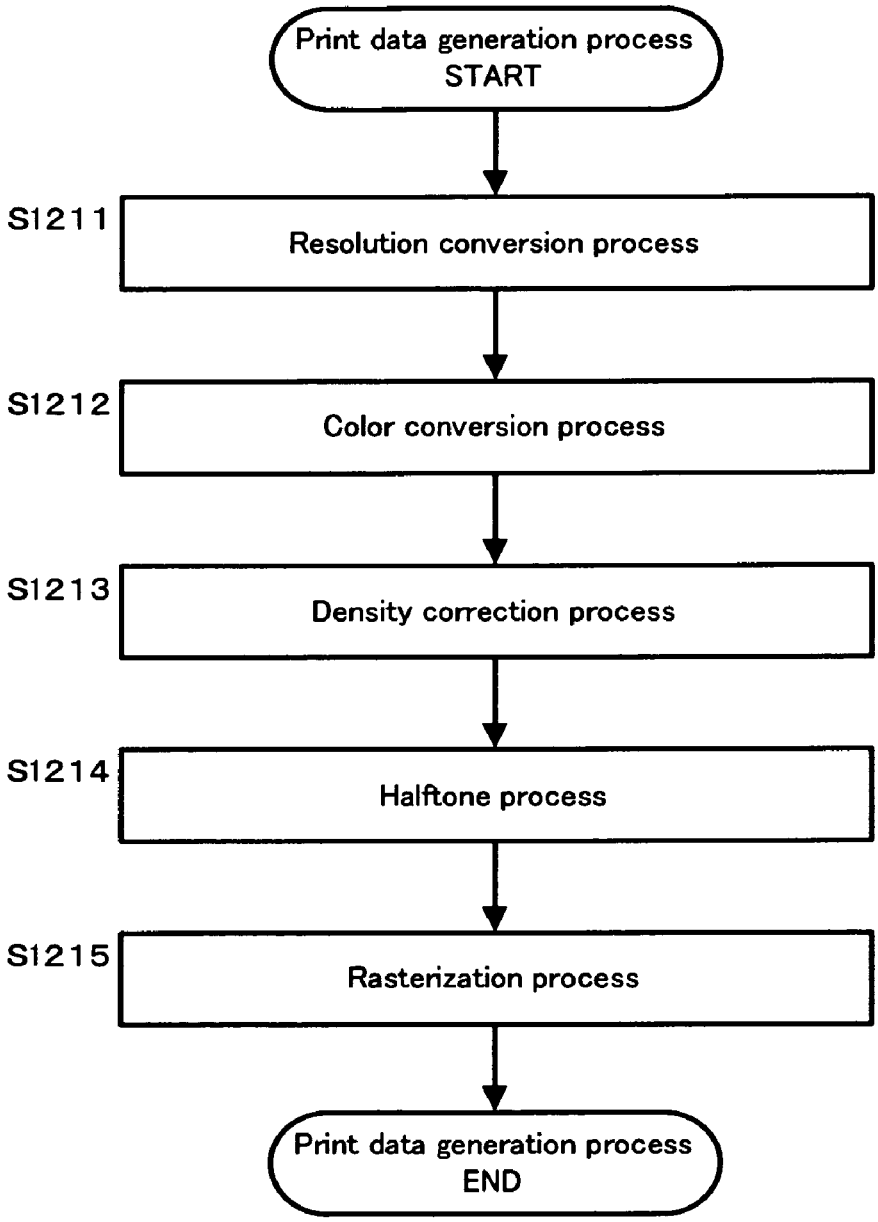
FIG. 44 is a flowchart of print-data generation processes.

FIG. 44 is a flowchart of print-data generation processes. The processes are performed by the printer driver.

First, the printer driver performs the resolution conversion process (S1211). The resolution conversion process is a process in which image data (such as text data and image data) output from the application program is converted to image data of a resolution when printing on paper. For example, when the resolution for when printing an image on paper is specified as 720×720 dpi, then the image data received from the application program is converted to image data of a resolution of 720×720 dpi. It should be noted that, the image data after the resolution conversion process is data with 256 tones expressed using the RGB color space ("RGB data").

Next, the printer driver performs a color conversion process (S1212). The color conversion process is a process in which the RGB data is converted to CMYK data that is expressed using the CMYK color space. The color conversion process is performed by the printer driver referencing a table in which the tone values of the RGB data and the tone values of the CMYK data are associated ("color conversion lookup table LUT"). By this color conversion process, the RGB data for each unit region is converted into CMYK data which corresponds to ink colors. It should be noted that data after the color conversion process is CMYK data having 256 tones expressed using the CMYK color space.

Next, the printer driver performs density correction process (S1213). The density correction process is a process in which the tone value of each unit region data is corrected based on the correction value associated with the row region to which the unit region data belongs to.

Figure 45:
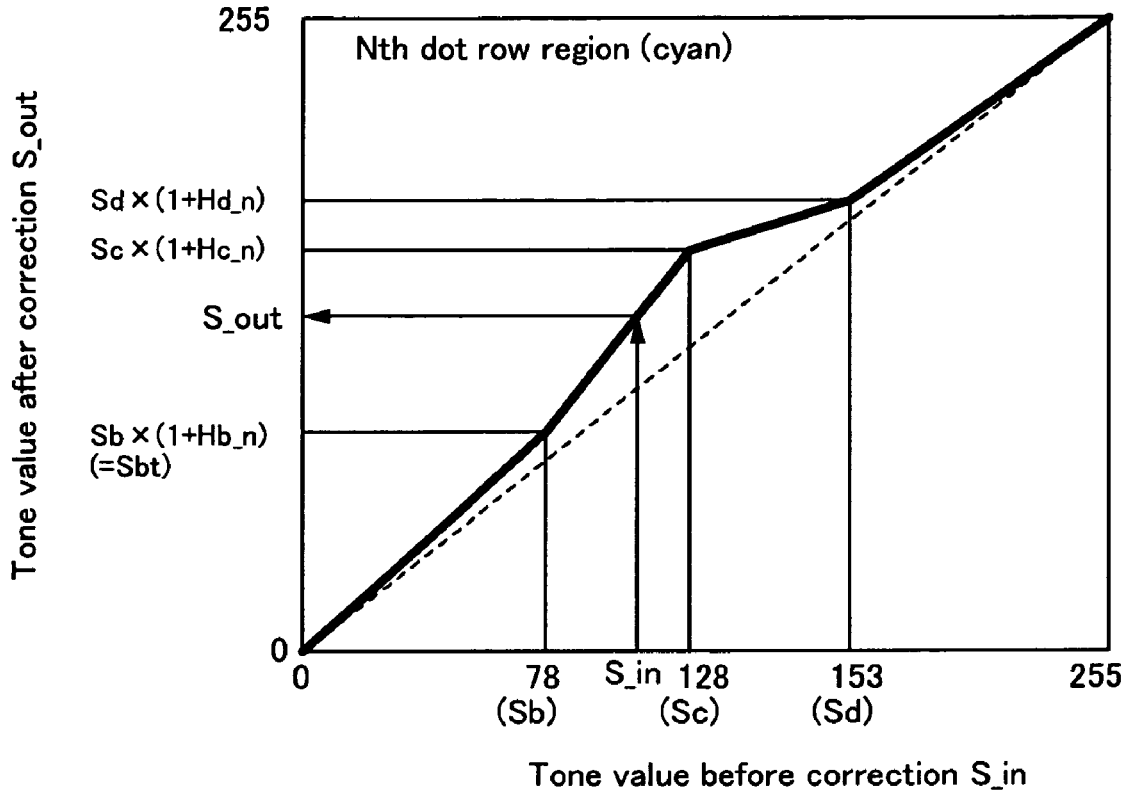
FIG. 45 is an explanatory diagram of the density correction process for an nth row region for cyan.

FIG. 45 is an explanatory diagram of the density correction process for an nth row region for cyan. FIG. 24 shows how the tone value S_in of unit region data of a unit region belonging to the nth row region for cyan is corrected. It should be noted that the tone value after correction is S_out.

If the tone value S_in of the unit region data before correction is the same as the instruction tone value Sb, the printer driver can form an image at the target density Cbt in the unit region corresponding to that unit region data, by correcting the tone value S_in to the target instruction tone value Sbt. That is, if the tone value S_in of the unit region data before correction is the same as the instruction tone value Sb, then it is preferable to correct the tone value S_in (=Sb) to Sb×(1+Hb) using the correction value Hb corresponding to the instruction tone value Sb. Similarly, if the tone value S of the unit region data before correction is the same as the instruction tone value Sc, then it is preferable to correct the tone value S_in (=Sc) to Sc×(1+Hc).

On the contrary, when the tone value S_in before correction is different from the instruction tone value, then the tone value S_out to be output is calculated using linear interpolation as shown in FIG. 24. In the linear interpolation shown in the figure, linear interpolation is performed between the respective tone values S_out after correction (Sbt, Sct, and Sdt) which correspond to the respective instruction tone values (Sb, Sc, and Sd). This, however, is not a limitation. For example, it is possible to calculate a correction value H corresponding to the tone value S_in by performing linear interpolation between the respective correction values (Hb, Hc, and Hd) corresponding to the respective instruction tone values, and calculate the tone value after correction as S_in×(1+H) using the calculated correction value H.

By the density correction process described above, with respect to a row region that tends to be recognized dark, the tone values of the unit region data (CMYK data) of unit regions corresponding to that row region are corrected to a lower value. On the other hand, with respect to a row region that tends to be recognized light, the tone values of the unit region data of unit regions corresponding to that row region are corrected to a higher value. It should be noted that the printer driver performs a similar correction process with respect to the other row regions of other colors as well.

Next, the printer driver performs the halftone process (S1214). The halftone process is a process in which data with a high number of tones is converted to data with a number of tones that can be formed by the printer. For example, through the halftone process, data indicating 256 tones is converted to one-bit data indicating two tones or two-bit data indicating four tones. In the halftone process, the unit region data is generated such that the printer can form dots in a dispersed manner using methods such as dithering, γ-correction, and error diffusion. During the halftone process, the printer driver references a dither table when performing the dithering, references a gamma table when performing the γ-correction, and references an error memory for storing diffused errors when performing the error diffusion. Data that has been subjected to the halftone process has the same resolution (for example, 720×720 dpi) as that of the RGB data described above.

In this embodiment, the printer driver subjects the unit region data whose tone value has been corrected by the density correction process to the halftone process. As a result, with respect to a row region that tends to be recognized dark, the tone value of the unit region data of that row region is corrected to a lower value. Thus, the dot-generation rate of dots configuring the raster line in that row region becomes low. On the other hand, the dot-generation rate becomes high with respect to a row region that tends to be recognized light.

Next, the printer driver performs the rasterization process (S1215). The rasterization process is a process in which image data in a matrix form is changed in an order for transfer to the printer. Rasterized data is output to the printer as the unit region data included in print data.

When the printer performs the print process in accordance with the print data generated as described above, the dot-generation rate of the raster line in each row region is changed as shown in FIG. 30C and the density of the image piece in that row region is corrected, thereby suppressing unevenness in density in the entire printed image.

In the above explanation, to simplify the explanation, the number of the nozzles and the number of the row regions (the number of raster lines) is a few. However, the processes performed by the correction value obtaining program or the printer driver and the like are substantially the same.

Corresponding the Raster Line in the Correction Pattern and the Raster Line in the Image As described above, the printer 1 of this embodiment determines the respective correction values corresponding to each row region, based on the results read from the correction pattern that has been printed in advance, and when printing an image, corrects the image data based on the correction values of the row regions formed with the raster lines of the correction pattern, corresponding to the respective raster lines configuring the image. Here, when the raster lines are assigned a sequence with a raster line that can be formed at the lowermost side in the carrying direction as a first raster line up to the raster line that can be formed at the furthest upstream side, in the image data for printing the image and the correction pattern, the corresponding raster lines are the raster lines that are assigned the same sequence when printing an image and when printing a correction pattern. At this time, the raster line does not have to be actually formed on paper, as long as it can be formed with the image data.

The correction in this embodiment is for suppressing the unevenness in density among the row regions where raster lines are formed along the movement direction of the carriage 31. As described above, the unevenness of density among the row regions can occur due to any of the raster lines to be formed in equal intervals in the carrying direction being formed in a shifted position in the carrying direction. That is, the unevenness of density among row regions can occur due to the carrying characteristics of paper, and not only due to the ink ejection characteristics of the nozzle. Particularly in the case where the carry roller that carries the paper is decentered, due to the portion of the circumferential surface of the carry roller 23 that is in contact with the paper being different, when the paper is carried, there is a case where each time the paper is carried, and further for each paper, the carry amount becomes different and the unevenness in density among the row regions occurs.

Then, as in this embodiment, in the case of correcting the image data for forming each of the raster lines of the print image, based on the read results of the printed correction pattern, if the portion in the circumferential surface of the carry roller 23 that contacts the paper that is carried is different when the correction pattern is printed and when the image is printed after correction, an appropriate correction is not performed, and there is fear that a satisfactory image cannot be printed. Therefore, in this invention, the carry section is controlled in order to make the portion in the circumferential surface of the carry roller that contacts a paper to be carried correspond when the correction pattern is printed and when the image is printed after correction. The process is described below.

The ways of forming the raster lines as a printing method is described above. Thus, here there is mainly described the carrying process of the paper to make the portion in the circumferential surface of the carry roller 23 that contacts the paper to be carried correspond when printing a correction pattern and when printing an image after correction based on the correction pattern.

Figure 46:
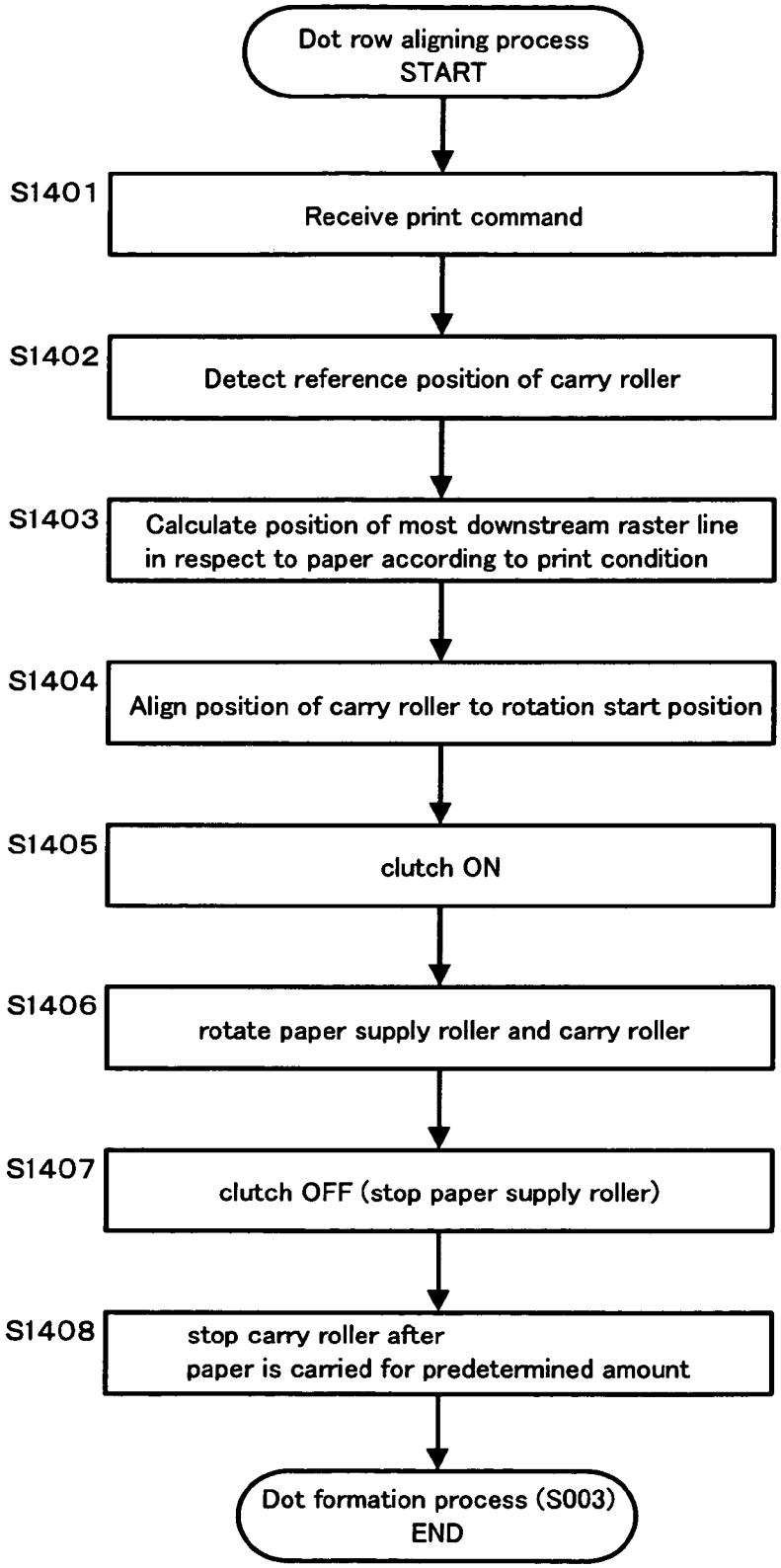
FIG. 46 is a diagram for explaining the process of aligning the position of the raster lines when printing an image and when printing a correction pattern.

FIG. 46 is a diagram for explaining the process of aligning the position of the raster lines when printing an image and when printing a correction pattern.

When the power source of the printer 1 is turned on, in a standby state in which an operation such as printing is not performed, the clutch 27 provided to the axis 23*a* of the carry roller 23 is disengaged. Incidentally, the paper supply roller 21 with a D-shaped cross-section always rotates once and stops at a predetermined position as described above, and starts to rotate from the same position, only in the paper supply operation when the clutch 27 is turned ON/OFF. Thus, even in the standby state, the paper supply roller 21 stops at the predetermined position.

When the printer 1 that is in the standby state receives a print instruction signal together with print data and a command showing print conditions or the like (S1401), from the computer 110 that is connected to the printer, the controller 60 drives the carry motor 22, and makes the carry roller 23 rotate. At this time, the controller 60 is monitoring an output of the rotary encoder 52, and detects a signal output from the rotary encoder 52 when the small opening provided in the code plate 52*a* is detected (S1402). The detected position is one point in the circumferential direction of the code plate 52*a*, which coincides with one point on a circumferential surface of the carry roller 23. The controller 60 recognizes the one point in the circumferential surface as the reference position, and aligns the circumferential surface of the carry roller 23 in order to position the reference position of the carry roller 23, for example, vertically above the axis 23*a* of the carry roller 23 (S1404). That is, in this embodiment, the reference position of the carry roller 23 is a rotation starting position that is positioned vertically above the axis 23*a* of the carry roller 23.

When the reference position of the carry roller 23 is aligned vertically above the axis 23*a* of the carry roller 23, the controller 60 analyzes the print data and the command showing the printing conditions or the like, received together with the print instruction signal, and calculates a relative position of a tip end of a print paper to be printed and a row region in which a raster line can be formed at the furthest downstream side in the print data to be printed (S1403). At this time, the print data can be image data for printing an image such as a landscape or character information, or can be print data for printing a test pattern for various adjustments including the correction pattern. Further, as a result of analyzing the command such as a print condition, in the case where the command is to cause "borderless printing" to be performed as a printing mode, the row region in which a raster line at the furthest downstream side can be formed in the print data is not positioned on paper. Thus, a position of the row region that is assumed to be formed with furthest downstream side raster line in a region outside the print paper, in respect to the tip end position of the paper is calculated. At this time, it is calculated that the position of the raster line that can be formed at the furthest downstream side in the carry direction by ink ejected based on the print data is calculated, is positioned at the upstream side from the tip end of the paper by how many pulses, and can be formed at the downstream side from the tip end of the paper by how many pulses, with the output of the rotary encoder 52.

Next, the controller 60 turns clutch 27 ON, and connects the axis 23*a* of the carry roller 23 and the gear G5 (S1405). Then by driving the carry motor 22, the paper supply roller 21 positioned in the predetermined position, and the carry roller 23 that has been positioned with the reference position positioned vertically above the axis 23*a* of the carry roller 23 are started to rotate simultaneously (S1406). That is, the paper S that has been carried by the paper supply roller 21 that has rotated once from the predetermined position, and the carry roller 23 that has started to rotate from the reference position at the same timing as the paper supply roller 21, are contacted always at substantially the same position in the circumferential surface of the carry roller 23. That is, by making a timing to start rotating the carry roller 23 from the rotation starting position coincide in respect to a timing to start supplying paper by the paper supply roller 21, it is possible to make the paper to be supplied by the paper supply roller 21 to contact the carry roller 23 that has been aligned in the predetermined rotation start position, at a substantially fixed position on the circumferential surface of the carry roller 23.

Then, the controller 60 turns off the clutch 27 at a timing in which the paper supply roller 21 has rotated once, based on the output of the rotary encoder 52, and makes the paper supply roller 21 stop (S1407). Thereafter, the carry roller 23 is made to stop after it has been continuously rotated, to make the position of the furthest downstream side raster line in the carrying direction in respect to the tip end of the paper, that has been calculated, and the position of the nozzle that ejects ink for forming the raster line in the row region at the furthest downstream side in respect to the tip end of the paper to be the same (S1408). At this time, the portion in the circumferential surface of the carry roller that the paper starts to contact is always substantially fixed. Further, the distance that the paper is carried from when the paper and the carry roller are in contact until the carry roller 23 stops is equal due to the printing conditions of the print mode and the like. Thus, the raster lines that are arranged in the same sequence from the front in the carrying direction, in the print data of the image to be printed with the same print conditions, are to be carried by the same portion in the circumferential surface of the carry roller 23.

When the carry roller 23 is made to stop, ink droplets are ejected while moving the carriage 31, and dots are formed on the paper. Thereafter, the carrying process for carrying the paper in increments of a predetermined amount, and a dot forming process for ejecting ink from predetermined nozzles while moving the carriage 31 are repeated, and an image is printed (S1003). The processes thereafter are as described in FIG. 28. At this time, after the paper discharge process (S1006) is performed, the controller 60 makes the carry roller 23 rotate and stop at a rotation starting position, that is, makes the carry roller 23 rotate so that the reference position of the carry roller 23 is positioned at a position vertically above the axis 23*a*, and prepares for the next paper supply process (S1002). In this manner, by rotating the carry roller 23 to the rotation starting position and stopping it, after the paper discharge process (S1006) has finished, it is possible to perform the paper supply process (S1002) as is, without having to align the carry roller 23 in the printing of the next paper. Thus, it is possible to improve throughput.

Then, the correction pattern and the image are printed with the same printing conditions when printing the correction pattern used in correcting the image data in order to suppress the unevenness in density among row regions formed with dot rows along the movement direction of the carriage 31 as described above, and when printing an image after correction based on this correction pattern. Thus, the portion of the carry roller 23 that contacts the paper for carrying the paper when printing the furthest downstream side raster line in the carrying direction of the correction pattern, and the portion of the carry roller 23 that contacts the paper for carrying the paper when printing the furthest downstream side raster line in the carrying direction of the corrected image, substantially coincide. Of course, the portion of the carry roller 23 that contacts the paper for carrying the paper when printing the other raster lines is substantially the same as when printing the correction pattern and when printing the corrected image. Thus, even in the case where the carry roller 23 is decentered, the effect of the decentering is similar for the raster lines that are arranged in the same sequence from the tip end side of the paper when printing the correction pattern and when printing the corrected image. Therefore, by printing the image on the paper that has been carried by the same predetermined portion of the carry roller 23, based on the correction pattern printed on the paper that has been carried by the predetermined portion of the carry roller 23, a more appropriate correction can be performed, and it is possible to print a satisfactory image suppressing the unevenness in density in the carrying direction. At this time, the controller 60 controls the carry unit 20 based on the reference position on the circumferential surface of the carry roller 23 that has been detected by the rotary encoder 52, thus, it is possible to position the reference position on the circumferential surface of the carry roller 23 accurately in the predetermined position, for example, the rotation starting position. Therefore, it is possible to make a paper to be carried and the predetermined portion on the circumferential surface of the carry roller 23 accurately contact each other.

Further, by making the timing to make the carry roller 23 start rotating from the rotation starting position, in respect to the timing to start supplying the paper by the paper supply roller 21 in respect to the carry roller 23 that has been positioned in the predetermined rotation starting position, the paper that is supplied by the paper supply roller 21 can be made to contact the substantially fixed position on the circumferential surface of the carry roller 23. In particular, in this embodiment, after the paper supply roller 21 and the carry roller 23 are positioned in the predetermined rotation starting position, they are simultaneously made to start rotating by the power of a single carry motor 22. Thus, it is possible to coincide the portion on the circumferential surface of the carry roller 23 that is in contact with the paper by a simple control when the raster line of the correction pattern is formed in the row region at the furthest downstream side in the carrying direction, and when the raster line of the image is formed while performing correction based on the correction pattern in the row region at the furthest downstream side in the carrying direction.

Further, the rotary encoder provided with the code plate 52*a* at the axis 23*a* of the carry roller 23 is provided as the detecting section for detecting the rotation of the carry roller 23, so that it is possible to detect easily and more accurately the rotation and the position in the circumferential surface of the carry roller 23. Further, the paper supply roller 21 is connected to the axis 23*a* of the carry roller 23 through the gears G5 to G9, so that the rotation amount of the paper supply roller 21 can be detected easily and accurately by the rotary encoder.

Further, since the correction value is obtained based on the read results of the correction pattern printed based on the image data showing the predetermined tone values, the read results of the printed correction pattern and the predetermined tone values of the image data are corresponded to each other. Then, since the tone values of the image data are corrected based on the read results of the correction pattern, the image data can be corrected more appropriately.

Further, since the rotation starting position of the carry roller 23 is set for each printing condition, the correction pattern printed for each printing condition is printed on paper that has been carried when the carry roller 23 has started rotating from the rotation starting position according to the printing condition. Therefore, the correction pattern according to the respective printing conditions are printed for each printing condition, so that the image data can be appropriately corrected when printing the image with any printing condition, and a satisfactory image can be printed.

According to the printer 1 of this embodiment, since the plurality of the raster lines are printed arranged along the carrying direction, it is possible to read the unevenness in density among row regions formed with raster lines by reading the correction pattern, and since the image data for printing the image is corrected based on the read results of the correction pattern, the unevenness in density among row regions in the print image can be suppressed appropriately.

In this embodiment, there is described an example of configuring the detecting portion for detecting the reference position of the carry roller 23 by the rotary encoder 52. As the detecting portion, however, there can be provided a new gear having the same number of teeth as the gear G4 provided on the axis 23*a* of the carry roller 23 that meshes with the gear G4, and the new gear and the gear G4 can each be provided with electrodes to detect the reference position of the carry roller 23. Specifically, if an electrode is provided on a tip of one tooth of the gear G4, and electrodes are provided over the entire circumference of the new gear, and it is set so that electricity that flows when the electrode on the gear G4 and the electrodes on the new gear contact each other, when the two gears mesh and rotate, is to be detected, the position where the electrode of the gear G4 and the electrodes of the new gear contacted can be detected as the reference position.

Other Embodiments

In the above embodiment, the printing system is mainly described, however, it goes without saying that the disclosures of the printer 1, printing apparatuses, printing methods and the like are included.

Moreover, although a printing system or the like is explained as an embodiment, the foregoing embodiment is for the purpose of elucidating the present invention, and is not to be interpreted as limiting the present invention. The invention can of course be altered and improved without departing from the gist thereof, and includes functional equivalents. In particular, embodiments mentioned below are also included in the present invention.

Furthermore, in the embodiment, a printing system and a printing method that correct unevenness in density generated in the paper carrying direction are described, however it is also possible to apply the correction to unevenness in density in stripe shapes caused in the direction along the carrying direction due to mechanisms constituting the printer 1, for example, by vibrations accompanying the movement of the carriage on which the head is mounted.

Regarding the Printer

In the foregoing embodiment, the printer 1 is described as a printing section, but this is not a limitation. For example, similar technology to that of this embodiment can apply to various types of recording apparatuses that use inkjet technology, such as color filter manufacturing equipment, dyeing equipment, macromachining equipment, semiconductor manufacturing equipment, surface treatment equipment, a three-dimensional molding machine, a vaporizer, an organic EL manufacturing equipment (particularly polymer EL manufacturing equipment), a display manufacturing device, a film formation device, and a DNA chip manufacturing device. Moreover, these methods and manufacturing methods are also included in applications to which the technology as mentioned in this embodiment can apply.

Regarding the Ink

In the foregoing embodiment, a dye ink or a pigment ink was ejected from the nozzles of the printer 1. However, the ink that is ejected from the nozzles is not limited to such inks.

Regarding the Nozzles

In the foregoing embodiment, ink was ejected using piezoelectric elements. However, the mode for ejecting ink is not limited as such. For example, other modes such as a mode for generating bubbles in the nozzles through heat also may be employed.

Regarding the Carriage Movement Direction in which Ink is Ejected

In the foregoing embodiment, an example of uni-directional printing in which ink is ejected only when the carriage 31 is moving forward is described, however this is not a limitation, and it is also possible to perform so-called bi-directional printing in which ink is ejected in bi-directional movement when the carriage 31 is moving forward and backward.

Regarding the Color Inks Used for Printing

In the foregoing embodiment, an example of multicolor printing is described in which the four color inks such as cyan (C), magenta (M), yellow (Y), and black (K) are ejected onto the paper S to form dots, but the ink colors are not limited to these. For example, it is also possible to use other inks such as light cyan (cyan in light tone, LC), light magenta (magenta in light tone, LM) and the like in addition to these ink colors.

Conversely, it is also possible to perform monochrome printing using only one of above four ink colors.

What is claimed is:

1. A printing apparatus comprising:

a carry section provided with a carry roller for intermittently carrying a medium on which an image is to be printed in increments of a predetermined amount in a carrying direction;

a nozzle that forms a dot based on corrected data obtained by correcting image data for printing the image on the medium that has been carried by the carry section;

a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount; and a controller that causes a dot to be formed based on the corrected data that has been corrected based on the correction value table;

wherein the nozzle forms a row of dots on the medium by ejecting ink while being moved in a movement direction that intersects the carrying direction, and the correction value table is created based on a read result of a correction pattern so as to suppress unevenness in density between row regions each formed with the row of dots arranged along the movement direction, and wherein the image data indicates a tone value of each unit region, a correction value is obtained for each row region based on the read result of the correction pattern that is printed based on the image data indicating a predetermined tone value, and, in the correction value table, the set region that was in contact with the medium during the carrying operation immediately before the dot forming operation that formed the row of dots configuring the correction pattern is associated with a correction value corresponding to the row region in which a row of dots is formed by that dot row forming operation.

2. A printing apparatus according to claim 1, wherein the image is printed by alternately repeating a carrying operation for carrying the medium and a dot forming operation for forming the dot, and in the correction value table, the set region that was in contact with the medium when the medium was carried by the carrying operation is associated with a correction value for correcting the image data that is to be used in the dot forming operation after that carrying operation.

3. A printing apparatus according to claim 2, comprising, a detection section for detecting the reference position and a displacement amount of the reference position in the carrying operation, wherein the controller detects the set region that was in contact with the medium when the medium was carried by the carrying operation by detecting the displacement amount with the detection section.

4. A printing apparatus according to claim 3, wherein the detection section is a rotary encoder for detecting a rotation amount of the carry roller.

5. A printing apparatus according to claim 1, wherein the theoretical circumferential surface length of the set region corresponding to n rotations (n is an integer) of the carry roller coincides with an amount which is obtained by multiplying by an integer the theoretical amount of the predetermined amount.

6. A printing apparatus according to claim 1, wherein in the correction pattern, a plurality of the rows of dots formed by ink ejected from the nozzle that is moved in the movement direction are printed arranged along the carrying direction based on a tone value indicating a predetermined density.

7. A printing apparatus according to claim 1, wherein the correction pattern includes rows of dots corresponding to row regions included in a theoretical carrying distance by which the medium is carried when the carry roller rotates n times that coincide with an amount obtained by multiplying by an integer the theoretical amount of the predetermined amount.

8. A printing method comprising:

carrying a medium by a carry section provided with a carry roller for intermittently carrying the medium on which an image is to be printed in increments of a predetermined amount in a carrying direction; and forming a dot based on corrected data obtained by correcting the image data for printing the image based on a correction value table in which a set region is associated with a correction value for performing the correction, the set region being virtually set so that a theoretical circumferential surface length of the set region from a predetermined reference position in a circumferential direction of the carry roller is equal to a theoretical amount of the predetermined amount, wherein a row of dots is formed on the medium by ejecting ink while a nozzle is being moved in a movement direction that intersects the carrying direction, and the correction value table is created based on a read result of a correction pattern so as to suppress unevenness in density between row regions each formed with the row of dots arranged along the movement direction, and wherein the image data indicates a tone value of each unit region, a correction value is obtained for each row region based on the read result of the correction pattern that is printed based on the image data indicating a predetermined tone value, and, in the correction value table, the set region that was in contact with the medium during the carrying operation immediately before the dot forming operation that formed the row of dots configuring the correction pattern is associated with a correction value corresponding to the row region in which a row of dots is formed by that dot row forming operation.

* * * * *